US006122847A

United States Patent [19]

Treu et al.

[11] Patent Number: 6,122,847

[45] **Date of Patent: *Sep. 26, 2000**

[54] METHOD OF AND APPARATUS FOR INSTALLATION OF PLATE ANCHORS

[75] Inventors: Johannes J. Treu, Belleville; Gordon R. Wilde, Houston; Peter Dove, Magnolia, all of Tex.

[73] Assignee: Aker Marine Contractors, Inc., Houston, Tex.

[ * ] Notice: This patent is subject to a terminal disclaimer.

[21] Appl. No.: 09/190,810

[22] Filed: Nov. 12, 1998

Related U.S. Application Data

[63] Continuation-in-part of application No. 08/971,518, Nov. 17, 1997, Pat. No. 5,992,060.

[51] Int. Cl.[7] ..... E02D 7/00

[52] U.S. Cl. ..... 37/345; 405/224; 114/296

[58] Field of Search ..... 37/323, 325, 345; 114/296, 295, 264, 230.13; 405/224, 195.1, 226, 204

[56] References Cited

U.S. PATENT DOCUMENTS

| | | | |
|---|---|---|---|
| 3,295,489 | 1/1967 | Bossa | 114/230 |
| 3,411,473 | 11/1968 | Mott et al. | 114/296 |
| 3,431,879 | 3/1969 | Westling | 405/224 X |
| 3,540,396 | 11/1970 | Bossa | 114/230 |
| 3,602,174 | 8/1971 | Gorman | 114/230 |
| 3,703,151 | 11/1972 | Clement | 114/230 |
| 4,024,718 | 5/1977 | Roche et al. | 405/190 |
| 4,086,866 | 5/1978 | Nixon | 114/295 |
| 4,164,195 | 8/1979 | Frigeni | 114/322 |
| 4,222,591 | 9/1980 | Haley | 285/920 X |
| 4,257,721 | 3/1981 | Haynes | 405/227 |
| 4,318,641 | 3/1982 | Hogervorst | 405/224 |
| 4,347,012 | 8/1982 | Glidden | 403/2 |
| 4,432,671 | 2/1984 | Westra et al. | 405/226 |
| 4,439,068 | 3/1984 | Poklandnik | 166/338 X |
| 4,601,608 | 7/1986 | Ahlstone | 285/920 X |
| 4,635,728 | 1/1987 | Harrington | 166/341 |
| 4,721,415 | 1/1988 | Shatto | 405/224.1 |
| 4,733,993 | 3/1988 | Andreasson | 405/224 |
| 4,830,541 | 5/1989 | Shatto | 405/226 |
| 4,940,362 | 7/1990 | Paulshus et al. | 405/224 |
| 5,041,038 | 8/1991 | Poldervaart et al. | 440/5 |
| 5,159,891 | 11/1992 | Lohr et al. | 114/230 |
| 5,480,521 | 1/1996 | Snyder, Jr. et al. | 166/338 X |
| 5,704,307 | 1/1998 | Treu et al. | 114/230 |

FOREIGN PATENT DOCUMENTS

| | | | |
|---|---|---|---|
| 610714 | 5/1978 | U.S.S.R. | 114/296 |
| 797955 | 1/1981 | U.S.S.R. | 114/296 |

OTHER PUBLICATIONS

Telefax Memo From Aker Omega Marine, Inc. to Shell Offshore, Inc. (May 7, 1991).

Telefax Memo From Aker Omega Marine, Inc. to Shell Offshore, Inc. (Jun. 17, 1991).

*Primary Examiner*—Robert E. Pezzuto

*Attorney, Agent, or Firm*—Gardere & Wynne, L.L.P.

[57] ABSTRACT

In a method of and apparatus for anchor installation, a plate anchor is mounted at the bottom of a suction follower comprising a hollow cylinder having an open lower insertion end and a closable upper suspension end. The suction follower and the anchor secured thereto are engaged with the sea floor, whereupon water is pumped out of the suction follower causing the suction follower and the anchor to penetrate into the sea floor to a predetermined depth. The anchor is then disengaged from the suction follower, whereupon water is pumped into the suction follower to disengage the suction follower from the sea floor for recovery to the surface, leaving the anchor embedded in the sea floor. The plate anchor may comprise first and second plate members, the second plate member pivoting relative to the first plate member to prevent upward movement of the anchor.

21 Claims, 56 Drawing Sheets

METHOD OF AND APPARATUS FOR INSTALLATION OF PLATE ANCHORS

CROSS REFERENCE TO RELATED APPLICATION

This application is a continuation-in-part of application Ser. No. 08/971,518, filed Nov. 17, 1997, now U.S. Pat. No. 5,992,060.

TECHNICAL FIELD

This invention relates generally to methods of and apparatus for effecting anchor installation and recovery, and more particularly to the installation of plate anchors in deep water.

BACKGROUND AND SUMMARY OF THE INVENTION

As is well known, exploration for and recovery of oil and gas has long since extended into offshore venues. Early offshore drilling operations were concentrated in relatively shallow waters. However, the number of shallow water drilling sites is finite, while the world's appetite for oil and gas is seemingly unlimited. It has therefore become necessary to conduct offshore drilling operations in waters as deep as 10,000 feet or more.

Offshore drilling operations are frequently conducted from floating platforms known as mobile offshore drilling units (MODUs) with following production operations being conducted using floating production systems. While the mooring in shallow water is relatively straightforward, the successful mooring of MODUs, floating production systems, etc., in deeper water can be problematic.

The traditional method of mooring MODUs, for example, in deeper water involves the use of drag embedment anchors and mooring lines which are stored on the MODU, and which are deployed from the MODU using anchor handling vessels. Some of the latest generation MODUs can carry adequate lengths of wire and chain on board, and are equipped with combination wire/chain mooring winches to moor at maximum depths of 5,000 feet of water. Large anchor handling vessels are capable of deploying and recovering such mooring legs and anchors. In even deeper water, however, the amount of wire and chain that would have to be carried on the MODU becomes too large, and even large anchor handling vessels would have difficulty deploying and recovering such mooring systems in the traditional manner.

Older generation MODUs typically cannot carry enough mooring line to moor in water deeper than about 2,000 to 3,000 feet. This water depth limit can be extended by inserting sections of wire in each mooring leg, or by pre-installing mooring legs prior to arrival of the MODU at location. Both types of extended water depth mooring legs (insert or preset) typically use modern high holding power drag embedment anchors. Large anchor handling vessels are used to install the wire inserts during mooring leg deployment or to pre-install the preset mooring legs.

One drawback to deep water moorings using drag embedment anchors is that such anchors typically cannot handle uplift (vertical load), which requires both that the mooring leg is very long, and that the anchor is set very far from the MODU. In water depths over 6,000 feet the horizontal distance to the anchors can become a problem, since it could be as large as 12,000 feet or 2 nautical miles, and each mooring leg could be as long as 15,000 feet or 2.5 nautical miles. This requires an anchor spread diameter of about 4 nautical miles.

If an anchor system can be used which can handle substantial uplift or vertical load, the anchor radius and mooring line length can be reduced significantly. Driven anchor piles are capable of handling uplift, but cannot be installed in water deeper than about 5,000 feet, nor are they recoverable. For these reasons, driven anchor piles have never been used for deep water moorings.

Mooring systems employing anchors other than conventional drag embedment anchors and driven piles have been proposed heretofore. For example, two types of drag embedded vertically loaded anchors are commercially available. The installation of these drag embedded vertically loaded anchors in deep water requires the connection of a very long length of chain and/or wire between the anchor and the installing vessel in order that a substantially horizontally directed embedment force can be applied to the anchor. Due to its extreme length, the mass of the installing chain and/or wire exceeds that of the anchor by a considerable extent, which causes the anchor to respond to whatever forces may be imposed by the chain and/or wire, including in particular twisting forces. The end result is that it is very difficult to assure the proper orientation, location, and depth of installation of drag embedded vertically loaded anchors installed in deep water.

The foregoing difficulties in installing drag embedded vertically loaded anchors have resulted in renewed interest in the use of suction anchors for deep water installations. U.S. Pat. No. 4,318,641, granted to Hogervorst on Mar. 8, 1982, discloses mooring systems employing suction embedment anchors, which are capable of taking significant uplift or vertical load. One difficulty involved in the use of suction anchors comprises the high cost thereof, which can be $200,000 or more. Another difficulty involves the large size and weight of suction anchors which results in transportation and deployment problems. Therefore, a need exists for an improved method of and apparatus for installing anchors in deep water.

The present invention comprises a method of and apparatus for installing anchors which overcomes the foregoing and other problems long since associated with the prior art. In accordance with the broader aspects of the invention, a plate anchor is temporarily connected to the lower insertion end of a suction follower. A mooring line is connected to the plate anchor and is temporarily connected to the suction follower. The suction follower having the plate anchor secured thereto is lowered from an installation vessel until it engages and partially penetrates the ocean floor under its own weight.

Thereafter, a remotely operated vehicle having a pump mounted thereon is engaged with the suction follower and is utilized to pump water out of the interior of the suction follower. This results in further penetration of the suction follower and the plate anchor secured thereto until the desired depth is reached. The plate anchor and the mooring line are then disengaged from the suction follower, whereupon the operation of the pump on the remotely operated vehicle is reversed. As water is pumped into the suction follower it is forced upwardly out of the ocean floor and is recovered to the installation vehicle. The plate anchor remains embedded in the ocean floor for use in mooring operations, and when a load is applied will orient itself into the correct attitude. The plate anchor may be recovered later if desired.

The present invention further comprises an improved plate anchor construction which prevents upward movement of the anchor following installation. The improved plate anchor includes a major plate portion and a minor plate portion which is hingedly supported on the major plate portion for limited pivotal movement with respect thereto. In the event the plate anchor tends to move upwardly upon the application of a load thereto, the minor plate portion automatically pivots into any orientation that prevents upward movement of the plate anchor.

BRIEF DESCRIPTION OF THE DRAWINGS

A more complete understanding of the present invention may be had by reference to the following Detailed Description when taken in connection with the accompanying Drawings wherein.

DETAILED DESCRIPTION

Figure 1:
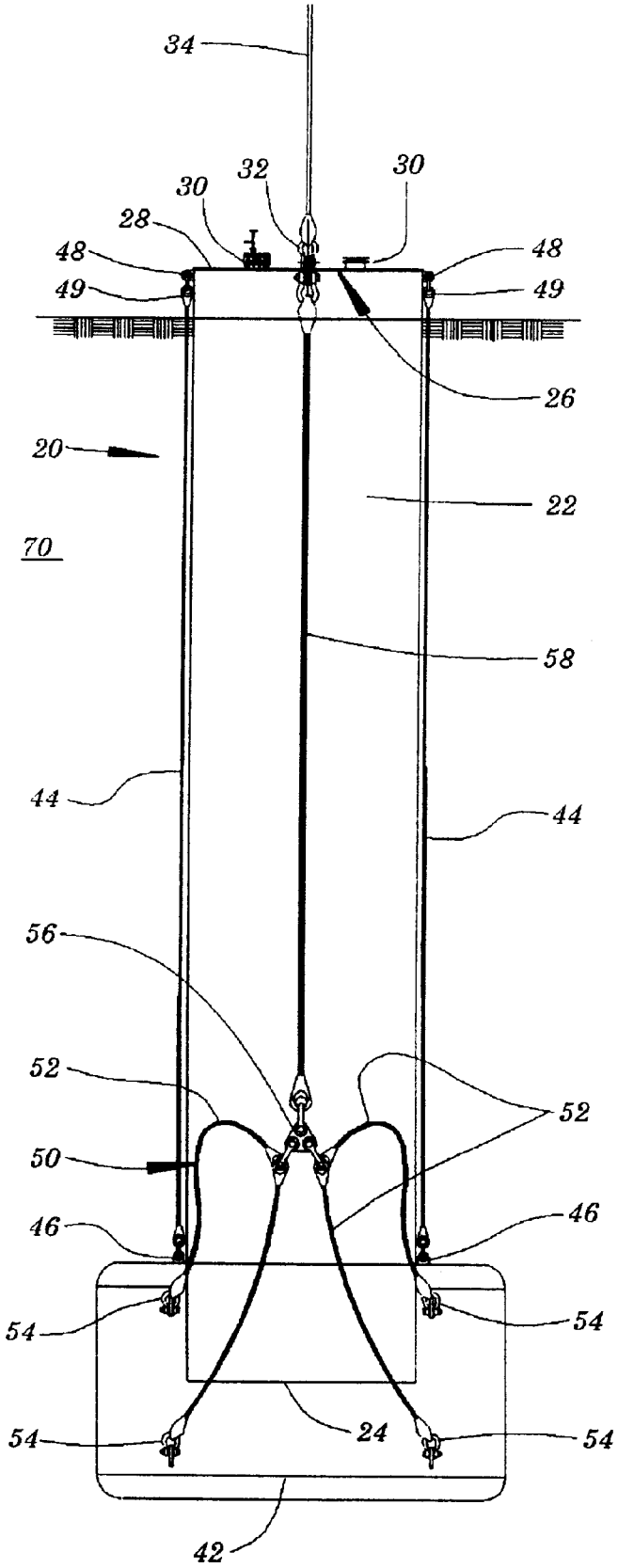
FIG. 1 is a front view illustrating a first embodiment of the invention.

Referring now to the Drawings, and particularly to FIG. 1 thereof, there is shown an anchor installation system 20 comprising a method of and apparatus for anchor installation incorporating a first embodiment of the invention. The anchor installation system 20 includes a suction follower 22. The suction follower 22 comprises a hollow right circular cylinder formed from steel and having a diameter of about 14 feet and a length of about 70 feet. Other cross-sectional configurations and/or other dimensions may be used in the fabrication of the suction follower 22 depending upon the requirements of particular applications of the invention.

Figure 2:
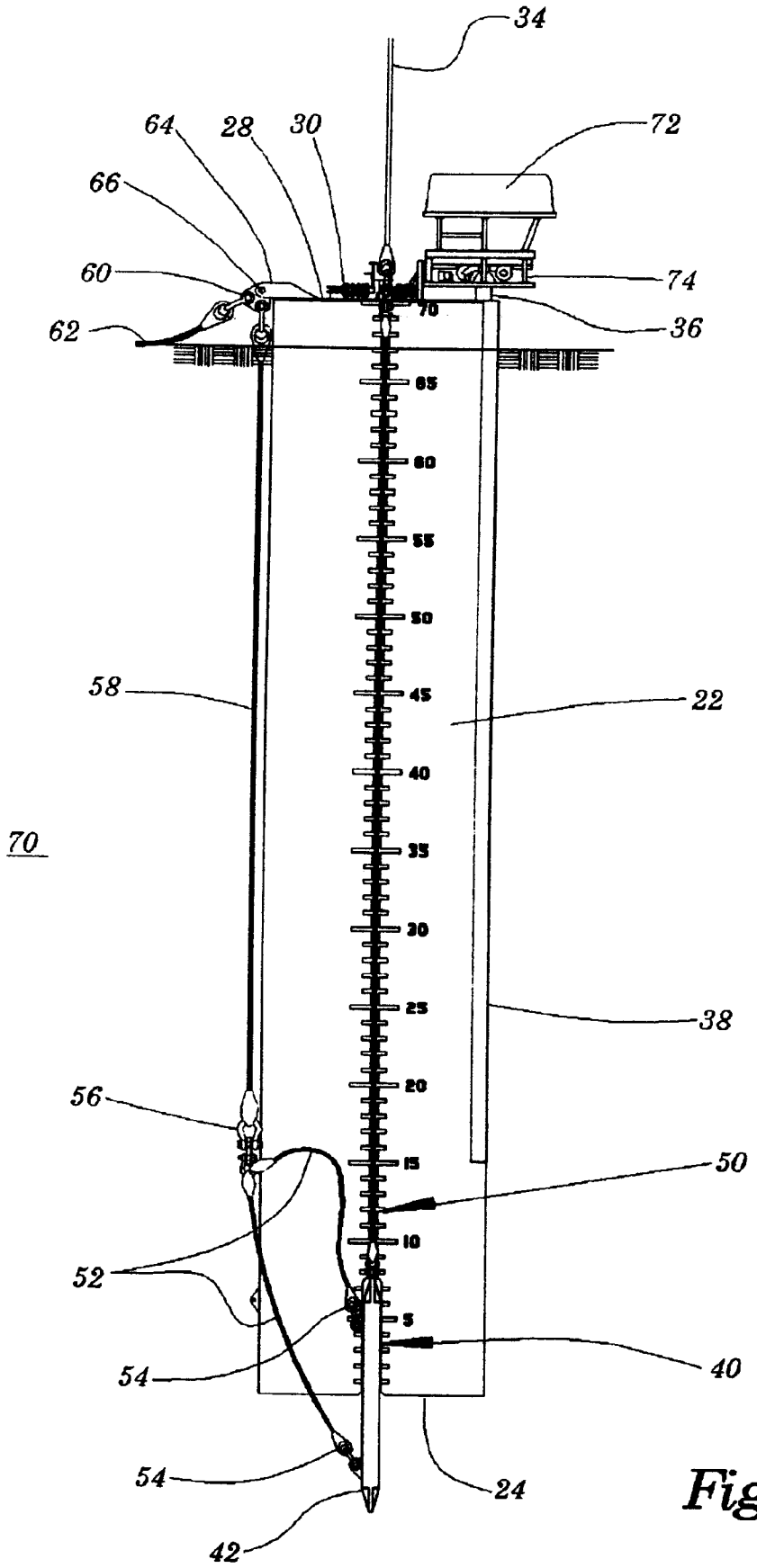
FIG. 2 is a side view further illustrating the embodiment of the invention shown in FIG. 1.

The suction follower 22 has a lower insertion end 24 of follower 22 which is open and an upper suspension end 26 of follower 22 which is closed by a top plate 28. The top plate 28 is provided with flow-through ports 30 and pad eye 32 which secures the suction follower 22 to a lowering/recovery wire 34. As is best shown in FIG. 2, the top plate 28 is further provided with a suction port 36. A pair of longitudinally disposed launching skids 38 extend along one side of the suction follower 22. The launching skids 38 function to prevent the suction follower from rolling on the deck of an installation vessel.

The suction follower 22 is similar in construction and function to the suction anchor disclosed and claimed in U.S. patent application Ser. No. 08/948227 filed Oct. 9, 1997, and assigned to the assignee hereof, the disclosure of which is incorporated by reference herein as if fully set forth herein. The difference between the two is that the suction anchor of the prior application is installed in the sea floor and thereafter serves an anchoring function, whereas the suction follower of the present invention comprises an anchor installation device but does not itself function as an anchor.

The suction follower 22 has a slot 40 formed in the lower insertion end 24 of follower 22 thereof. The slot 40 is generally rectangular in shape, is disposed on the axis of the suction follower 22, and extends longitudinally inwardly from the lower end 24. Slots having other shapes and other locations relative to the suction follower 22 may be used in the practice of the invention depending upon the requirements of particular applications thereof.

A plate anchor 42 is received in the slot 40. The plate anchor 42 is preferably formed from steel and may be either solid or hollow in construction. The plate anchor 42 illustrated in FIGS. 1 and 2 is rectangular in shape; however, it will be understood that plate anchors having other shapes may be utilized in the practice of the invention, if desired.

Referring particularly to FIG. 1, the plate anchor 42 is retained in the slot 40 during installation by a pair of retainer wires 44 extending along opposite sides of the suction follower 22. The lower ends of the retainer wires 44 are secured to pad eyes 46 mounted on the plate anchor 42. The upper ends of the retainer wires 44 are secured to brackets 48 mounted on the suction follower 22 at the upper end thereof. The retainer wires 44 are releaseably secured to the brackets 48 by means of releaseable pins 49.

An anchor bridle assembly 50 includes a plurality of bridle wires 52 each secured to a pad eye 54 mounted on the plate anchor 42. Each of the wires 52 extends from its respective pad eye 54 to a connection plate 56 which connects the bridle assembly to an anchor forerunner wire 58. Referring to FIG. 2, the anchor forerunner wire 58 extends from the plate 56 to a triplate 60 which secures the anchor forerunner wire 58 to a mooring line 62. During installation of the plate anchor 42, the triplate 60 is secured to a bracket 64 mounted on the top plate 28 of the suction follower 22 by a releaseable pin 66.

In the operation of the anchor installation system 20, the plate anchor 42 is initially secured in the slot 40 of the suction follower 22 by means of the retainer wires 44 each of which is connected to its respective bracket 48 by means of a releaseable pin 49. The suction follower/plate anchor assembly is transported to the installation site on an installation vessel. During transportation the suction follower 22 is prevented from rolling on the deck of the installation vessel by means of the launching skids 38 which are engaged with the deck of the vessel.

At the installation site the suction follower/plate anchor assembly is lowered downwardly from the vessel until it is positioned directly above the sea floor 70. A remotely operated vehicle 72 is then utilized to assure that the plate anchor 42 is properly oriented. Thrusters on the remotely operated vehicle 72 may be utilized to reposition the suction follower/plate anchor assembly if necessary. The remotely operated vehicle 72 may comprise a Racal Sea Lion Mk II heavy work class remotely operated vehicle having 100 horsepower; however, any of the various commercially available remotely operated vehicles having 75 horsepower or more can be used in the practice of the invention.

After the proper orientation of the plate anchor has been assured, the suction follower/plate anchor assembly is lowered into engagement with the sea floor 70 and penetrates the sea floor 70 under its own weight. At this point the remotely operated vehicle 72 is again utilized to assure that the axis of the suction follower 22 is vertically oriented. The suction follower 22 may be provided with a bulls-eye level mounted on the top plate 28 thereof for observation by the remotely operated vehicle 72 to assure proper vertical alignment of the suction follower 22.

After the proper orientation of the plate anchor 42 and the proper vertical alignment of the suction follower 22 have been assured utilizing the remotely operated vehicle 72, the remotely operated vehicle 72 is utilized to close the flow-through ports 30. Thereafter, a pumpskid 74 mounted on the remotely operated vehicle 72 is clamped into engagement with the suction port 36 of the suction follower 22. The pumpskid 74 is preferably of the type disclosed and claimed in co-pending application Ser. No. 08/959,931, filed Oct. 29, 1997, and assigned to the assignee of the present application, the disclosure of which is incorporated herein by reference as if fully set forth herein.

The pumpskid 74 includes a pump which functions responsive to power supplied by the remotely operated vehicle 72 to pump water out of the interior of the suction follower 22. This results in a differential pressure between the interior and the exterior of the suction follower 22, whereby the suction follower 22 and the plate anchor 42 are forced into the sea floor 70. The pumping of water out of the interior of the suction follower 22 and the resulting penetration of the suction follower 22 and the plate anchor 42 into the sea floor 70 continues until the desired depth of penetration is achieved. A typical maximum penetration depth is indicated in FIGS. 1 and 2.

After the desired penetration depth has been achieved, the remotely operated vehicle 72 is utilized to disengage the releaseable pins 49, thereby disengaging each retainer wire 44 from its respective pad eye 48. Likewise, the remotely operated vehicle 72 is utilized to disengage the releaseable pin 66, thereby disengaging the triplate 60 from the bracket 64. Thereupon the remotely operated vehicle 72 and the pumpskid 74 are returned to the position indicated in FIG. 2, and the pumpskid 74 is once again clamped into engagement with the suction port 36 of the suction follower 22.

At this point the pump of the pumpskid 74 is utilized to pump water into the suction follower 22. This causes a pressure differential between the interior of the suction follower 22 and the exterior thereof which causes the suction follower 22 to move upwardly and out of engagement with the sea floor 70. Disengagement of the suction follower 22 from the sea floor 70 is aided by an upwardly directed force applied to the suction follower 22 from the installation vessel through the lowering/recovery wire 34. It will also be understood that since the releaseable pins 49 and 66 have been disengaged, upward movement of the suction follower 22 does not result in upward movement of the plate anchor 42. Rather, the plate anchor 42 remains in place at its maximum penetration depth while the suction follower 22 is removed from the sea floor 70 and returned to the surface utilizing the lowering/connection wire 34.

It will be understood that by means of suitable connections, the remotely operated vehicle can be used to disengage the pins 49 and 66 without disconnecting from the suction port.

Figure 3:
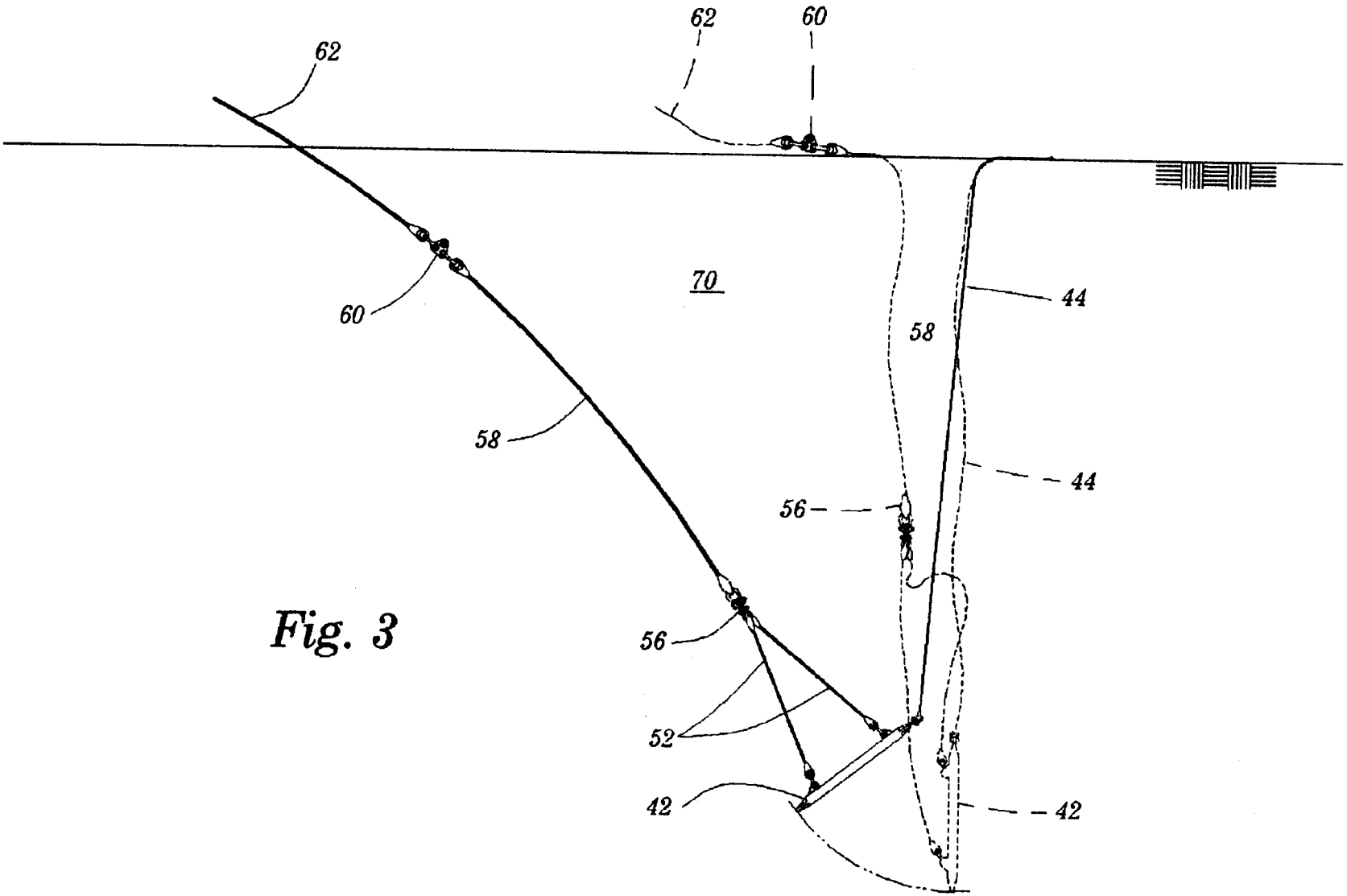
FIG. 3 is an illustration of a plate anchor installed in accordance with the first embodiment of the invention.

Referring to FIG. 3, the positioning of the plate anchor 42 following removal of the suction follower 22 is indicated in dashed lines. Thereafter, an object to be moored utilizing the plate anchor 42, for example, a MODU, is secured to the mooring line 62, it being understood that pre-connection of the device to be moored to the plate anchor is also possible. A mooring force is then applied to the plate anchor 42 through the mooring line 62 and the anchor forerunner wire 58, causing the plate anchor 42 to move into the orientation show in full lines of FIG. 3. However, since the plate anchor 42 has been inserted into the sea floor 70 to a depth of approximately 70 feet, the plate anchor 42 does not disengage from the sea floor, but rather provides a very dependable anchoring resistance to any movement of the device secured thereto through the mooring line 62.

Figure 4:
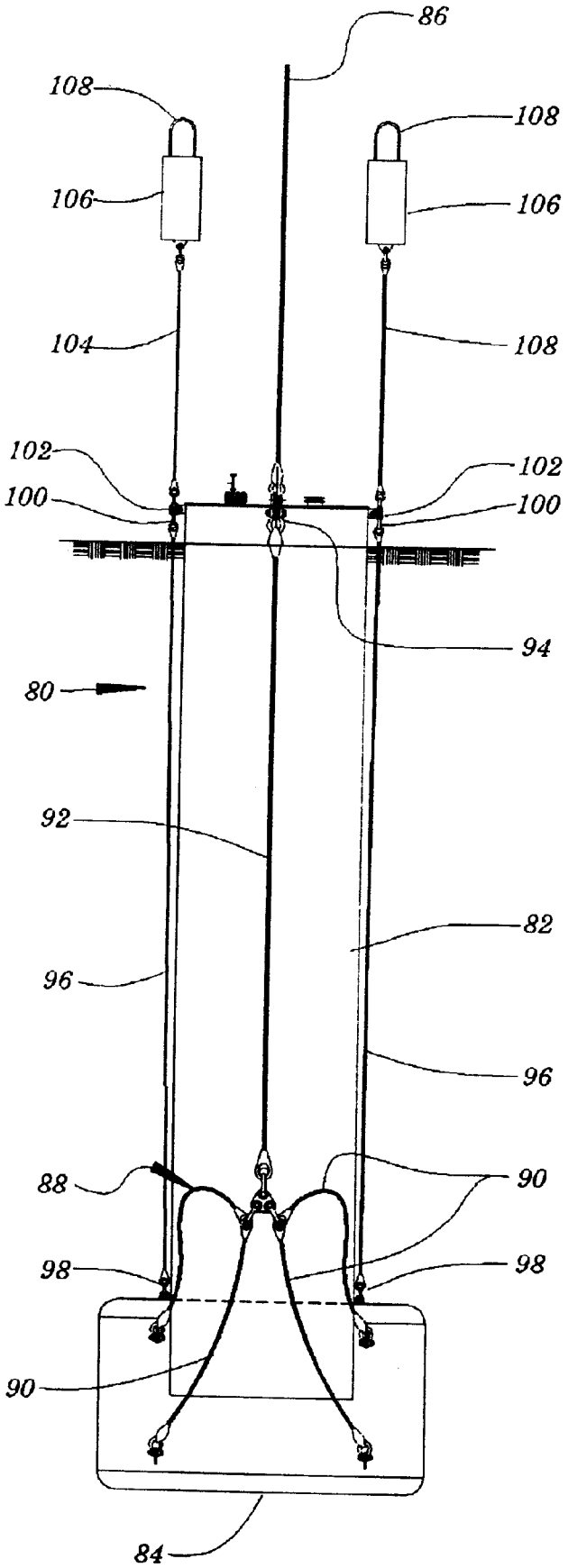
FIG. 4 is a front view illustrating a second embodiment of the invention.
Figure 5:
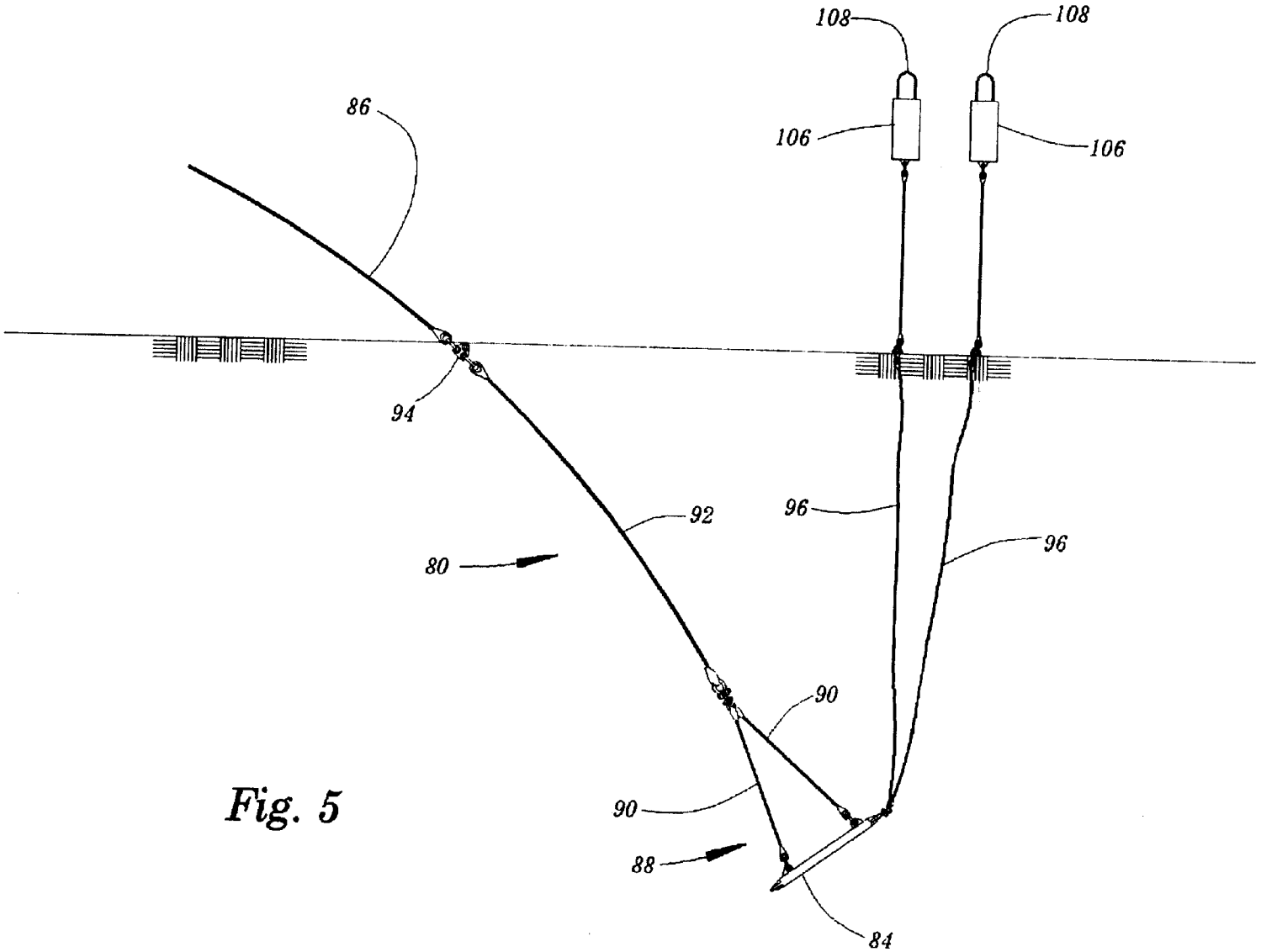
FIG. 5 is an illustration of a plate anchor installed in accordance with the second embodiment of the invention.

Referring now to FIGS. 4 and 5, there is shown an anchor installation system 80 comprising a method of and apparatus for anchor installation incorporating a second embodiment of the invention. The anchor installation system 80 utilizes a suction follower 82 which is identical in construction and function to the suction follower 22 illustrated in FIGS. 1 and 2 and described hereinabove in conjunction therewith. The anchor installation system 80 is utilized to install a plate anchor 84 which is identical in construction and function to the plate anchor 42 illustrated in FIGS. 1, 2, and 3 and described hereinabove in conjunction therewith. The plate anchor 84 is connected to a mooring line 86 by means of a bridle assembly 88 including bridle wires 90. The bridle assembly 88 connects the plate anchor 84 to the mooring line 86 through an anchor forerunner wire 92 and a triplate 94 which is detachably connected to the suction follower 82 during installation of the plate anchor 84.

During installation, the plate anchor 84 is connected to the suction follower 82 by means of retrieval/retainer wires 96. Each retrieval/retainer wire 96 extends from a pad eye 98 secured to the plate anchor 84 and is connected to a triplate 100. Each triplate 100 is connected to the suction follower 82 by means of a releaseable pin 102 which is disengageable following installation utilizing the remotely operated vehicle 72 illustrated in FIGS. 1 and 2 and described hereinabove in conjunction therewith.

A recovery pendant 104 extends from each triplate 100. A small buoy 106 formed from syntactic foam is secured to the distal end of each recovery pendant 104. Each buoy 106 is provided with an eye 108 adapted for engagement by a hook secured to a recovery line extending from an installation vessel by means of the remotely operated vehicle 72.

Referring particularly to FIG. 5, following installation and after the application of a mooring force thereto, the plate anchor 84 is oriented similarly to the orientation of the plate anchor 42 as shown in FIG. 3 and described hereinabove in conjunction therewith. The buoys 106 are positioned above the sea floor and locate the eyes 108 for engagement by hooks extending from recovery lines. The recovery lines are adapted to apply a retrieval force to the plate anchor 84 through the recovery pendants 104 and the retrieval/retainer wires 96, thereby disengaging the plate anchor 84 from the sea floor for recovery and reuse.

In certain instances it may be preferable to use a single recovery pendant 104, buoy 106, and eye 108 to prevent tangling. Any desired number of such components can be used depending upon the requirements of specific applications of the invention.

Figure 6:
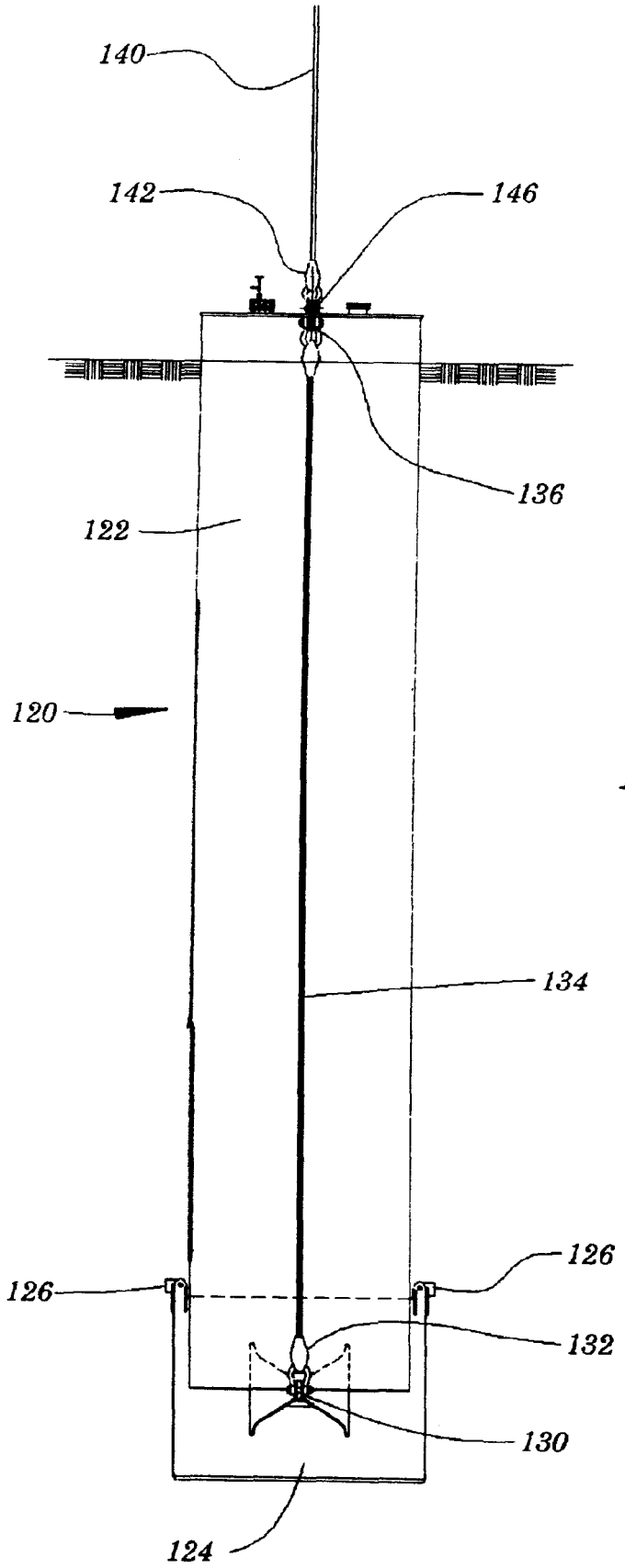
FIG. 6 is a front view illustrating a third embodiment of the invention.
Figure 7:
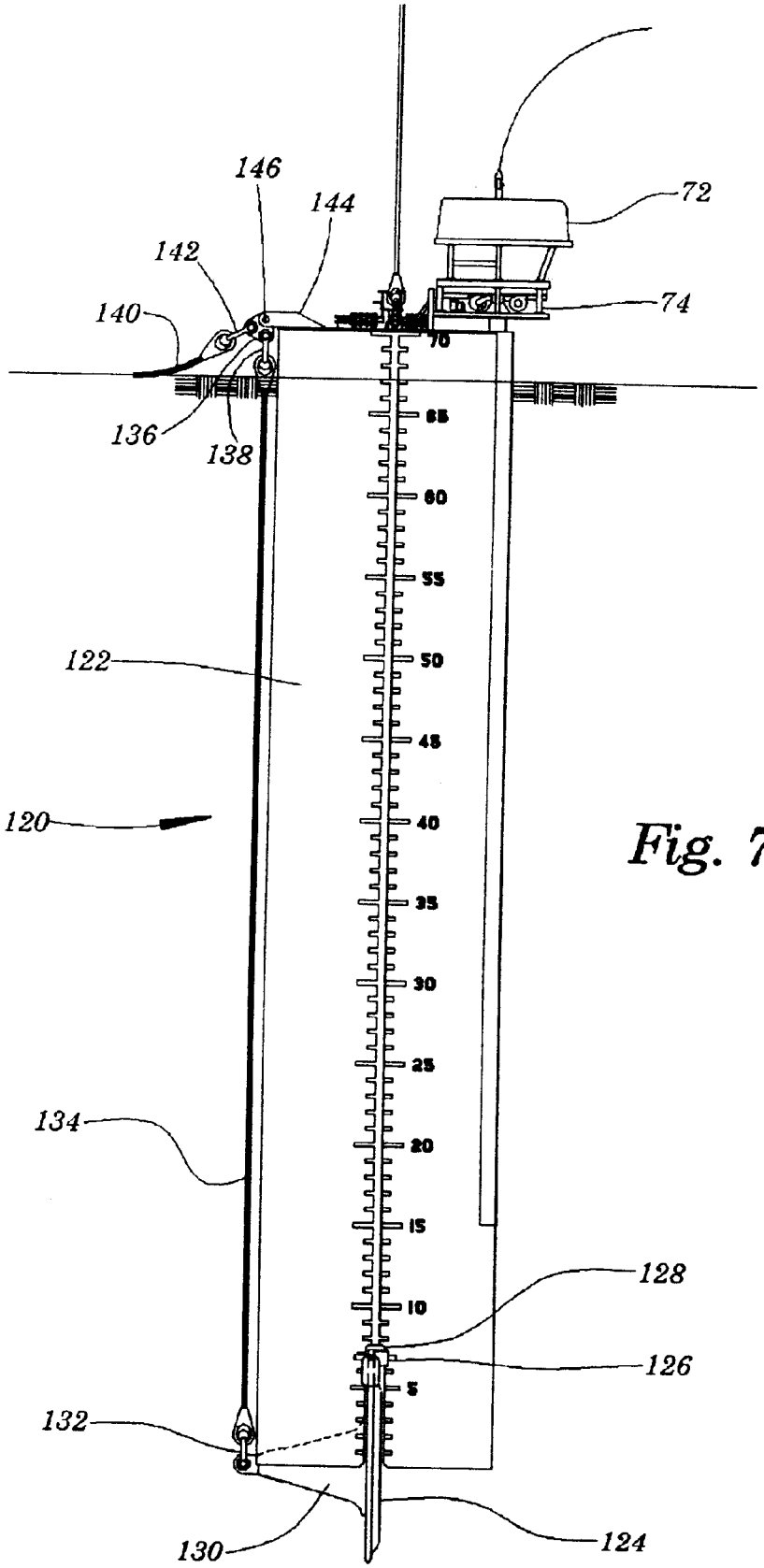
FIG. 7 is a side view further illustrating the embodiment of the invention shown in FIG. 6.
Figure 8:
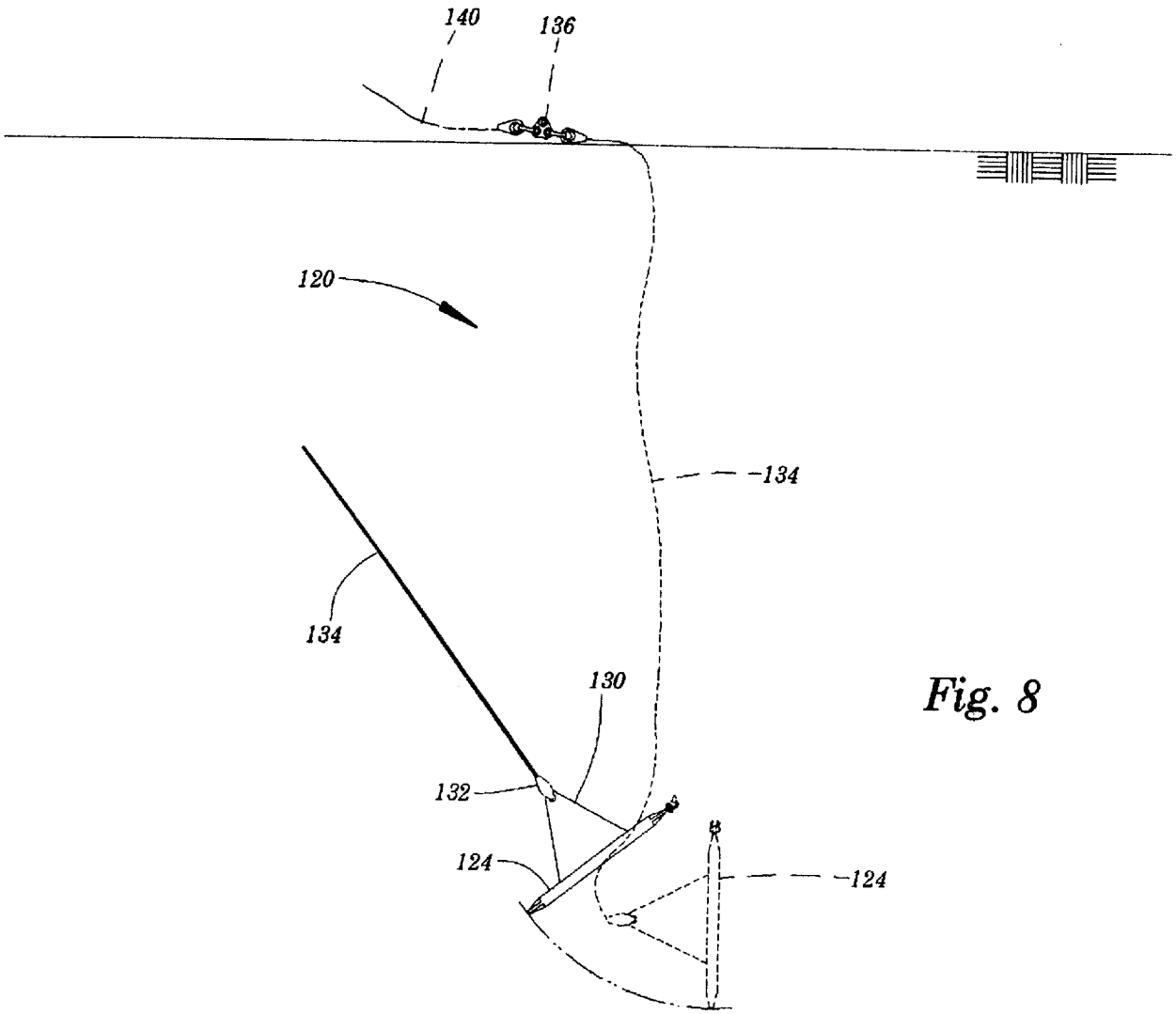
FIG. 8 is an illustration of a plate anchor installed in accordance with the third embodiment of the invention.

Referring now to FIGS. 6, 7, and 8, there is shown an anchor installation system 120 comprising a method of and apparatus for anchor installation incorporating a third embodiment of the invention. The anchor installation system 120 utilizes a suction follower 122 which is identical in construction and function to the suction follower 22 illustrated in FIGS. 1 and 2 and described hereinabove in conjunction therewith.

The suction follower 122 is utilized to effect installation of a plate anchor 124. One difference between the anchor installation system 20 in FIGS. 1, 2, and 3, and the anchor installation system 120 of FIGS. 6, 7, and 8 is that the plate anchor 124 is connected to the suction follower 122 by means of pins 126 which are selectively withdrawn to disengage the plate anchor 124 from the suction follower 122 utilizing hydraulic actuators 128 which are operated by the remotely operated vehicle 72 illustrated in FIGS. 1 and 2 and described hereinabove in conjunction therewith.

The plate anchor 124 is provided with an anchor shank 130. A shackle 132 secures the shank 130 to an anchor forerunner line 134. The anchor forerunner line 134 is in turn connected to a triplate 136 by means of a shackle 138. A mooring line 140 is also connected to the triplate 136 by means of a shackle 142.

During installation of the plate anchor 124, the triplate 136 is connected to a bracket 144 mounted on the suction follower 122 by means of a pin 146 extending therethrough. The pin 146 is adapted for disengagement from the triplate 136 and the bracket 144 under the action of a hydraulic actuator identical in construction and function to the hydraulic actuator 128. The hydraulic actuator for the pin 146 is actuated by the remotely operated vehicle 72.

Referring particularly to FIG. 8, the positioning of the plate anchor 124 following installation is indicated in dashed lines. Upon the application of an anchoring force to the plate anchor 124 through the mooring line 140, the triplate 136, and the anchor forerunner wire 134, the plate anchor 124 assumes the positioning indicated in FIG. 8 in full lines. At this point the plate anchor 124 is securely embedded in the sea floor and is fully capable of resisting anchoring forces applied thereto from a device secured to the opposite end of the mooring line 140.

Figure 9:
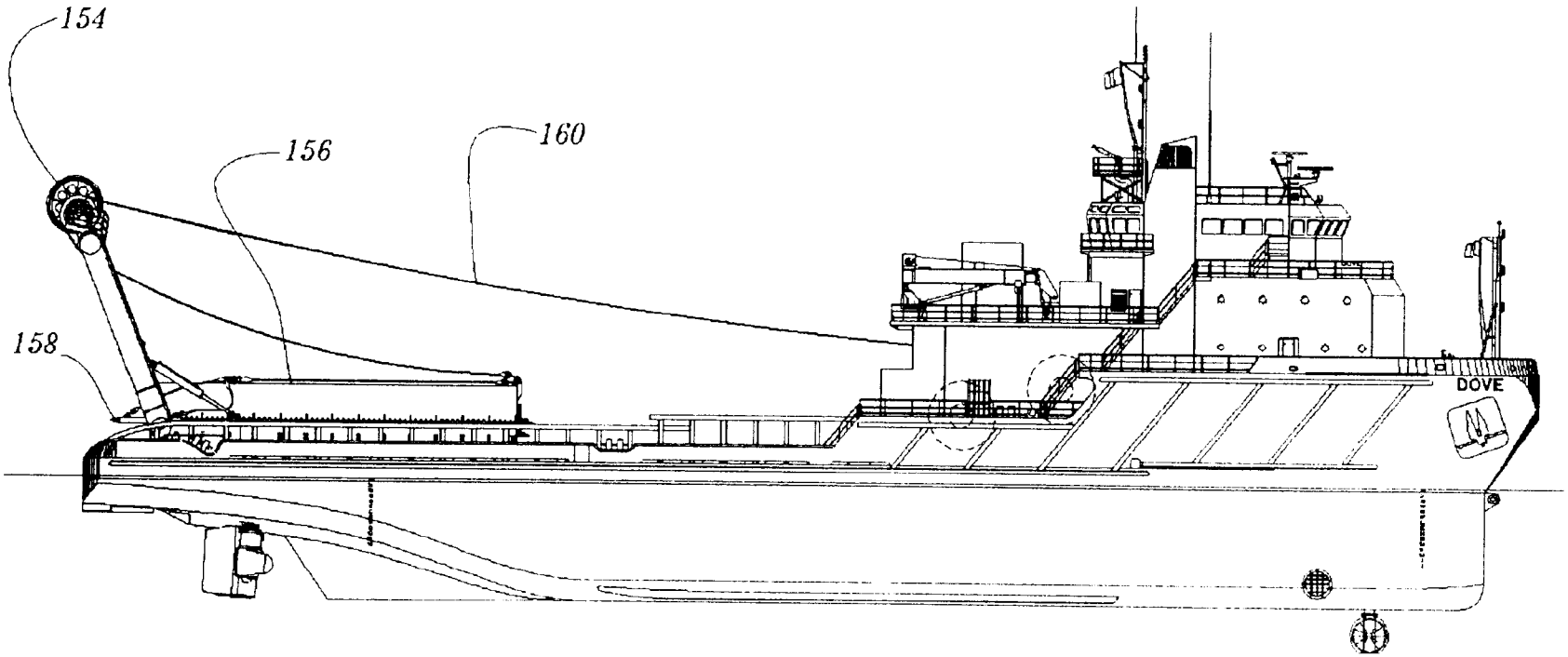
FIG. 9 is an illustration of a first step in the practice of the method of the invention.

Referring to FIGS. 9 through 14, inclusive, the method of anchor installation comprising the present invention is further illustrated. Referring particularly to FIG. 9, installation vessel 150 is provided with an A-frame gantry 154. A suction follower 156, which is identical in construction and function to the suction followers 22, 82, and 122 illustrated in FIGS. 1, 2, 4, 6, and 7 hereof and described hereinabove in conjunction therewith is mounted on the deck of the vessel 150. A plate anchor 158 is installed on the suction follower 156 either prior to or after the positioning of the suction follower 156 on the deck of the vessel 150. The plate anchor 158 may be identical in construction and function to any of the plate anchors 42, 84, and 124 illustrated in FIGS. 1 through 8, inclusive, hereof and described hereinabove in conjunction therewith.

Figure 10:
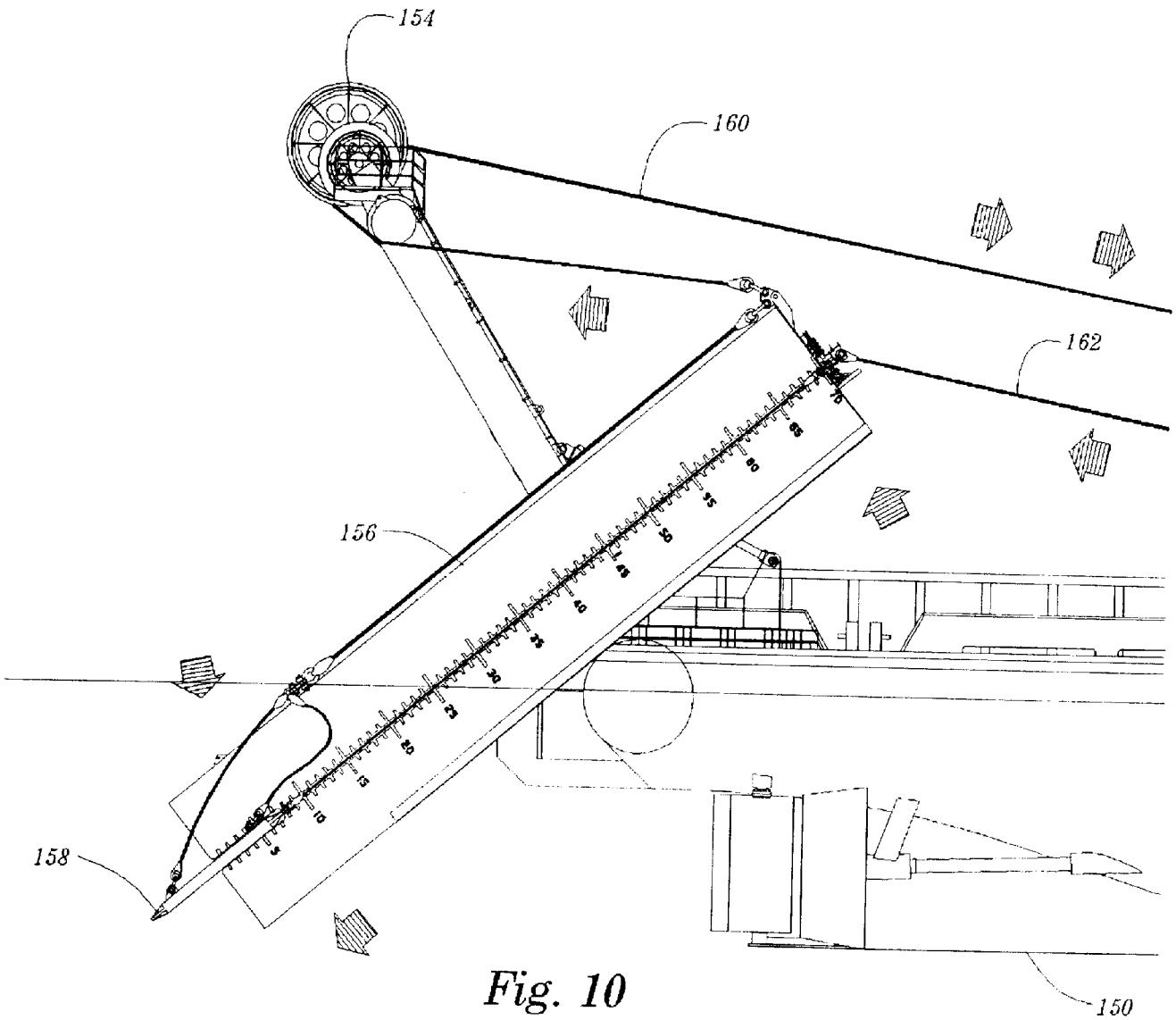
FIG. 10 is an illustration of a subsequent step in the practice of the method of the invention.
Figure 11:
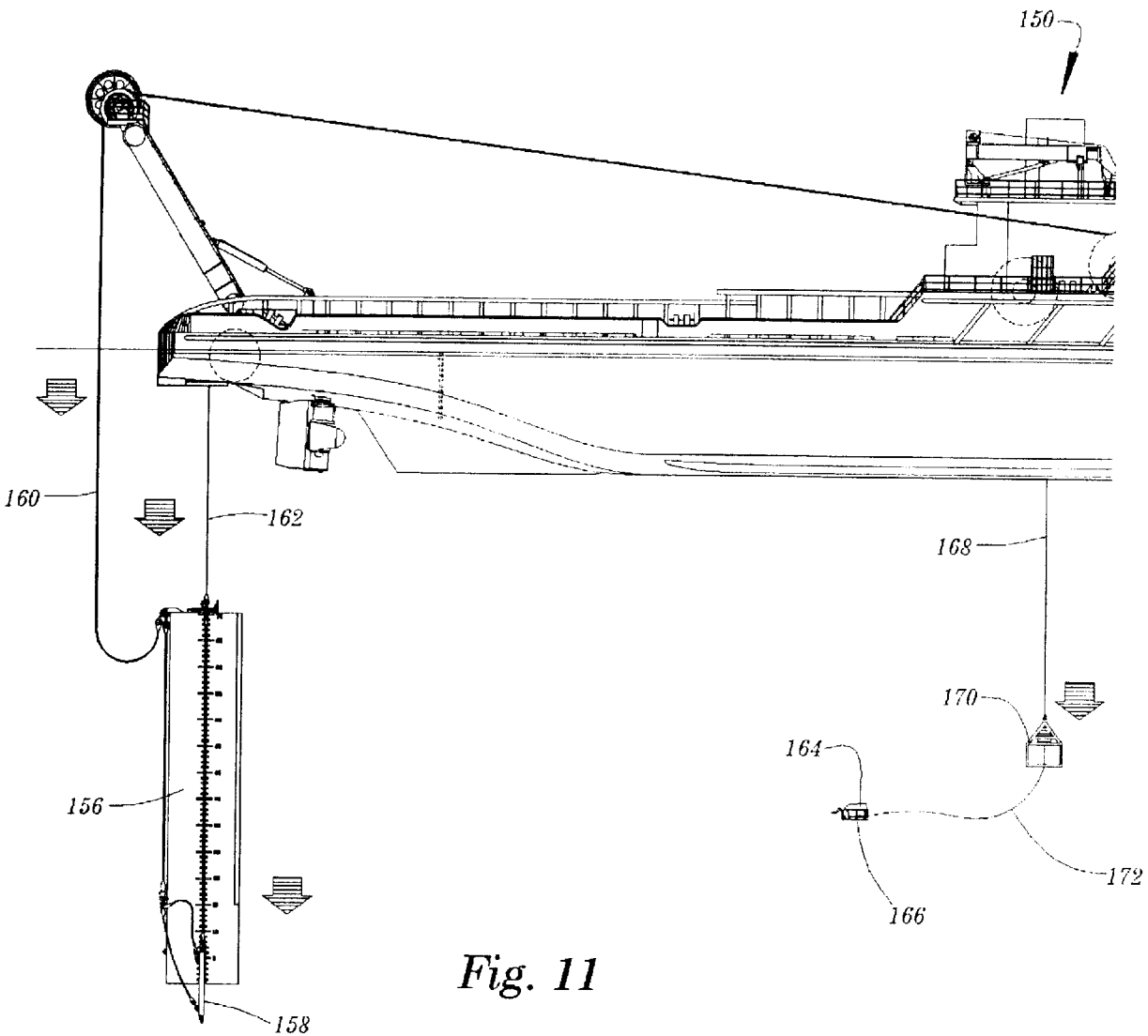
FIG. 11 is an illustration of a later step in the practice of the method of the invention.

The vessel 150 is utilized to transport the suction follower/plate anchor assembly to the point of installation. A mooring line 160 is deployed from a suitable winch over the gantry and is engaged with the plate anchor 158 and initially with the suction follower 156. Referring to FIG. 10, a lowering/recovery wire 162 is deployed from a suitable winch and is secured to the suction follower 156. The gantry 154 is utilized to lift the suction follower/plate anchor assembly and to move it rearwardly, whereupon the suction follower/plate anchor assembly passes over a stern roller of the vessel 150 and enters the ocean. As is illustrated in FIG. 11, the suction follower/plate anchor assembly is lowered downwardly utilizing the lowering/recovery line 162 with the mooring line 160 following.

Figure 12:
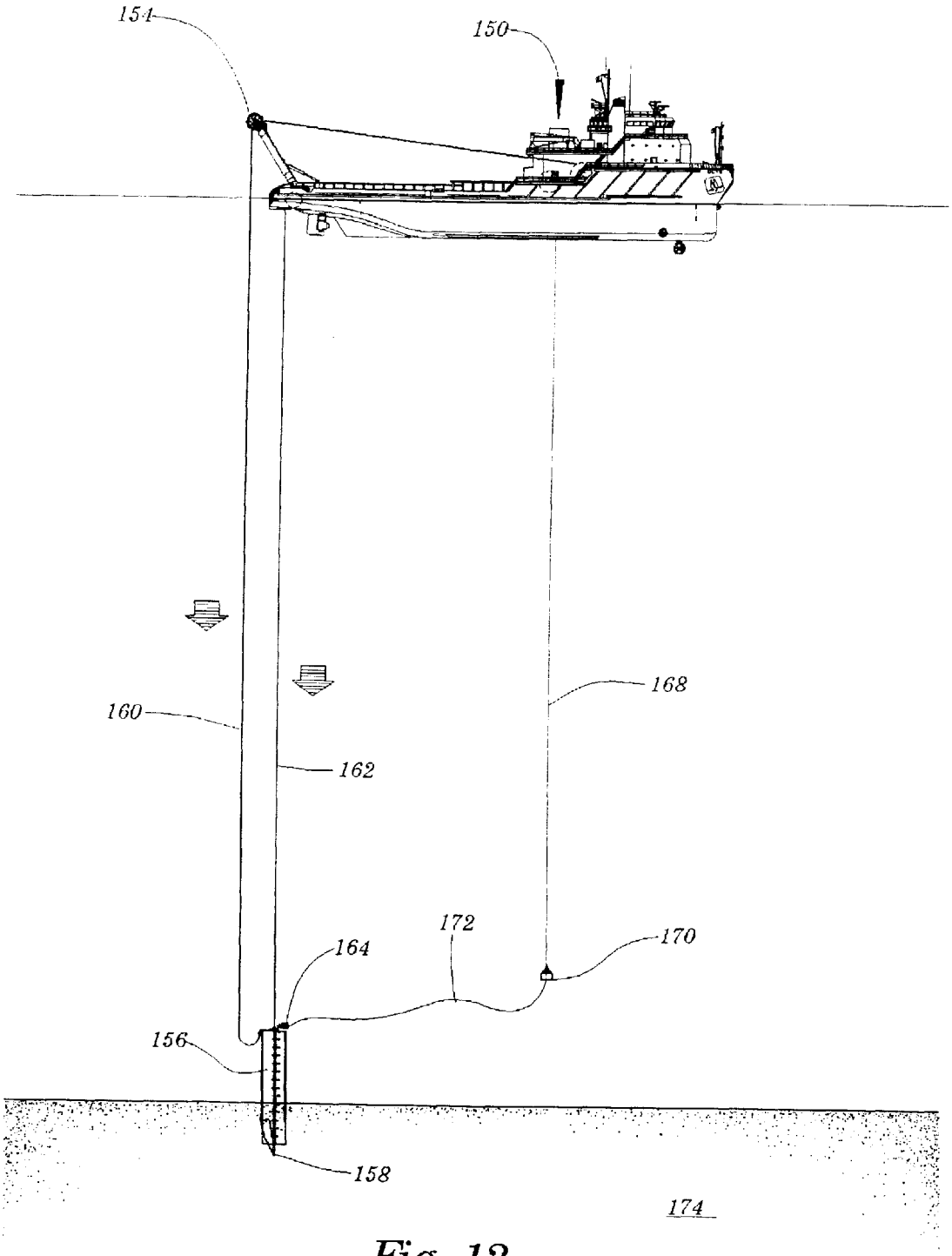
FIG. 12 is an illustration of a still later step in the practice of the method of the invention.

Referring to FIG. 12, a remotely operated vehicle 164 having a pumpskid 166 secured thereto is also deployed from the vessel 150. The remotely operated vehicle 164 and the pumpskid 166 are preferably identical in construction and function to the remotely operated vehicle 72 and the pumpskid 74 illustrated in FIGS. 1 and 2 and described hereinabove in conjunction therewith. The remotely operated vehicle 164 is connected to the vessel 150 by a line 168 which supplies operating power and control functions for the remotely operated vehicle 164 and the pumpskid 166. A remotely operated vehicle/pumpskid housing 170 is secured to the lower end of the line 168. An umbilical cord 172 secures the remotely operated vehicle 164 to the housing 170.

When the suction follower/plate anchor assembly is positioned just above the surface of the sea floor 174, the remotely operated vehicle 164 is utilized to assure the proper orientation of the plate anchor 158. Thrusters on the remotely operated vehicle re-orient the suction follower/plate anchor assembly if necessary. Thereafter, the suction follower/plate anchor assembly is lowered further and penetrates the sea floor 174 under its own weight. At this point the remotely operated vehicle 164 is utilized to assure that the axis of the suction follower 156 is oriented vertically. Again, the thrusters on the remotely operated vehicle correct the vertical orientation of the suction follower, if necessary. The results of the foregoing steps is illustrated in FIG. 12.

After the orientation of the plate anchor and the alignment of the suction follower have been assured utilizing the remotely operated vehicle, the remotely operated vehicle is employed to close the flow through ports of the suction follower. Thereupon the pumpskid 166 secured to the remotely operated vehicle 164 is clamped in engagement with the suction port of the suction follower 156, and is utilized to pump water out of the interior of the suction follower 156. This causes the suction follower to penetrate the sea floor 174 carrying the plate anchor with it. By means of the suction follower 156, the plate anchor 158 is located sufficiently deep in the sea floor 174 to assure that it will not pull out of the sea floor in response to anchoring forces.

Figure 13:
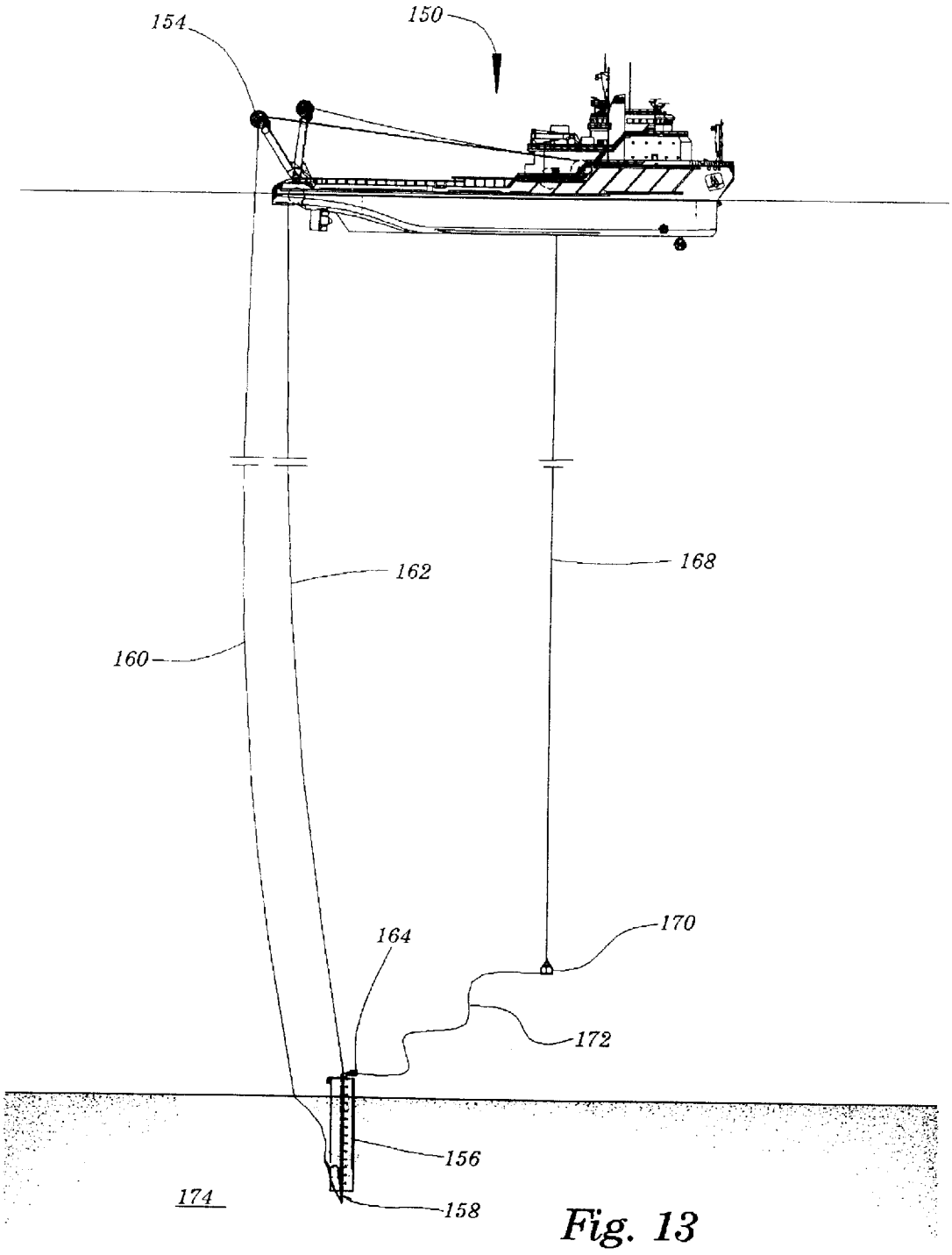
FIG. 13 is an illustration of a still later step in the practice of the method of the invention.
Figure 14:
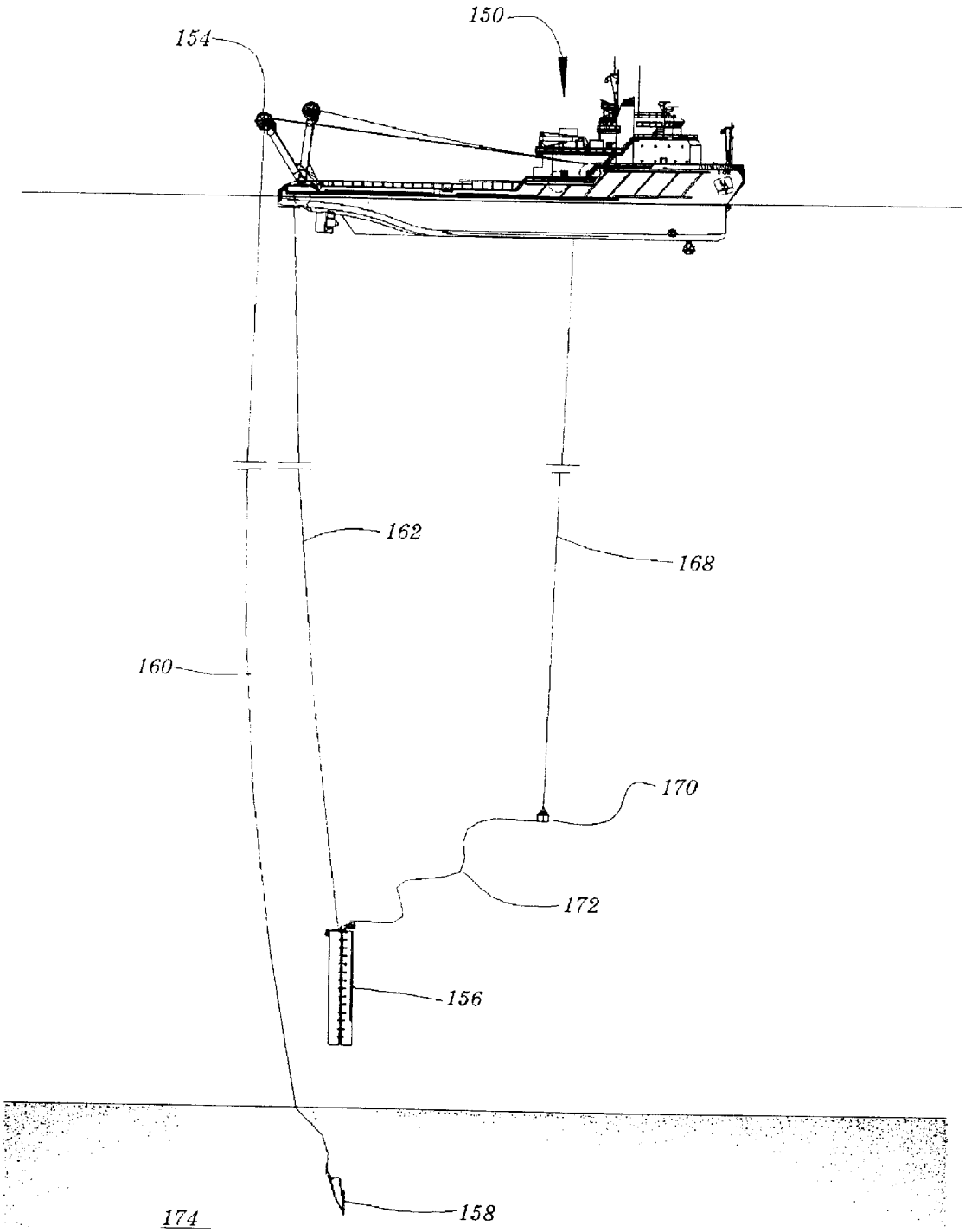
FIG. 14 is an illustration of a still later step in the practice of the method of the invention.

Referring to FIGS. 13 and 14, after the plate anchor 158 has been properly positioned by means of the suction follower 156, the remotely operated vehicle 164 is utilized to disengage the connections between the suction follower 156 and the plate anchor 158. Thereafter the pumpskid 166 is once again clamped in engagement with the suction port of the suction follower 156, it being understood that the connections between the suction follower and the plate anchor can be disengaged without disengaging the remotely operated vehicle from the suction port.

Water is then pumped into the interior of the suction follower 156, causing the suction follower 156 to move upwardly and out of engagement with the sea floor 174. Disengagement of the suction follower 156 from the sea floor 174 is aided by the application of an upwardly directed force to the lowering/recovery line 162 by the vessel 150. The suction follower 156 and the remotely operated vehicle 164 having the pumpskid 166 mounted thereon are then recovered to the vessel 150 and the mooring line 160 is connected to the object to be moored. After the operations requiring mooring have been completed, the plate anchor 158 may be recovered, if desired.

Those skilled in the art will appreciate the fact that the pump used to pump water out of and into the suction follower of the present invention could be mounted thereon, with power being supplied along the lowering/recovery line. The use of a pumpskid on the remotely operated vehicle could then be dispensed with.

Figure 15:
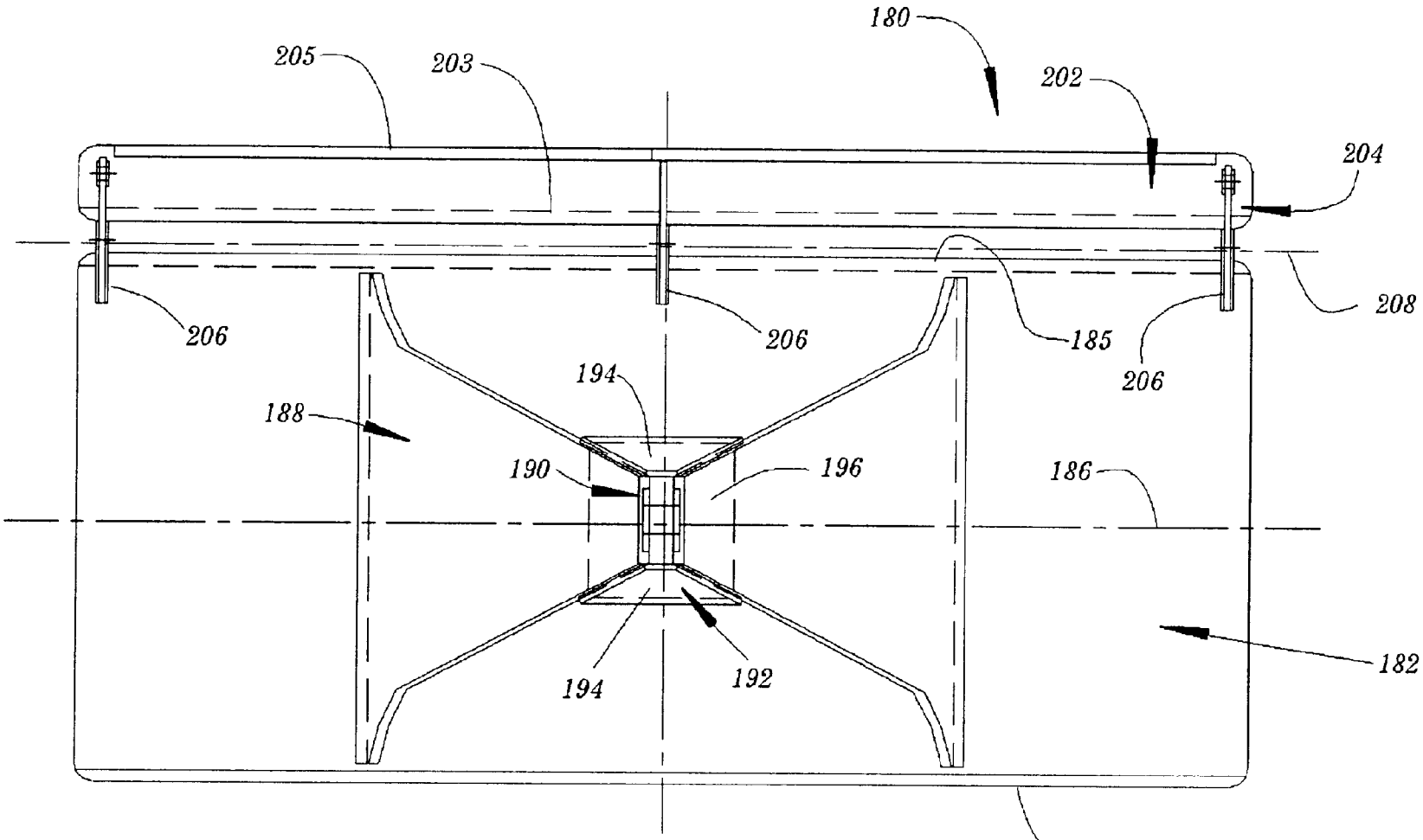
FIG. 15 is a top view of an improved plate anchor construction comprising a fourth embodiment of the invention.
Figure 16:
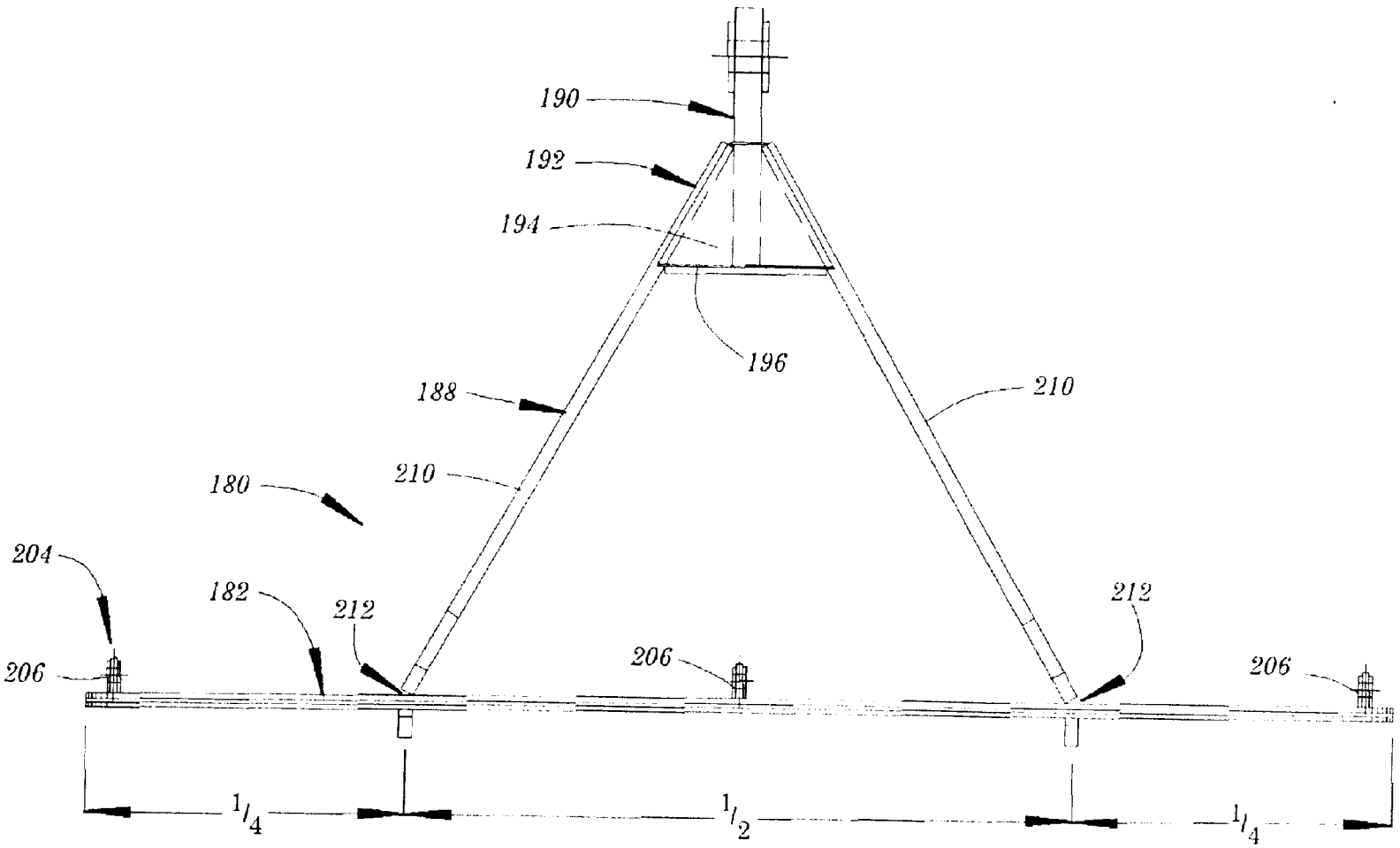
FIG. 16 is an end view of the improved plate anchor construction of FIG. 15.
Figure 17:
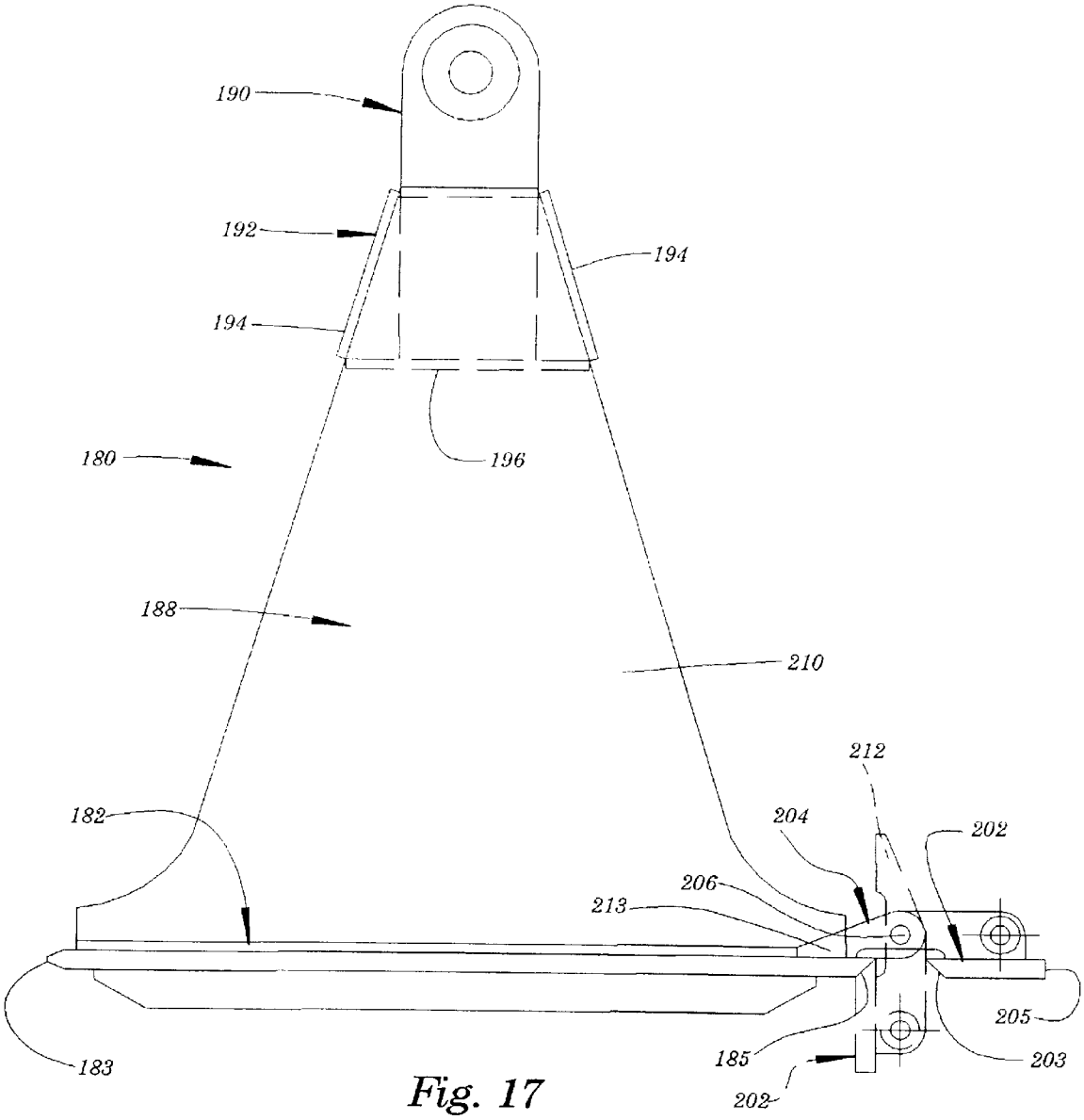
FIG. 17 is a side view of the improved plate anchor construction of FIG. 15.

Referring now to FIGS. 15, 16, and 17, there is shown an improved plate anchor 180 comprising a fourth embodiment of the invention. The plate anchor 180 includes a major plate portion 182 having a longitudinal axis 184 and a transverse axis 186. The major plate portion is further characterized by a leading edge 183 and a trailing edge 185. An anchor shank 188 is rigidly secured to the major plate portion 182, for example, by welding. The shank 188 is provided with a connection lug 190 which is secured on the shank 188 by a bracket assembly 192 including side plates 194 and a bottom plate 196.

The plate anchor 180 further comprises a minor plate portion 202 which is hingedly supported on the major plate portion 182 by a hinge mechanism 204. The minor plate portion 202 has a leading edge 203 adjacent the trailing edge 185 of the major plate portion and a trailing edge 205. The hinge mechanism 204 comprises three spaced apart hinges 206 which support the minor plate portion 202 for pivotal movement about an axis 208 extending parallel to the transverse axis 186 of the major plate portion 182. It will be understood that other types of hinge mechanisms may be utilized in the practice of the invention depending upon the requirements of particular applications thereof.

Referring particularly to FIG. 16, the shank 188 of the plate anchor 180 comprises diverging legs 210 which are secured to the major plate portion 182 at points 212 which are separated one from the other by a distance equal to one half of the overall length of the major plate portion 182. It has been found that this construction is superior in controlling bending of the major plate portion 182 upon the application of mooring forces to the plate anchor 180.

Referring to FIG. 17, the minor plate portion 202 extends parallel to the major plate portion 182 of the plate 180 during installation and recovery thereof. This configuration of the plate anchor 180 is illustrated in full lines in FIG. 17. Upward pivotal movement (FIG. 17) of the minor plate portion 202 relative to the major plate portion 182 is prevented by brackets 213 extending from and rigidly connected to the minor plate portion 202.

Upon the application of a load thereto, the plate anchor 180 may initially tend to move upwardly. This tendency is caused by disruption of the sea floor during installation of the plate anchor 180. Even slight upward movement of the plate anchor 180 causes the minor plate portion 202 thereof to automatically pivot from the position shown in full lines in FIG. 17 to the position shown in dashed lines therein, thereby preventing further upward movement of the plate anchor 180. Further pivotal movement of the minor plate portion 202 relative to the major plate portion 182 of the plate anchor 180 is prevented by engagement of the leading edge 203 of the minor plate portion 202 with the trailing edge 185 of the major plate portion 182 as illustrated in FIG. 17.

Figure 18:
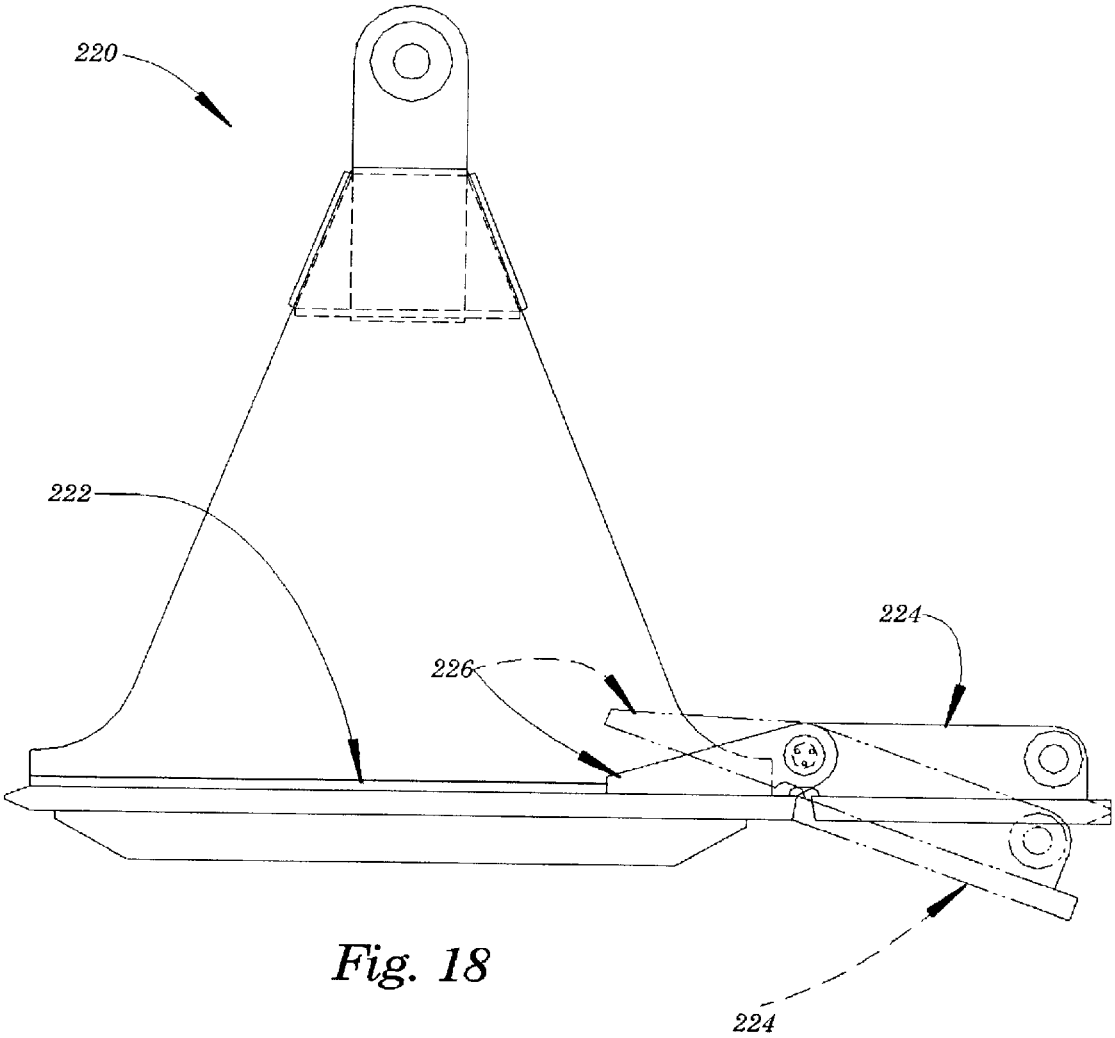
FIG. 18 is a side view similar to FIG. 17 illustrating an improved plate anchor construction comprising a fifth embodiment of the invention.

Referring to FIG. 18, there is shown a plate anchor 220 which is virtually identical in construction and function to the plate anchor 180 of FIGS. 15, 16, and 17. The primary difference between the plate anchor 220 and the plate anchor 180 is that the plate anchor 220 includes a major plate portion 222 and a minor plate portion 224 which is relatively longer with respect to the major plate portion 222 as compared with the length of the minor plate portion 202 relative to the length of the major plate portion 182 of the plate anchor 180. The major plate portion 222 and the minor plate portion 224 both have leading and trailing edges, with the leading edge of the minor plate portion positioned adjacent the trailing edge of the major plate portion.

The plate anchor 220 is installed and recovered with the minor plate portion 224 extending parallel to the major plate portion 222 as illustrated in full lines in FIG. 18. Further upward movement (FIG. 18) of the minor plate portion 224 relative to the major plate portion 222 is prevented by a bracket 226.

Following installation, the plate anchor 220 may tend to move upwardly upon the first application of a load thereto. Following installation, the plate anchor 220 may tend to move upwards upon the first application of a load thereto. Further pivotal movement of the minor plate portion 224 relative to the major plate portion 222 is prevented by engagement between the leading edge of the minor plate portion 224 and the trailing edge of the major plate portion 222 as illustrated in dashed lines in FIG. 18. Pivotal movement of the minor plate portion 224 into the orientation illustrated in dashed lines prevents any further upward movement of the plate anchor 220 in the sea floor.

It will be appreciated that the extent of pivotal movement of the minor plate portion 224 of the plate anchor 220 relative to the major plate portion 222 thereof is considerably reduced as compared with the extent of pivotal movement of the minor plate portion 202 of the plate anchor 180 relative to the major plate portion 182 thereof. The reduction in the amount of pivotal movement of the minor plate portion 224 as compared with that of the minor plate portion 202 is due, at least in part, to the increased area of the minor plate portion 224 relative to the area of the major plate portion 222 of the plate anchor 220 as compared with the length of the minor plate portion 202 relative to the area of the major plate portion 182 of the plate anchor 180.

Figure 19:
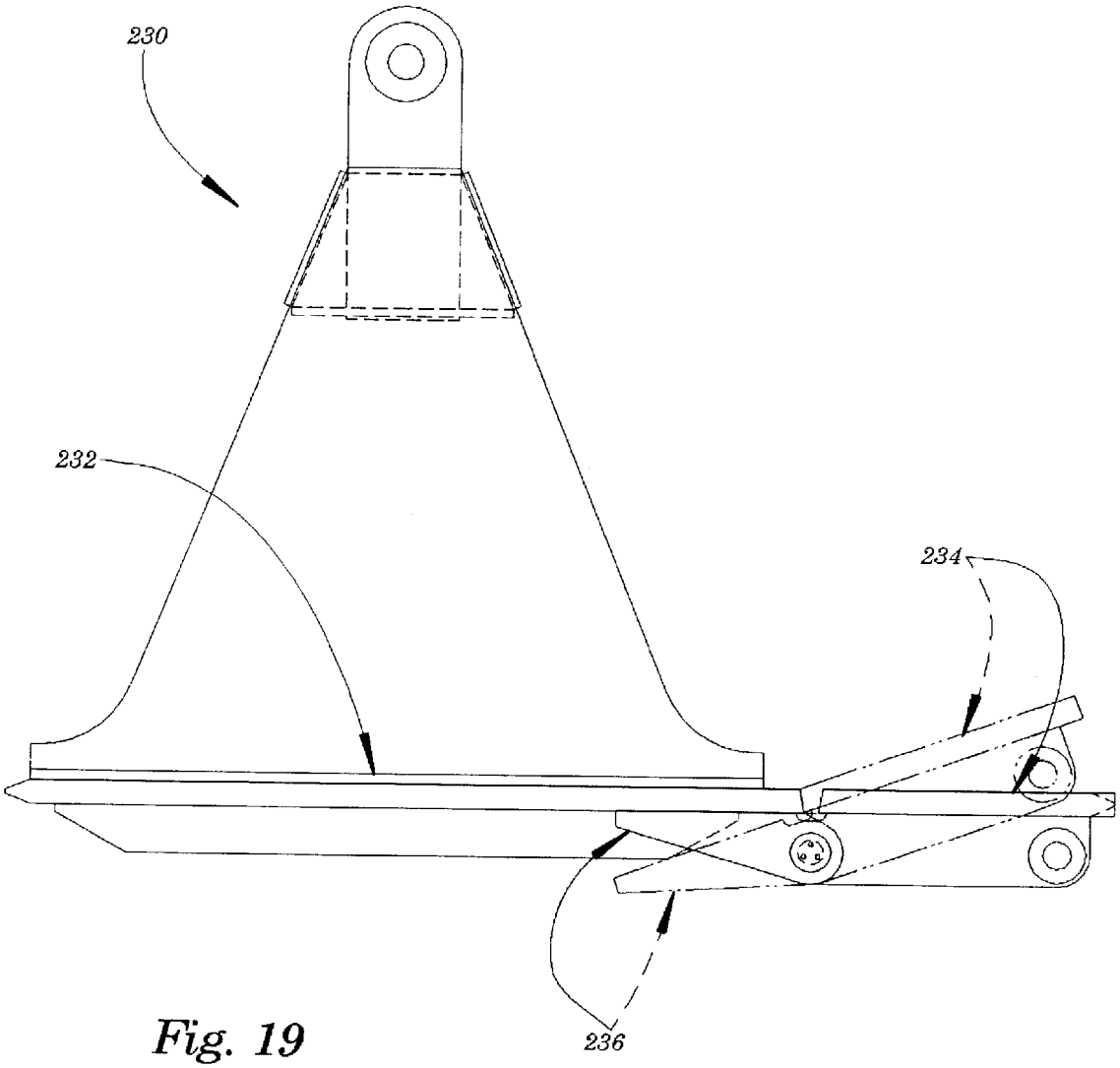
FIG. 19 is a side view similar to FIG. 17 illustrating an improved plate anchor construction comprising a sixth embodiment of the invention.

A plate anchor 230 comprising a sixth embodiment of the invention is illustrated in FIG. 19. The plate anchor 230 is virtually identical in construction and function to the plate anchor 220 illustrated in FIG. 18 and described hereinabove in conjunction therewith. The sole difference between the plate anchor 230 and the plate anchor 220 comprises the direction of pivotal movement of the minor plate portion thereof. The plate anchor 230 comprises a major plate portion 232 and a minor plate portion 234 supported for upward pivotal movement (FIG. 19) relative to the major plate portion 232 as compared with the downward pivotal movement (FIG. 18) of the minor plate portion 224 relative to the major plate portion 222 of the plate anchor 220. The reduced pivotal movement of the minor plate portion 224 ensures that this plate portion still contributes to the projected area of the plate anchor 220, thus providing increased resistance in the direction of the mooring line load.

The plate anchor 230 is installed with the minor plate portion 234 extending parallel to the major plate portion 232 as illustrated in full lines in FIG. 19. Downward pivotal movement of the minor plate portion 234 from the position illustrated in full lines in FIG. 19 is prevented by brackets 236 which engage the underside of the major plate portion 232. The plate anchor 230 may tend to move upwardly in the sea floor upon the first application of a load thereto. In such event, the minor plate portion 234 automatically pivots relative to the major plate portion 232 from the orientation shown in full lines to the orientation shown in dashed lines in FIG. 19, thereby preventing any further upward movement of the plate anchor 230 in the sea floor.

Figure 20A:
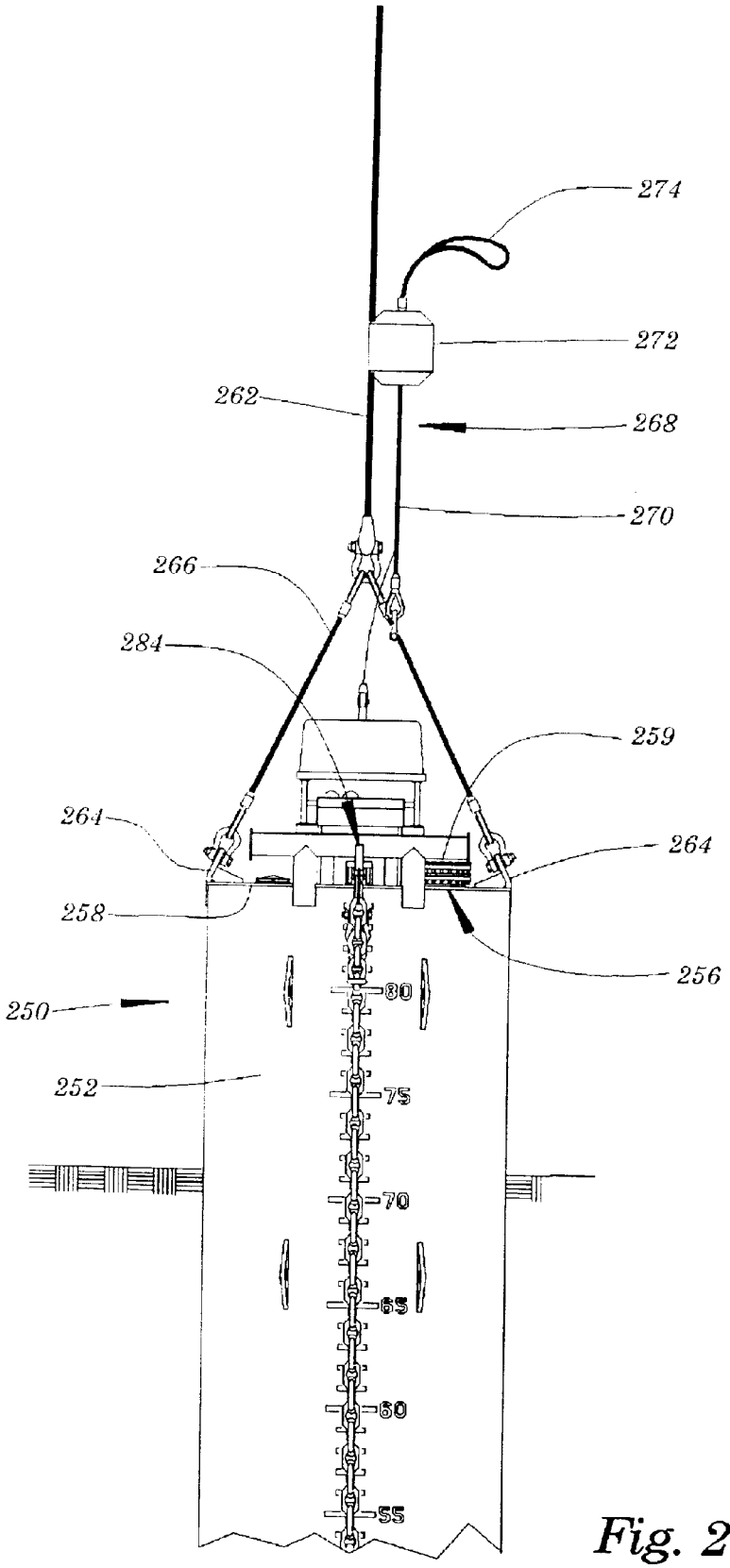
FIG. 20A and FIG. 20B, taken together, comprise a front view illustrating a seventh embodiment of the invention.
Figure 20B:
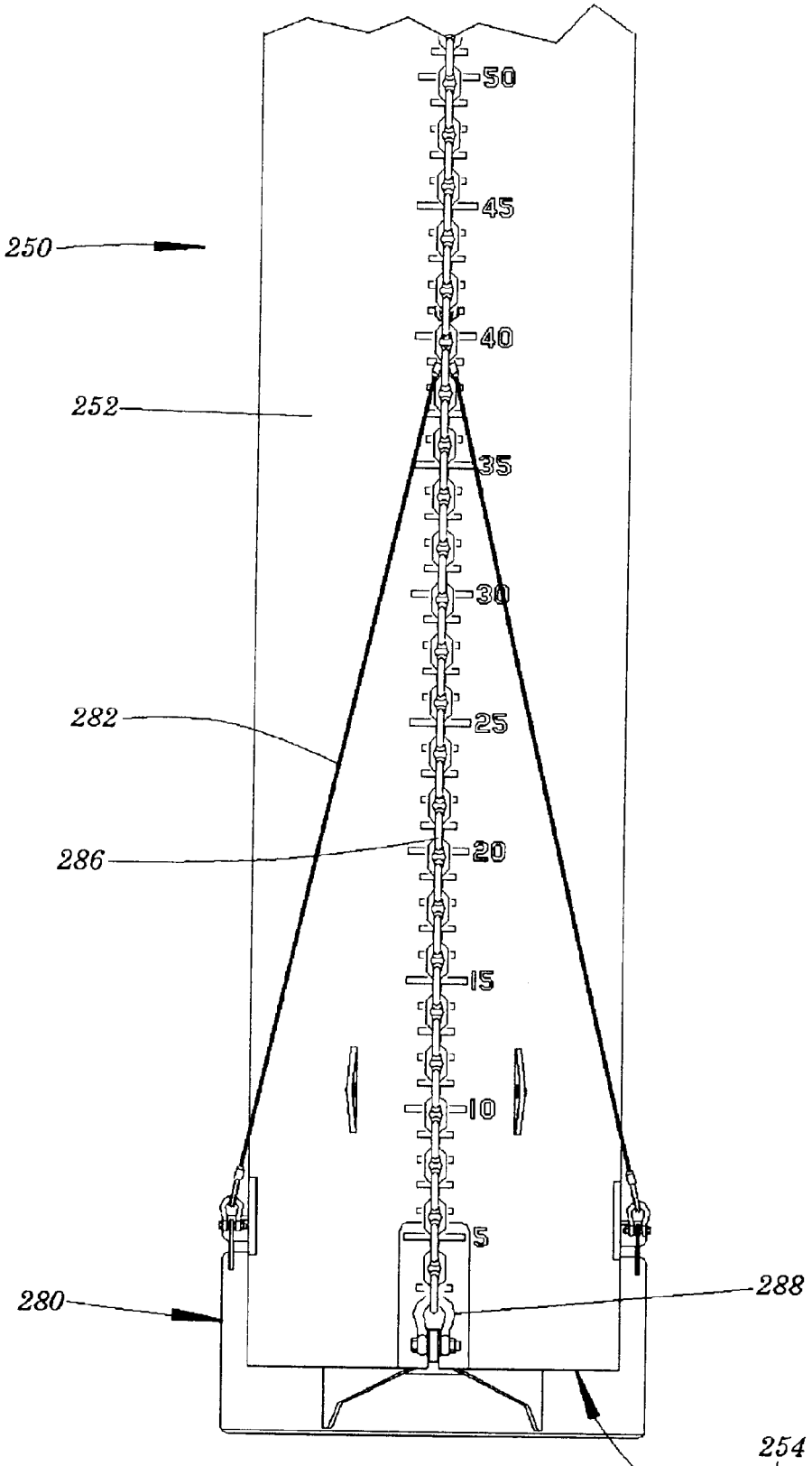

Referring now to FIGS. 20A and 20B, there is shown an anchor installation and recovery system 250 comprising a seventh embodiment of the invention. The system 250 includes a suction follower 252 comprising a right circular cylinder formed from steel and characterized by a length of about 85 feet and an outside diameter of about 14 feet. It will be understood that the geometrical configuration, the length, and the diameter of the suction follower 252 can be varied in accordance with the requirements of particular applications of the invention.

The suction follower 252 has an open bottom 254 and a top 256 which is closed by a top plate 258. A normally open flow through valve 259 is provided in the top plate 258. The suction follower 252 is supported from an anchor handling vessel (not shown in FIGS. 20A and 20B) by a lowering/recovery wire 262 which is connected to brackets 264 mounted at the upper end of the suction follower 252 by a two point bridle wire 266.

An emergency recovery assembly 268 may be secured to the two point bridle wire 266, if desired. The emergency recovery assembly 268 includes a buoy pendant wire 270, a 3 KIP submersible buoy 272, and a recovery sling 274. The emergency recovery assembly 268 is used in the event of a failure of the lowering/recovery wire 262 and functions to maintain the recovery loop 274 in an engageable position. If utilization of the emergency recovery assembly 268 is required, the recovery loop 274 is engaged by a hook which is manipulated into engagement with the recovery loop 274 by a remotely operated vehicle.

A plate anchor 280 is initially secured at the lower end of the suction follower 252 for installation thereby. The plate anchor 280 may comprise any of the plate anchors illustrated in FIGS. 1 and 2; 4 and 5; 6 and 7; 15, 16, and 17; 18; or 19, and described hereinabove in connection therewith. Preferably, however, the plate anchor 280 comprises one of the plate anchors illustrated in FIGS. 15 through 19, inclusive.

The plate anchor 280 is initially secured in engagement with the suction follower 252 by a retainer bridle 282 which extends to a release mechanism 284 mounted at the upper end of the suction follower 252. A forerunner chain 286 is connected to the plate anchor 280 by a shackle 288 and also extends to the release mechanism 284.

Figure 21A:
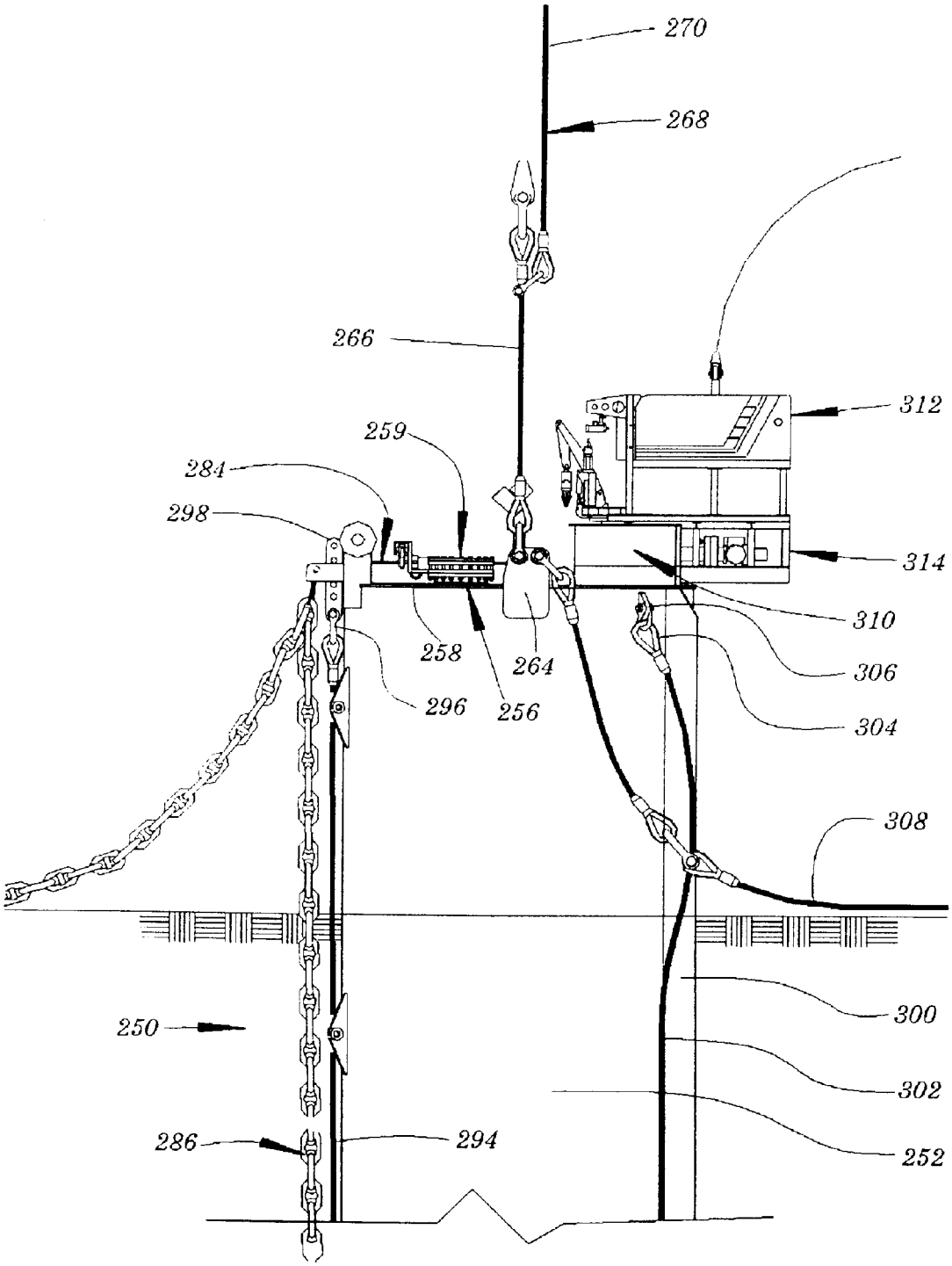
FIG. 21A and FIG. 21B, taken together, comprise a side view of the seventh embodiment of the invention.
Figure 21B:
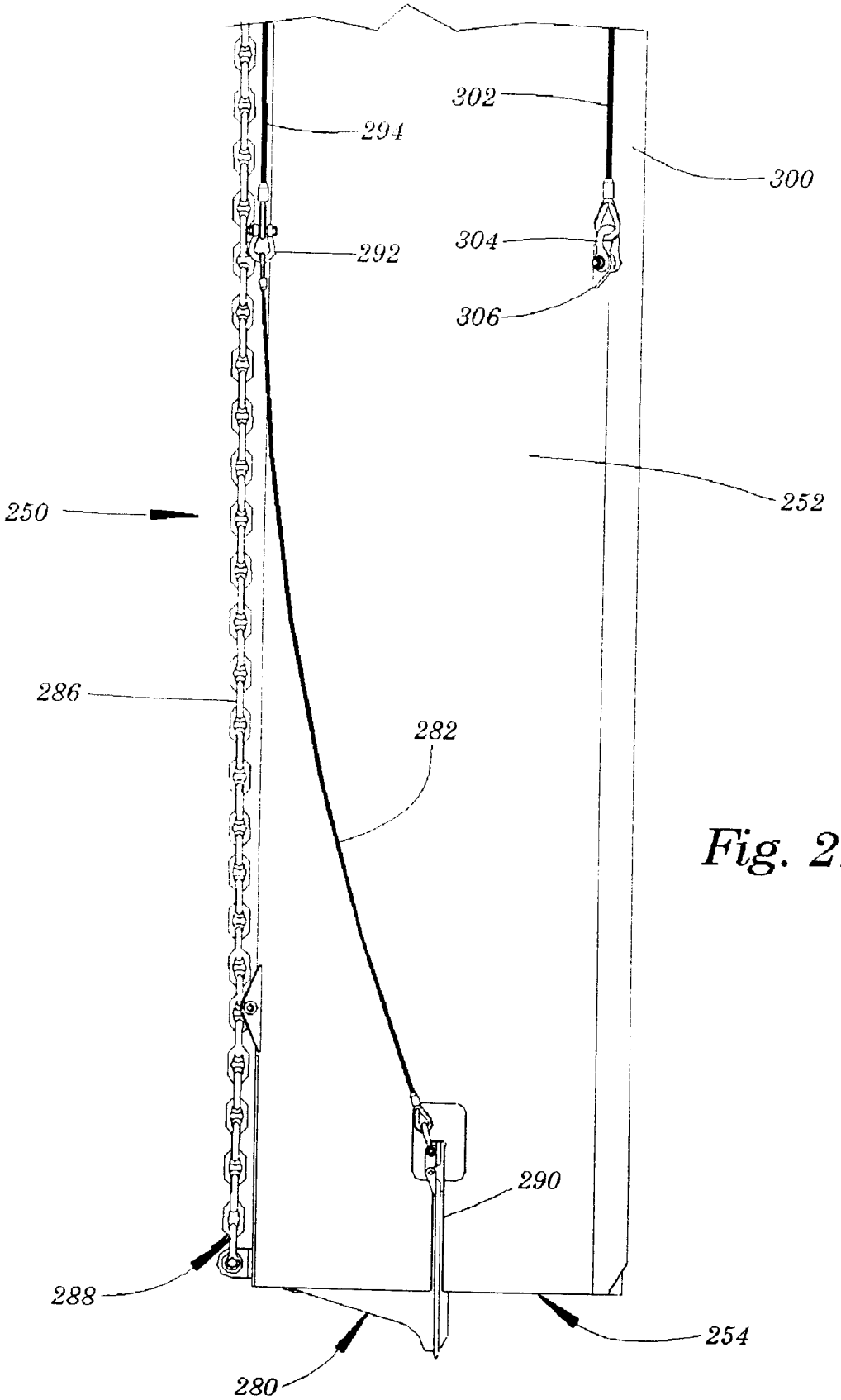

As is best shown in FIG. 21B, the plate anchor 280 is received in a slot 290 located at the bottom of the suction follower 252. The slot 290 is preferably rectangular in shape and is preferably located on the axis of the suction follower 252. Plate anchor receiving slots having other geometrical configurations and other locations on the suction follower 252 may be utilized with the requirements of particular applications of the invention.

The anchor retaining bridle 282 extends upwardly from the plate anchor 282 to a shackle 292. An anchor retaining wire 294 extends upwardly from the shackle 292 to a shackle 296 which connects the anchor retaining wire 294 to a dog bone connector 298. The dog bone connector 298, and therefore the anchor retaining wire 294, the anchor retaining bridle 282, and the plate anchor 280 are temporarily retained in engagement with the suction follower 252 by engagement of the dog bone connector 298 with the release mechanism 284. The forerunner chain 286 extends upwardly from the shackle 288 parallel to the retainer wire 294 and is also temporarily secured to the suction follower 252 by engagement with the release mechanism 284.

A pair of launch skids 300 extend along one side of the suction follower 252 and functions to prevent the suction follower from rolling on the deck of an installation vessel which transports the suction follower to and from the location at which the anchor 280 is installed. A pair of hip slings 302, utilized for launching and recovering the suction follower 252, extend longitudinally along the suction follower 252 adjacent the launch skids 300 and are retained in place by the shackles 304 and pad eyes 306. The suction follower 252 is provided with a wire sling 308 which is employed in the launching and recovery of the suction follower 252.

An ROV guide frame 310 is mounted at the top of the suction follower 252 and receives a remotely operated vehicle 312 having a pumpskid 314 mounted thereon. The remotely operated vehicle 312 may comprise a Racal Sea Lion Mk II heavy work class remotely operated vehicle having 100 horsepower; however, any of the various commercially available remotely operated vehicles having 75 horsepower or more may be used in the practice of the invention. The pumpskid 314 is preferably of the type disclosed and claimed in co-pending application Ser. No. 08/959,931, filed Oct. 29, 1997, and assigned to the assignee of the present application, the disclosure of which is incorporated herein by reference as if fully set forth herein.

Figure 22:
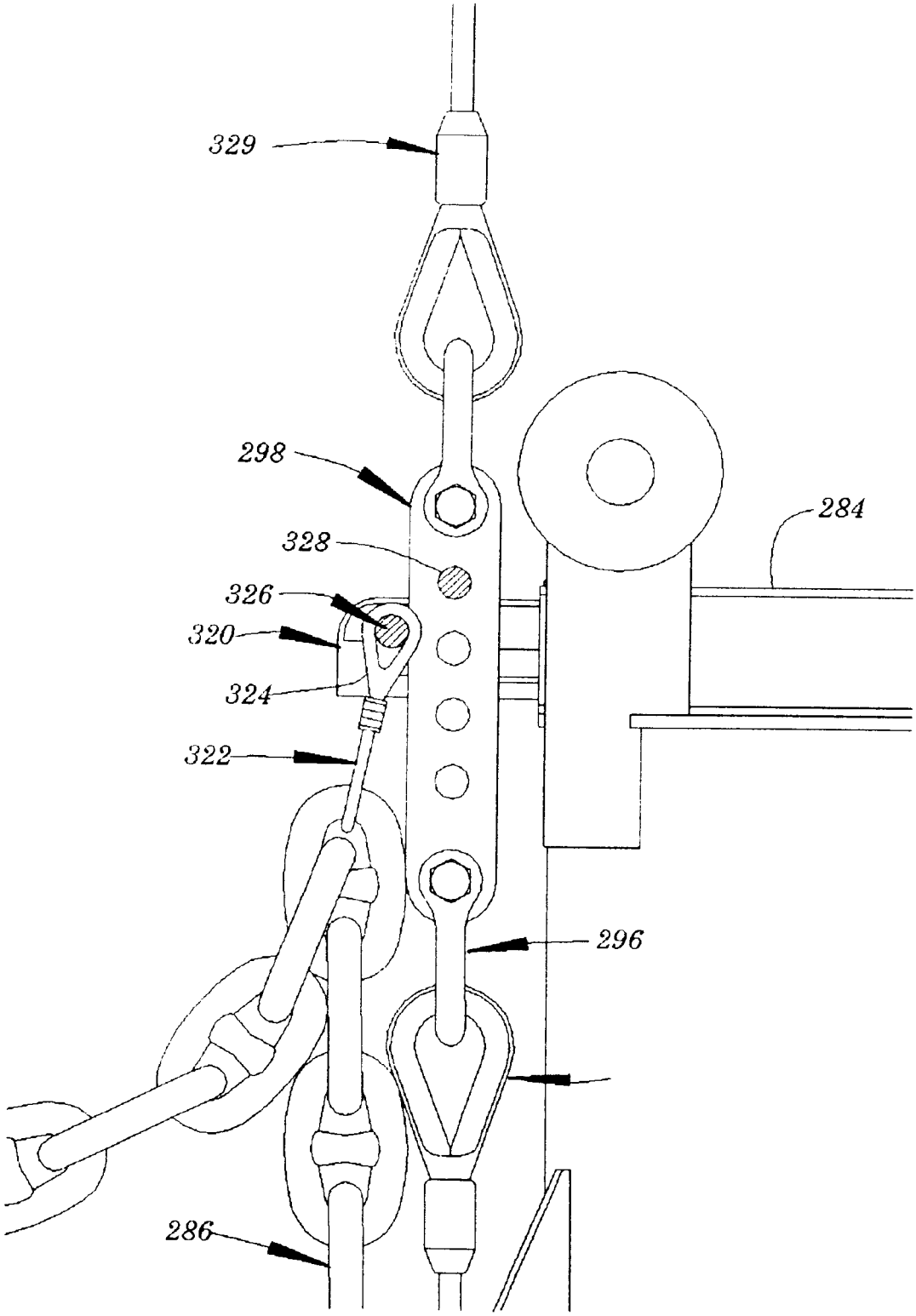
FIG. 22 comprises an enlargement of a portion of FIG. 21A.

Referring to FIG. 22, the release mechanism 284 has a hydraulically operated telescopic arm 320 extending therefrom. The forerunner chain 286 is connected to the telescopic arm 320 by a sling 322 having a soft eye 324 at each end. Each soft eye 324 has a pin 326 extending therethrough. A pin 328 temporarily secures the dog bone connector 298 to the telescopic arm 320.

An anchor retrieval assembly 329 may be secured at the upper end of the dog bone connector 298. The anchor retrieval assembly 329 is substantially identical to the emergency recovery assembly 268 except that the buoyancy of the buoy thereof is about 1.3 KIP.

The hydraulic actuator of the release mechanism 284 is actuated from the remotely operated vehicle 312. Upon actuation, the hydraulic actuator retracts the internal part of the arm 320 which first disengages the forerunner chain 286 by releasing the pin 326 and sling 322. Upon further operation of the hydraulic actuator, the dog bone connector 298 is also released from the arm 320.

FIGS. 23 through 41, inclusive, illustrate a method of anchor installation and retrieval comprising an eighth embodiment of the invention. The method is preferably utilized in conjunction with the anchor installation and recovery system 250 shown in FIGS. 20A, 20B, 21A, 21B, and 22, it being understood that the method can also be utilized with other anchor installation and recovery systems.

Referring particulary to FIGS. 21A, 21B, 23, and 24, the anchor installation and recovery system 250 is transported to an anchor installation site on a first anchor handling vessel 330. During transportation, the launch skids 300 prevent the suction follower 252 from rolling on the deck of the vessel 330. The lowering/recovery wire 262 is connected to the bridle 266 and extends around a pulley mounted on a gantry crane 331 to a winch 332 on the vessel 330. The installation wire sling 308 is connected to a line 333 which extends to a winch 334. The hip slings 302 are disconnected from the pad eyes 306 at the upper end of the suction follower 252 and are connected to lines 335 which extend to a pair of hip sling deadmans 336. A pair of tugger lines 337 extend from a winch on the vessel 330 and are connected to the pad eyes 306 at the upper end of the suction follower 252. A mooring line 338 extends between the first anchor handling vessel 330 and a second handling vessel 339.

Figure 23:
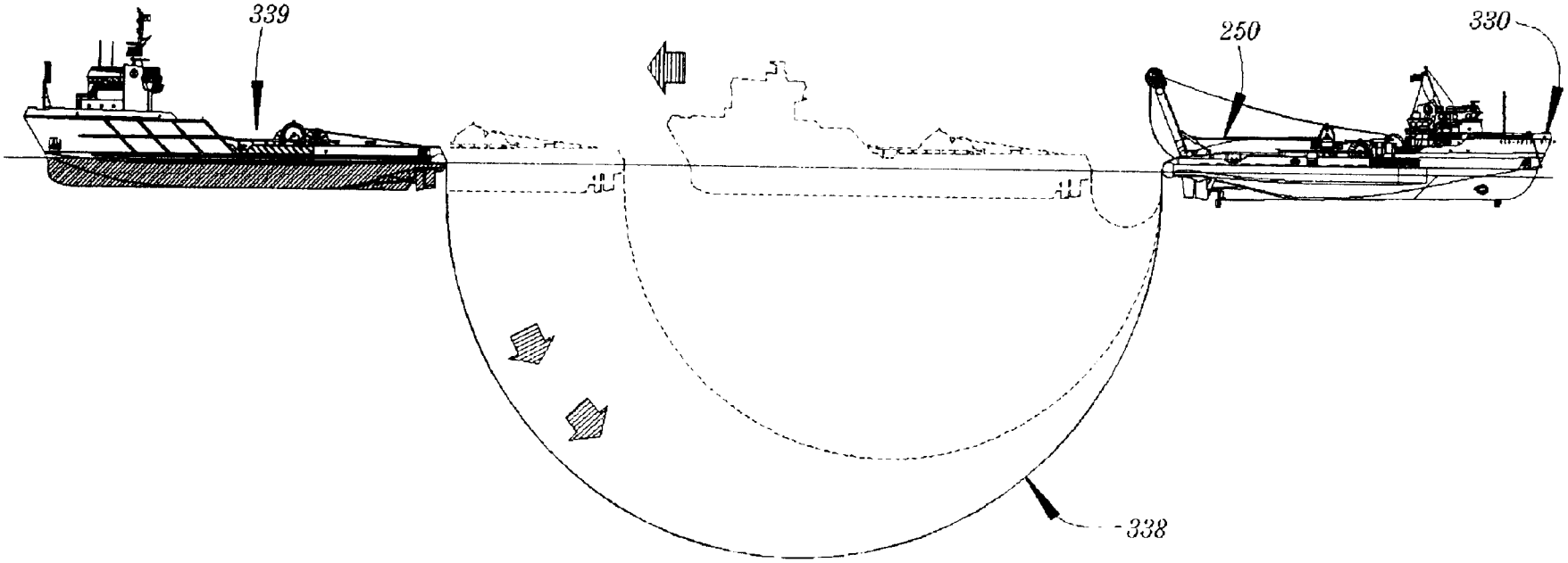
FIG. 23 is an illustration of early steps in a method of anchor installation comprising an eighth embodiment of the invention.
Figure 24:
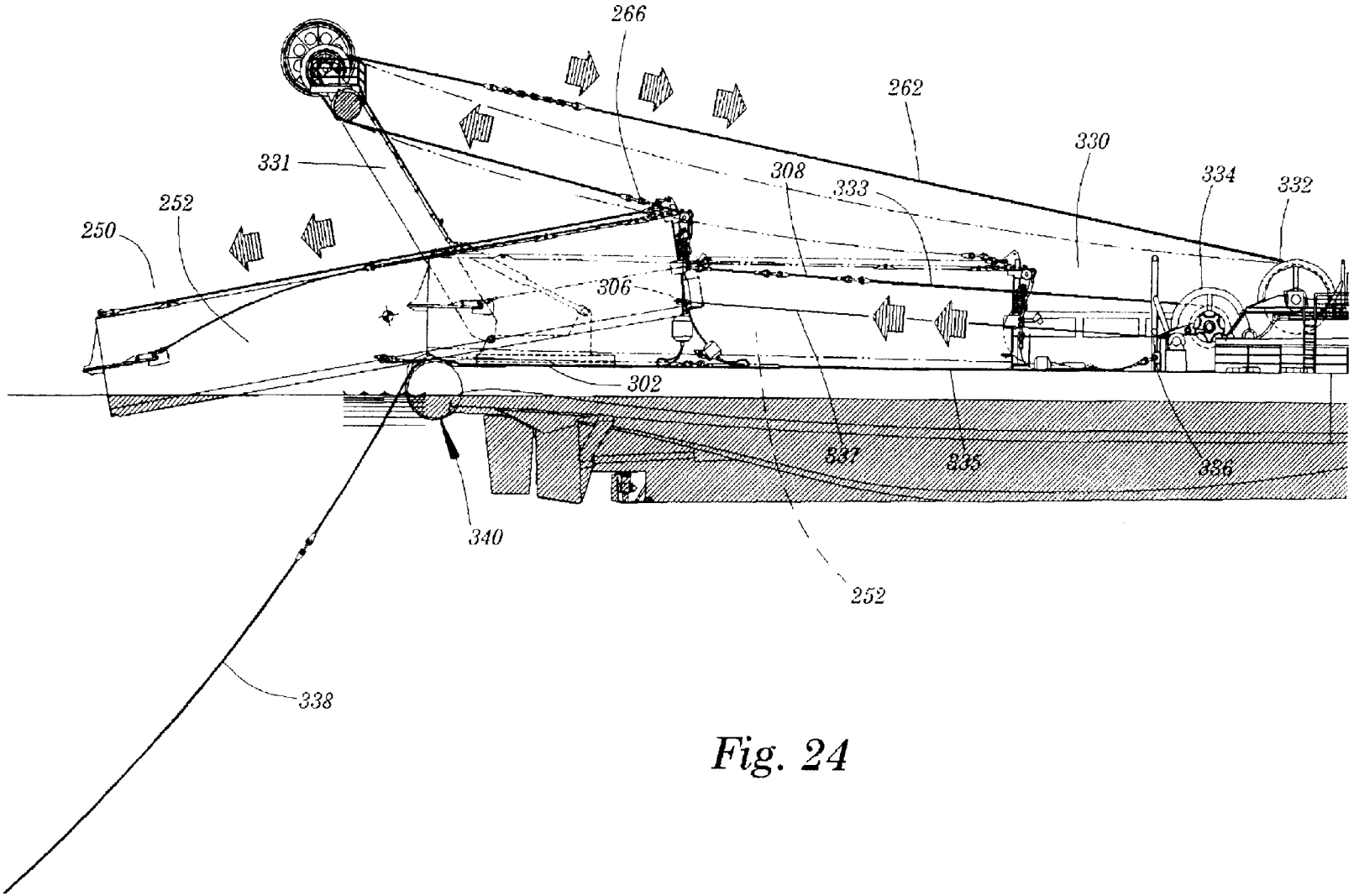
FIG. 24 is an illustration of a somewhat later step in the method of FIG. 23.
Figure 25:
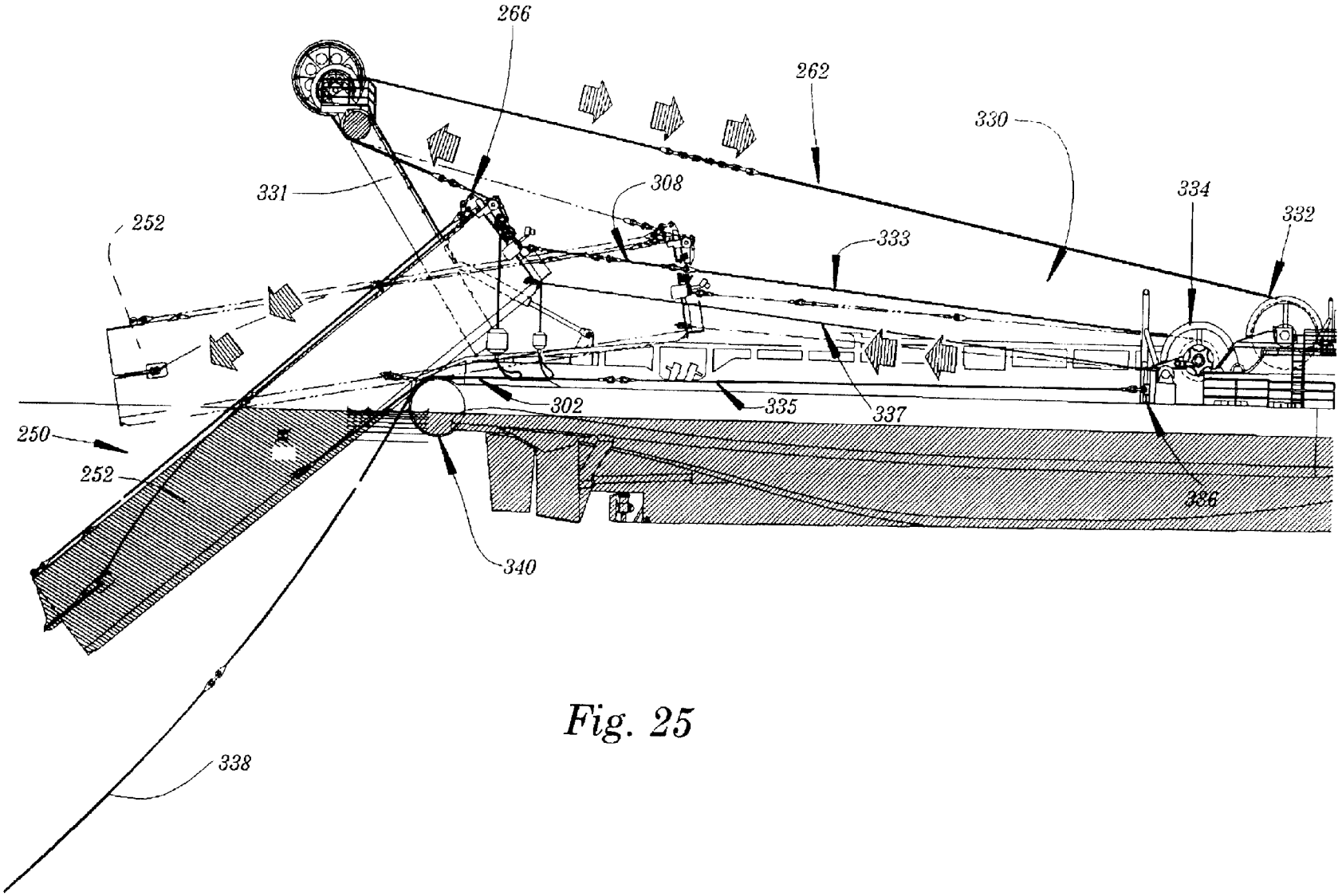
FIG. 25 is an illustration of a still later step in the method of FIG. 23.

Referring specifically to FIGS. 23 and 24, after the mooring line 338 is connected between the anchor handling vessels 330 and 339, the anchor handling vessel 339 moves away from the anchor handling vessel 330 until the two vessels are separated by a distance of approximately 650 feet. The winch 332 is actuated to move the suction follower 252 rearwardly relative to the vessel 330. The winch 334 is actuated to apply a retarding force which prevents the suction follower 252 from moving rearwardly too rapidly. Simultaneously, the tugger lines 337 are payed out. The foregoing operations continue until the suction follower 252 is positioned as shown in FIG. 25. At this point the line 333 becomes taut, as does the hip slings 302. Pay out of the tugger lines 337 is continued.

Figure 26:
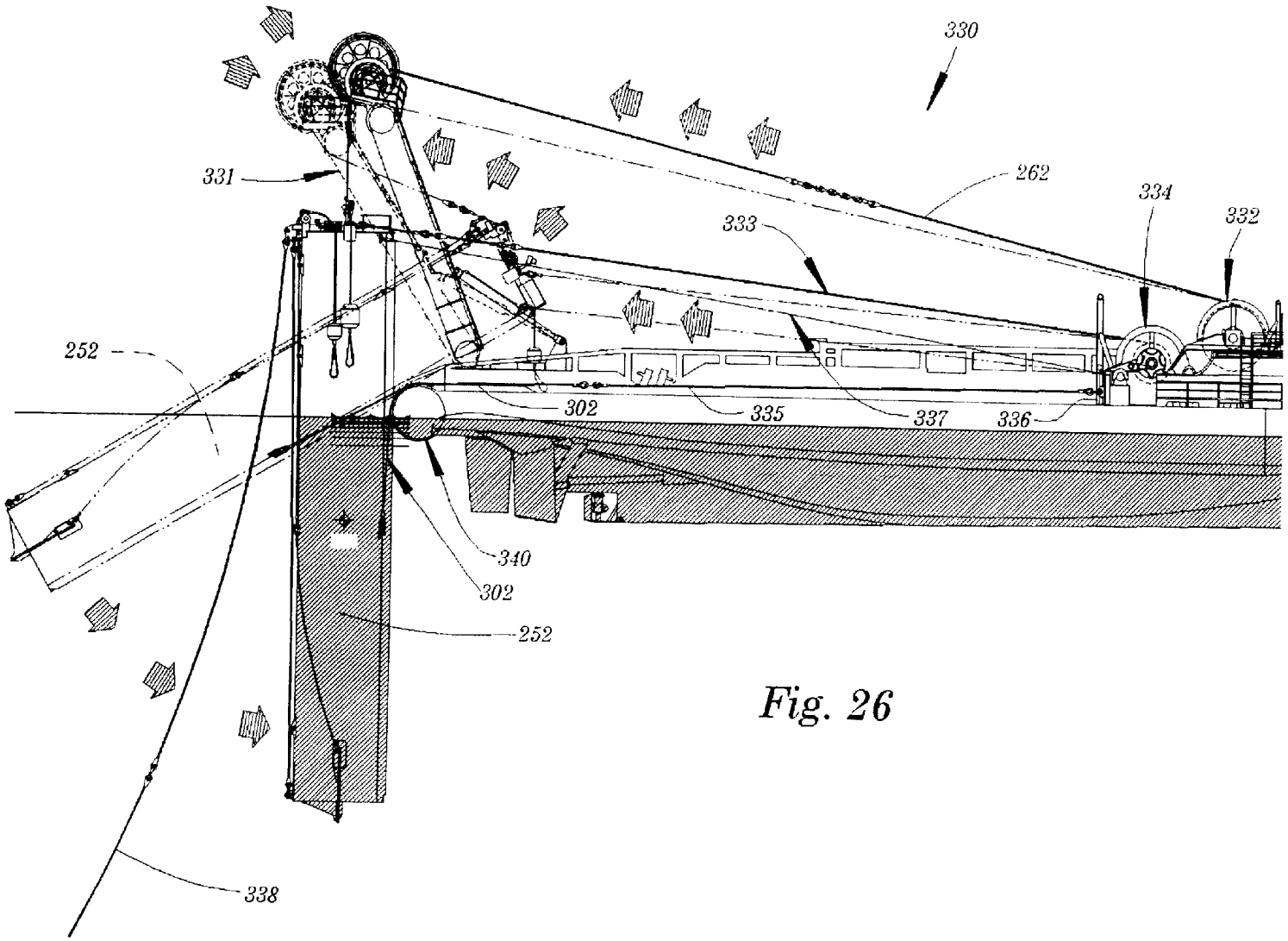
FIG. 26 is an illustration of a still later step in the method of FIG. 23.

Referring to FIG. 26, as the hip slings 302 become taut, the operation of the winch 332 is reversed, allowing the lowering/recovery wire 262 to become somewhat slack. The winch 334 is likewise operated to release tension on the line 333, thereby allowing the suction follower 252 to pivot into a vertical orientation. The line 333 and the tugger lines 337 prevent the suction follower 252 from pivoting more than the desired amount. The positioning of the crane 331 is adjusted until the suction follower 252 is secured against the stern roller of the vessel 330.

Figure 27:
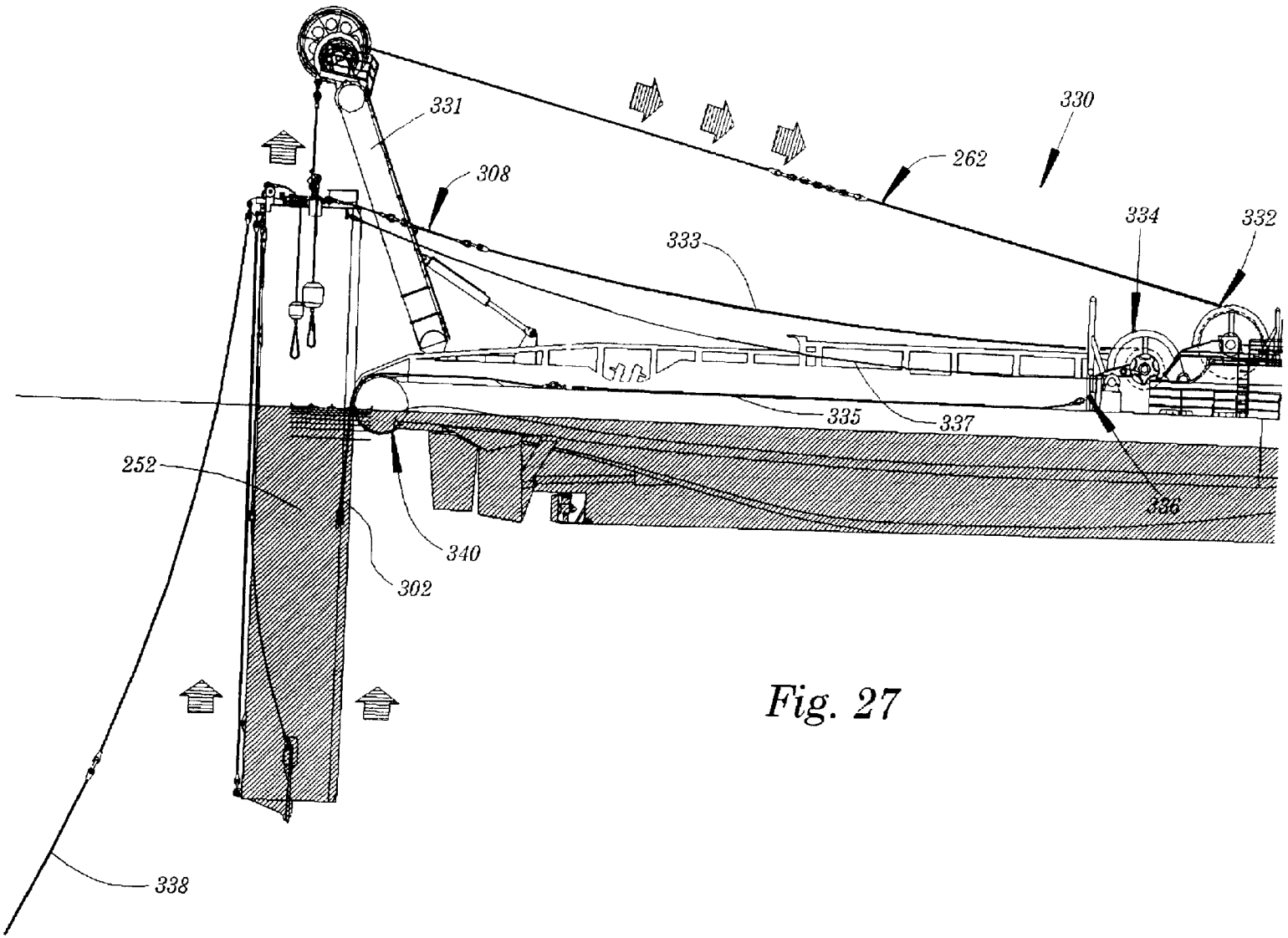
FIG. 27 is an illustration of a still later step in the method of FIG. 23.
Figure 28:
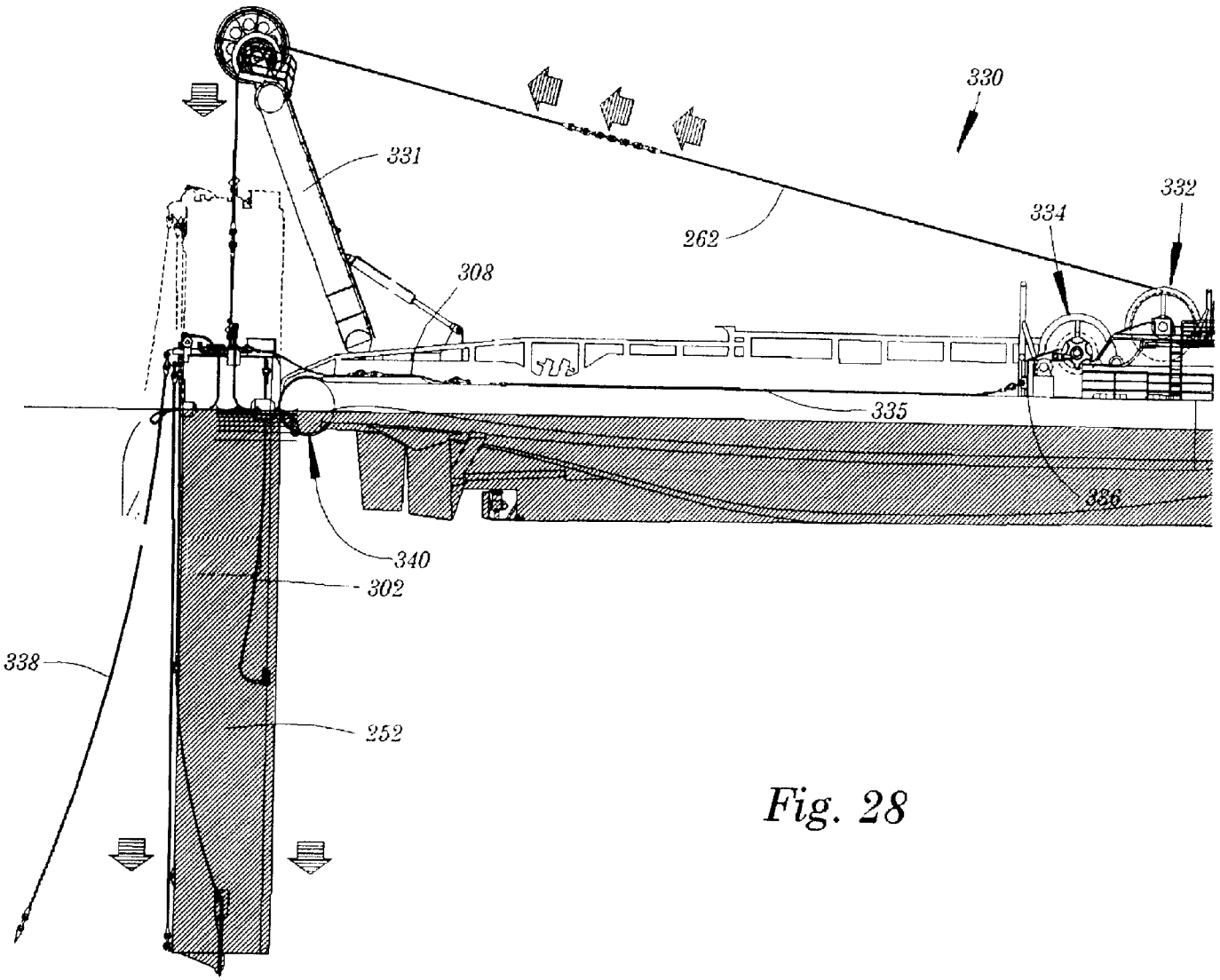
FIG. 28 is an illustration of a still later step in the method of FIG. 23.

The next step in the method of anchor installation is illustrated in FIG. 27. The winch 332 is actuated to lift the suction follower 252 sufficiently to remove tension from the hip slings 302. At this point, the hip slings 302 are disconnected from the lines 335. As is best shown in FIG. 28, the winch 332 is then operated to lower the suction follower 252. The tugger lines 337 are disconnected from the pad eyes 306 at the upper end of the suction follower 252, and the hip slings 302 are reconnected thereto using the shackles 304. The sling 308 is likewise disconnected from the line 333.

Figure 29:
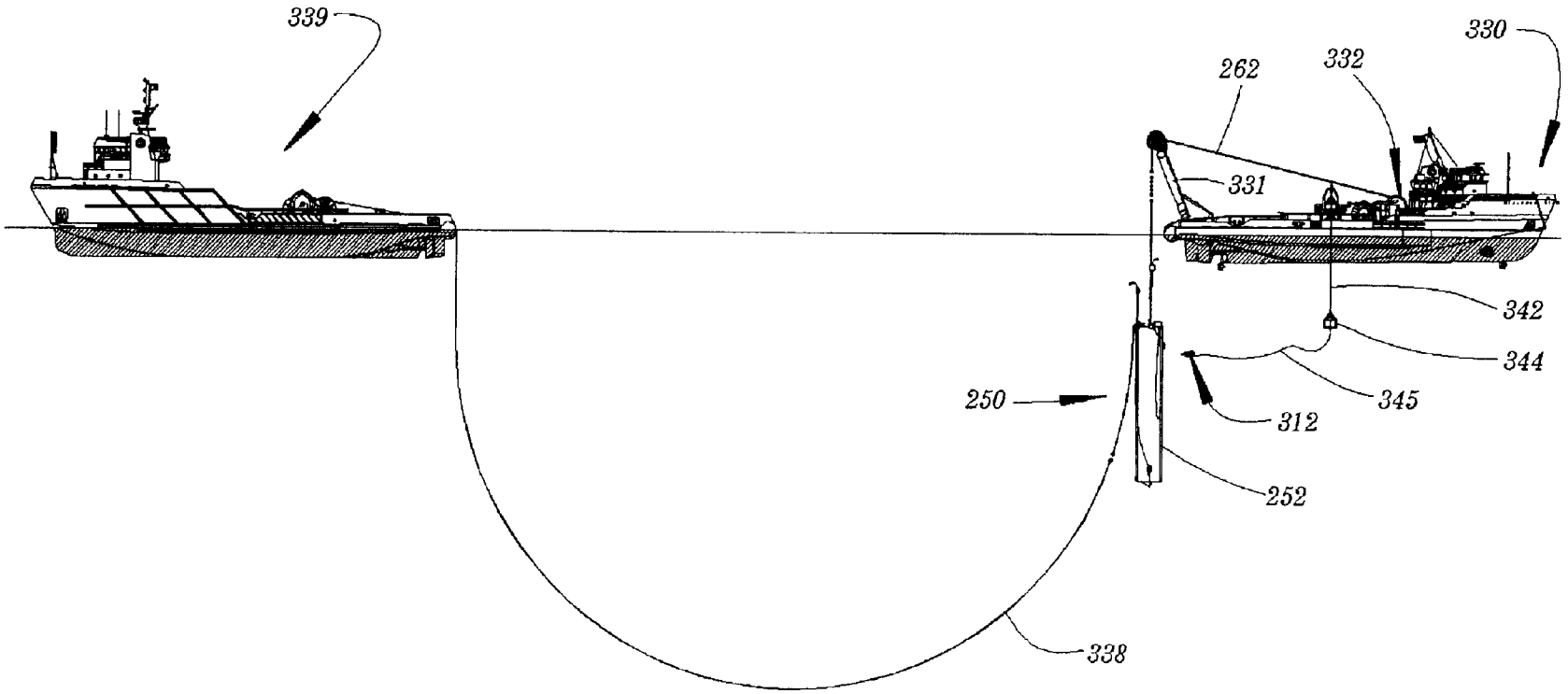
FIG. 29 is an illustration of a still later step in the method of FIG. 23.

Referring to FIG. 29, the vessels 330 and 339 remain separated by a distance of approximately 650 feet. The winch 332 is actuated to pay out the lowering/recovery wire 262 allowing the suction follower 252 to move downwardly. The remotely operated vehicle 312 is deployed from the vessel 330 on a umbilical wire 342 which is provided with a tether management system 344. The remotely operated vehicle is controlled through a tether 345, and observes the anchor installation and recovery system 250 prior to further lowering to assure that all component parts thereof are in proper order.

Figure 30:
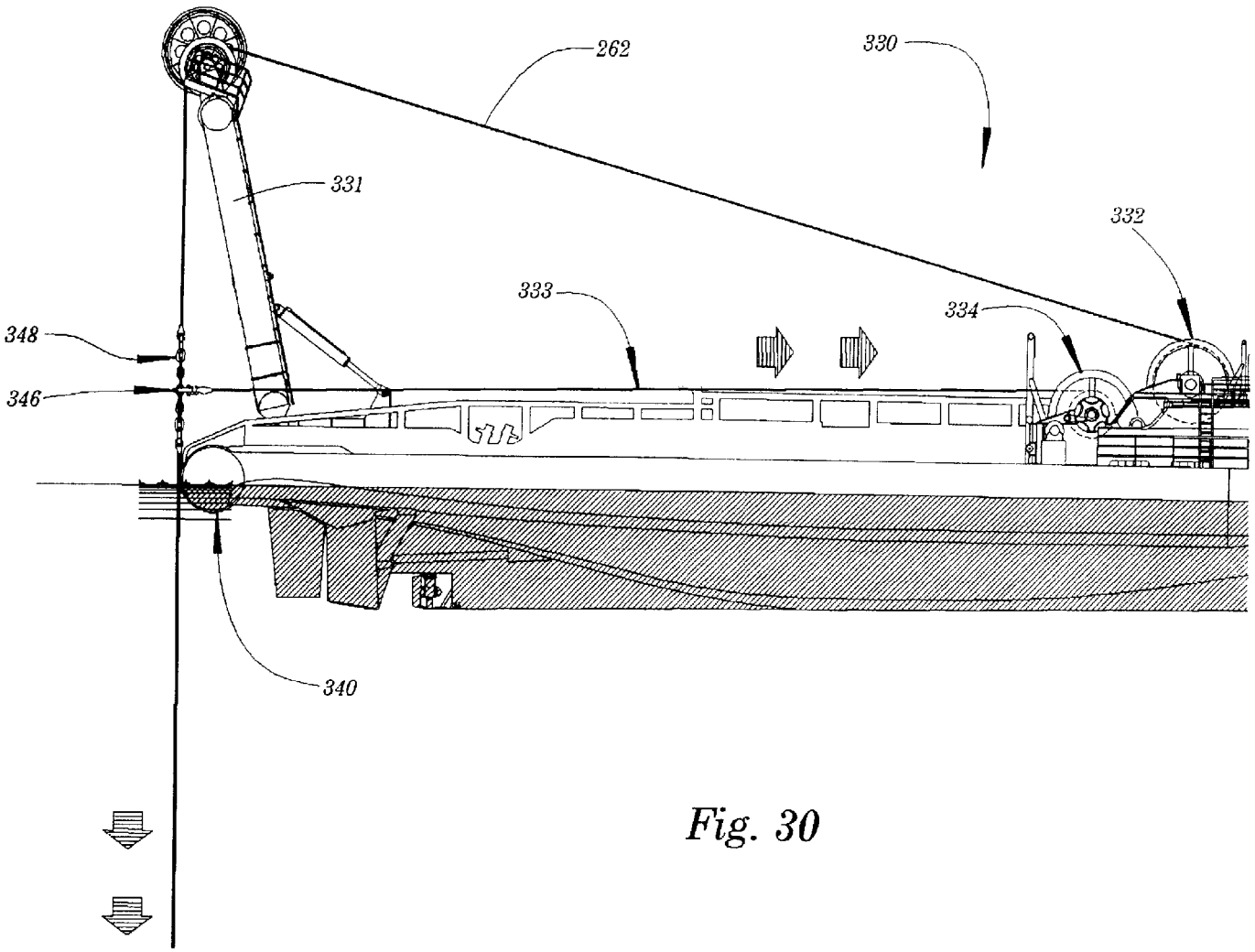
FIG. 30 is an illustration of a still later step in the method of FIG. 23.
Figure 31:
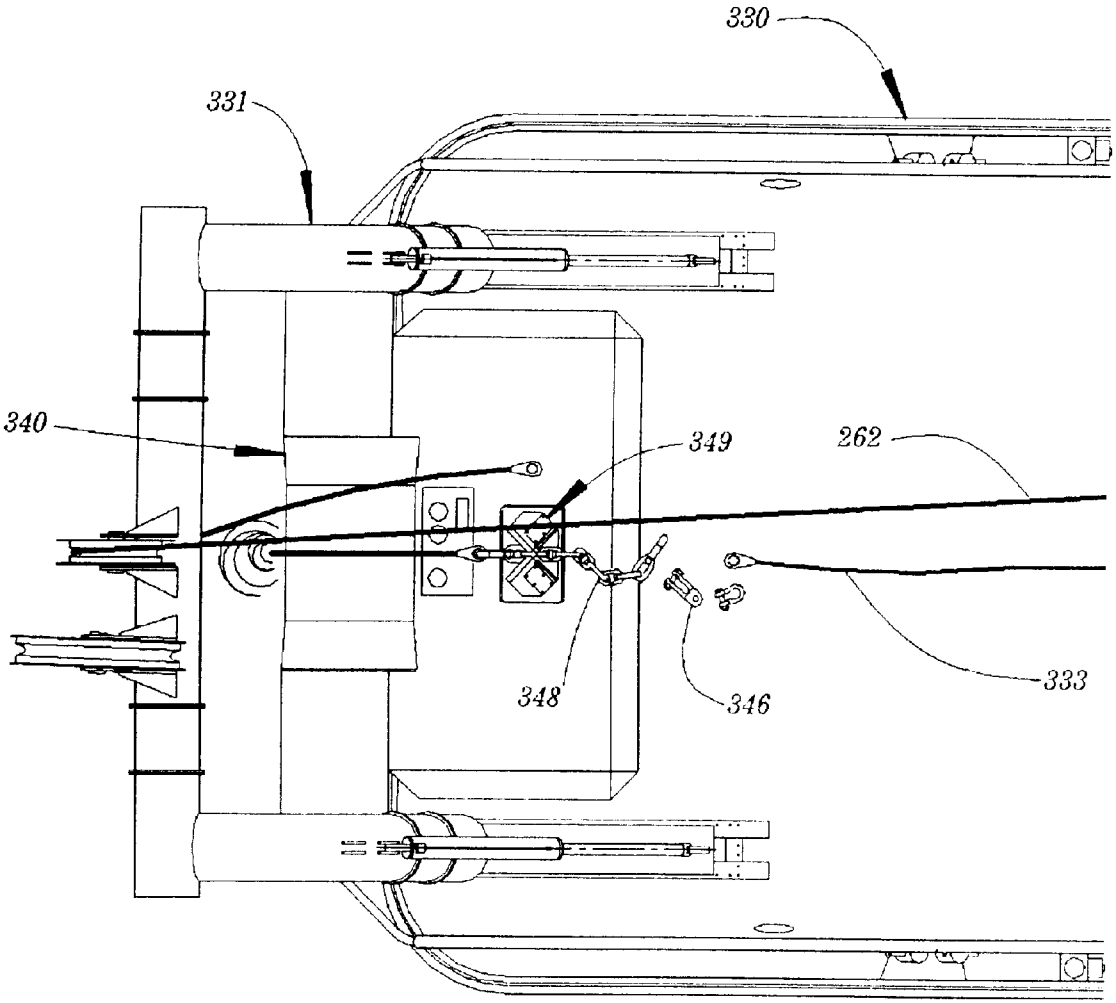
FIG. 31 is an illustration of a still later step in the method of FIG. 23.
Figure 32:
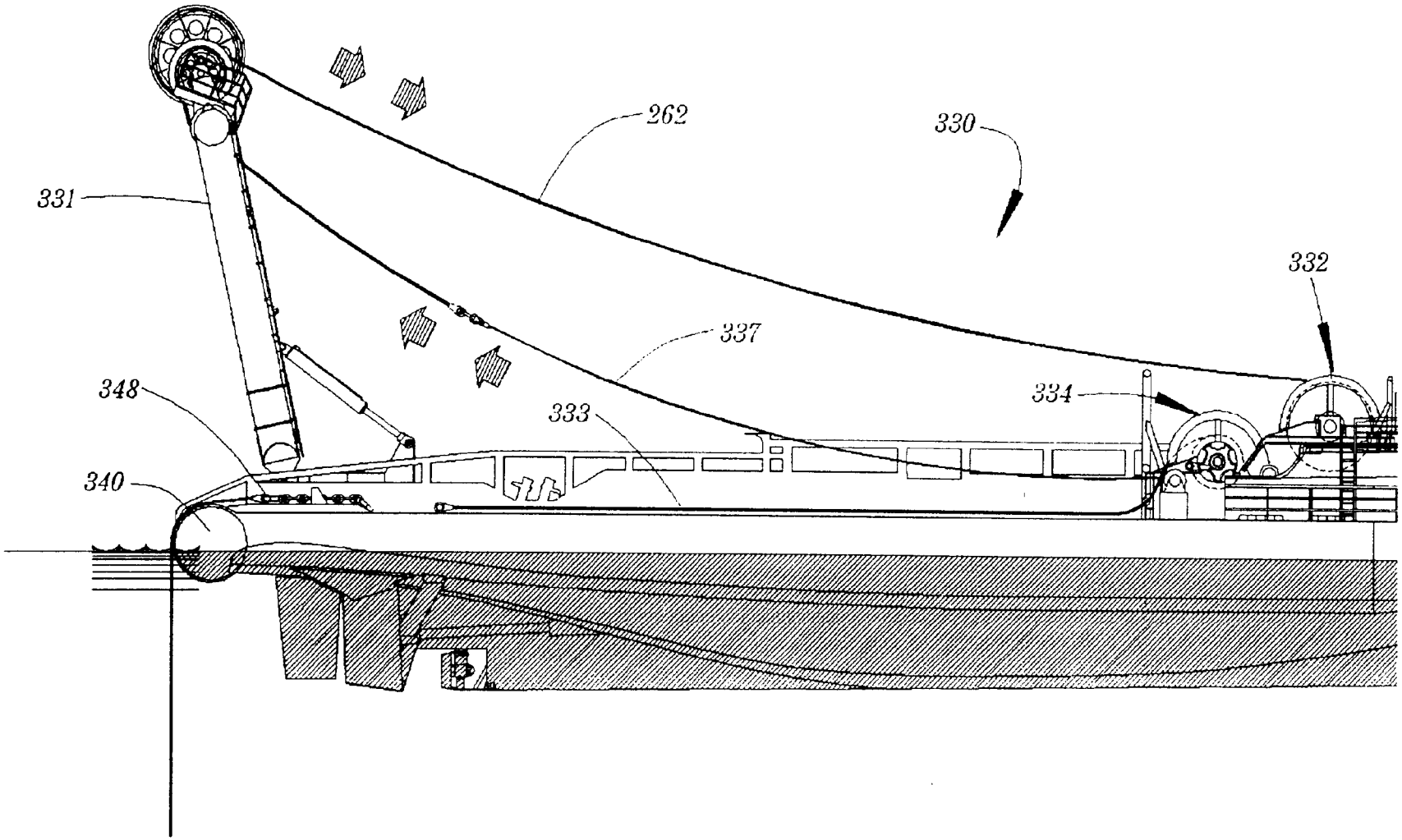
FIG. 32 is an illustration of a still later step in the method of FIG. 23.
Figure 33:
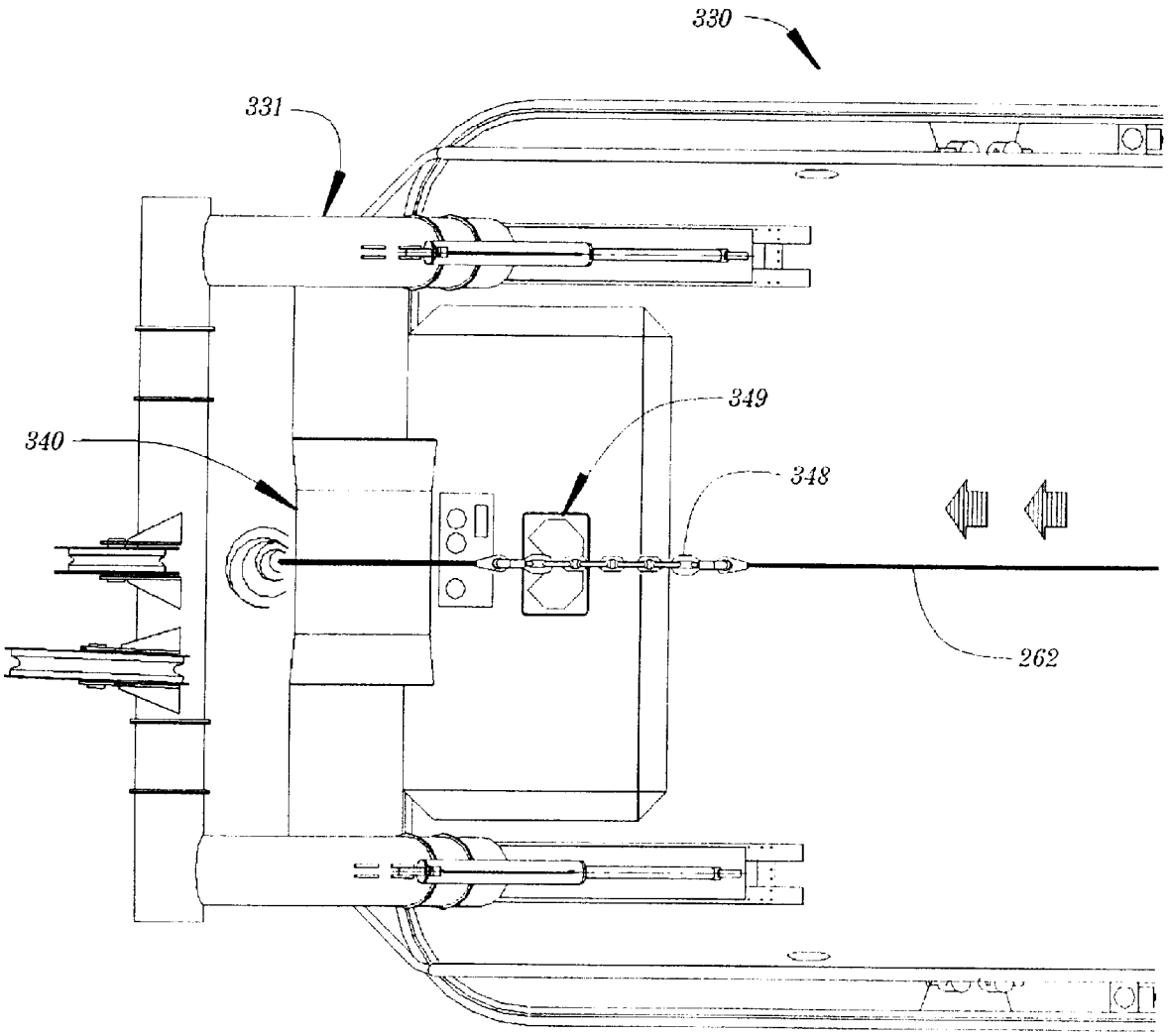
FIG. 33 is an illustration of a still later step in the method of FIG. 23.

As is best shown in FIG. 30, the line 333 extends from the winch 334 and is connected to a tuning fork shackle 346 which captures a chain section 348 of the lowering/recovery wire 262. Referring to FIGS. 31, 32, and 33, the winch 334, the line 333, and the shackle 346 are utilized to engage the chain 348 with a shark's jaw 349. The tugger line 337 is then secured to the distal end of the lowering/recovery wire 262. The winch 332 is then actuated to draw the wire 262 inwardly against resistance supplied by the tugger line 337. This process continues until the distal end of the lowering/recovery wire 262 has cleared the crane 331.

The distal end of the wire 262 is next disengaged from the tugger line 337 and is re-connected to the chain 348. Thereafter, the winch 332 is operated to pay out the lowering/recovery wire 262, thereby lowering the anchor installation and recovery system 250 comprising the suction follower 252 and the plate anchor mounted therein downwardly toward the sea floor. The line 262 could also remain rigged over the pulley mounted on the crane 330, in case the vessel has adequate stability to support the weight of the anchor installation and recovery system 250, and the weight of the line 262. It will be understood that during the lowering procedure the line 262 is payed out over the stern roller 340 rather than the pulley mounted on the crane 331.

Figure 34:
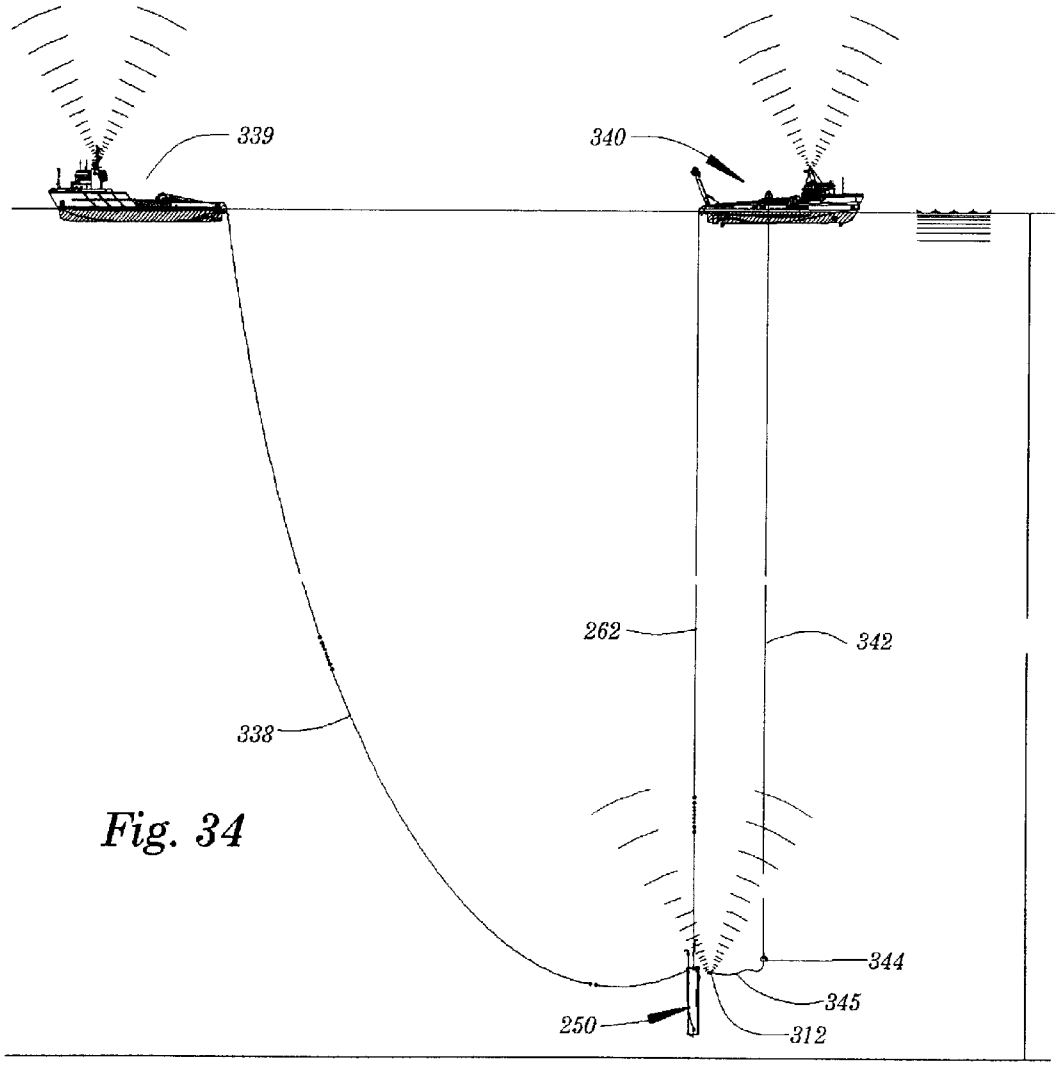
FIG. 34 is an illustration of a still later step in the method of FIG. 23.

Referring to FIG. 34, the lowering/recovery line 262 is payed out until the anchor installation and recovery system 250 is positioned between about 20 feet and about 30 feet above the sea floor. The second anchor handling vessel 339 applies power to assure that the suction follower 252 is properly oriented. The remotely operated vehicle 312 is utilized to assure that the anchor installation and recovery system 250 is in proper condition for installation, and in particular the proper orientation thereof. Strict communication is maintained at all times between the operators of the remotely controlled vehicle 312 and the vessels 330 and 339 to assure correct orientation of the suction follower 252.

Figure 35:
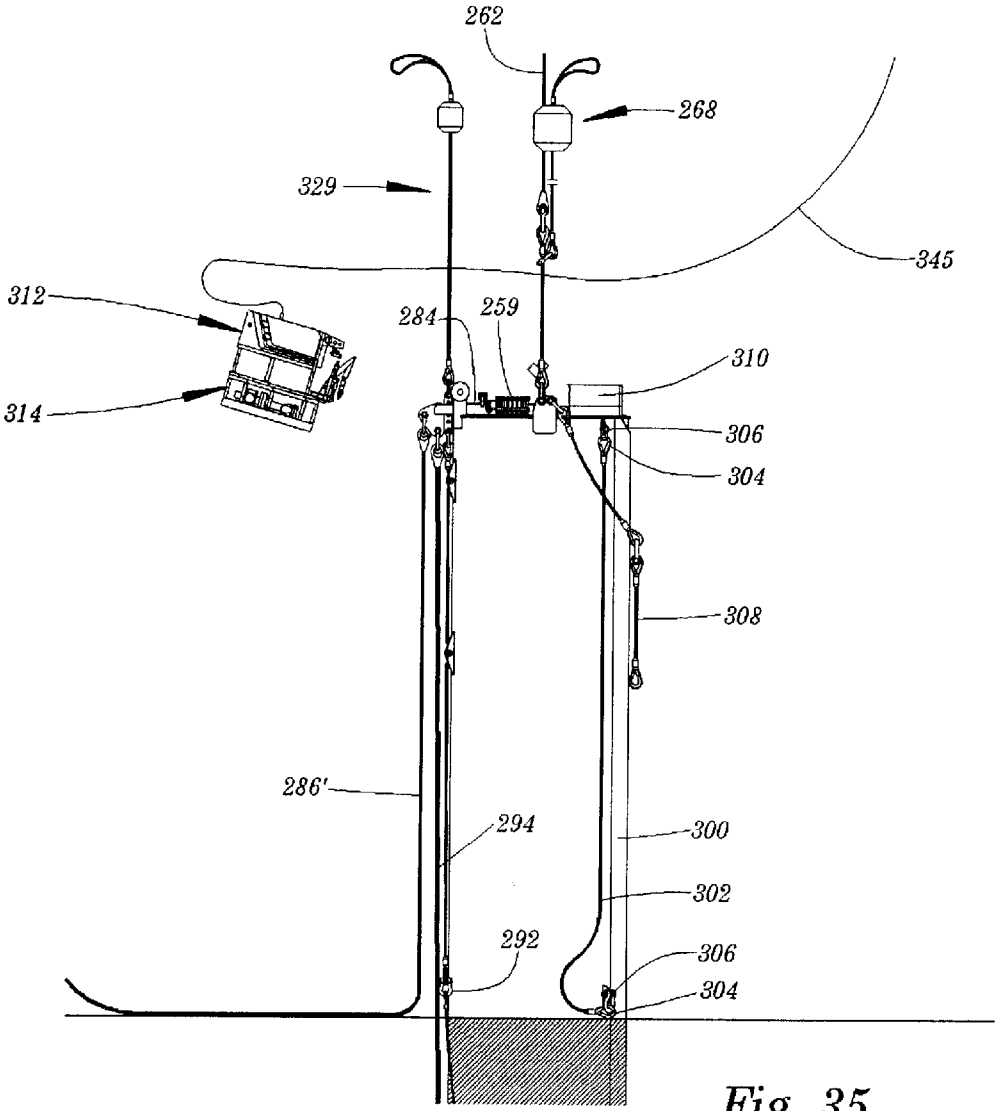
FIG. 35 is an illustration of a still later step in the method of FIG. 23.
Figure 36:
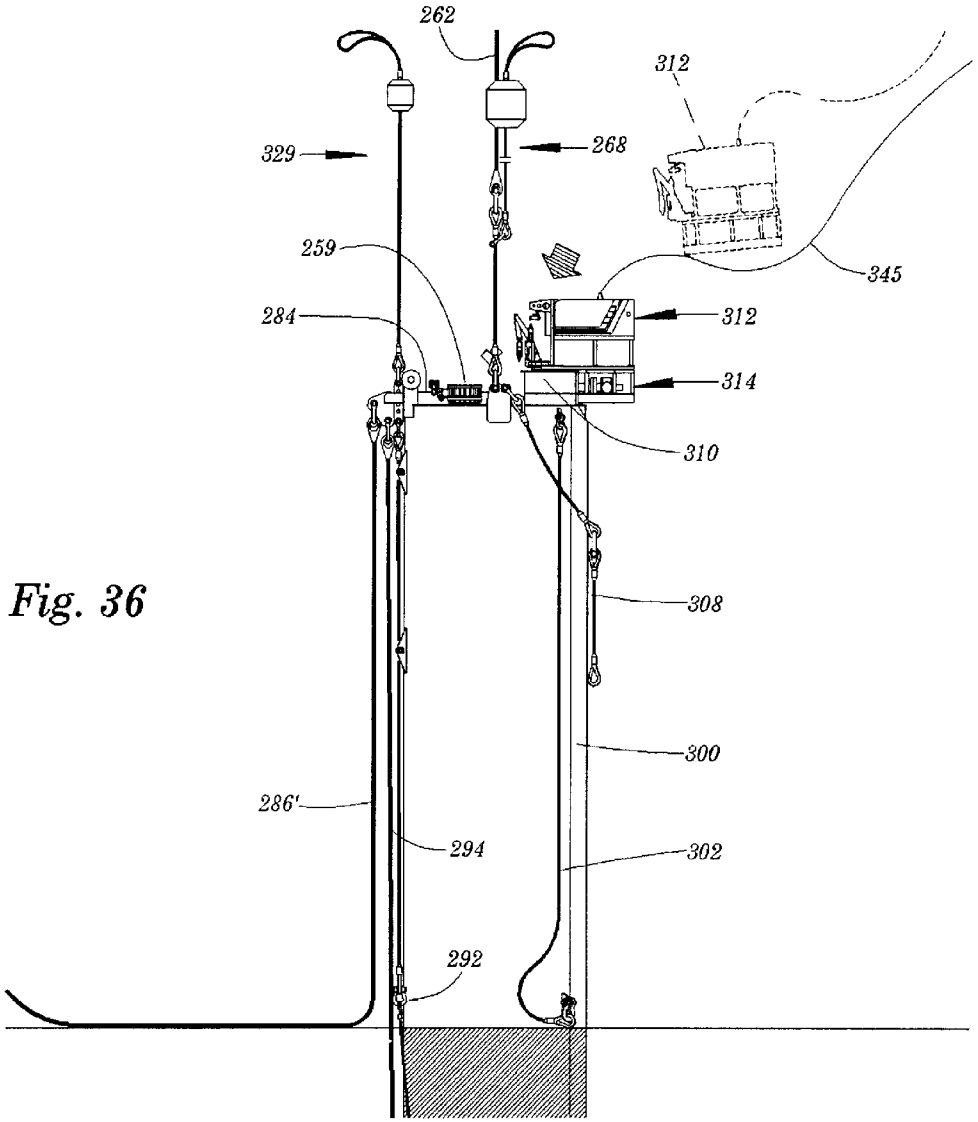
FIG. 36 is an illustration of a still later step in the method of FIG. 23.

After the remotely operated vehicle 312 has determined that the suction follower 252 is properly oriented and that all other conditions necessary to anchor installation have been fulfilled, the lowering/recovery line 262 is payed out to allow the suction follower 252 to engage the sea floor and to partially penetrate the sea floor under its own weight. This stage of the installation procedure is illustrated in FIG. 35, wherein the remotely operated vehicle 312 is illustrated observing the orientation of the suction follower 252. One of the conditions which must be met at this stage is the proper vertical orientation of the suction follower 252 which is determined by utilizing the remotely operated vehicle 312 to observe a bulls-eye level mounted on the suction follower 252. As is shown in FIG. 36, following the observation step, the remotely operated vehicle 312 docks into the guide 310. Thereafter, the remotely operated vehicle 312 is operated in the "full thrust-up" mode to assure that it is properly locked in place in the guide 310.

Figure 37:
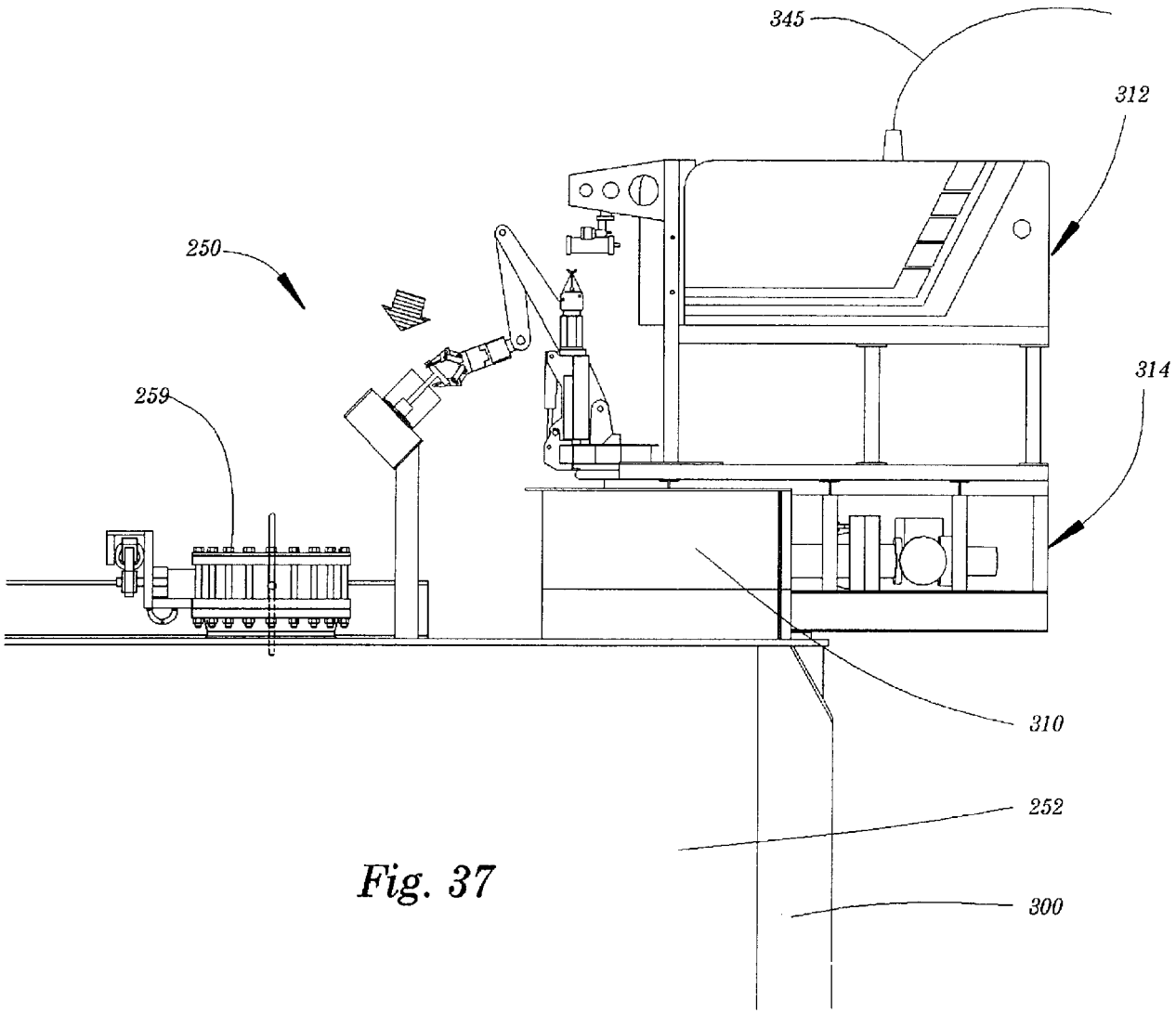
FIG. 37 is an illustration of a still later step in the method of FIG. 23.
Figure 38:
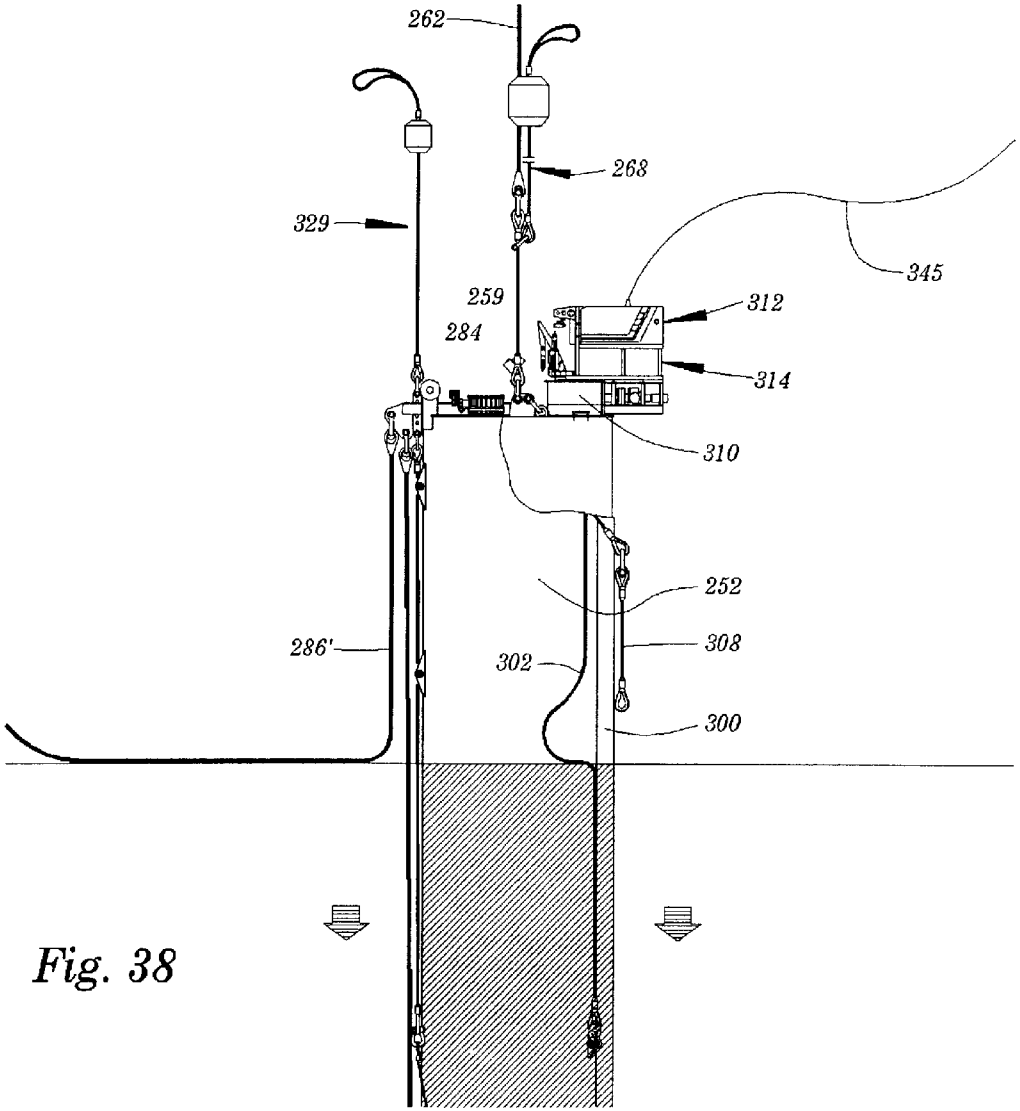
FIG. 38 is an illustration of a still later step in the method of FIG. 23.

Referring to FIGS. 37 and 38, the next step in the anchor installation procedure is the operation of the hot stab of the remotely operated vehicle 312 to close the normally open flow through valve 259. Thereafter, the hot stab of the remotely operated vehicle 312 is withdrawn for safety. Then, the remotely operated vehicle 312 actuates the pumpskid 314 to pump water out of the interior of the suction follower 252. This causes a differential pressure between the interior of the suction follower 252 and the surrounding water which forces the suction follower 252 and the plate anchor thereby downwardly into the sea floor.

Figure 39:
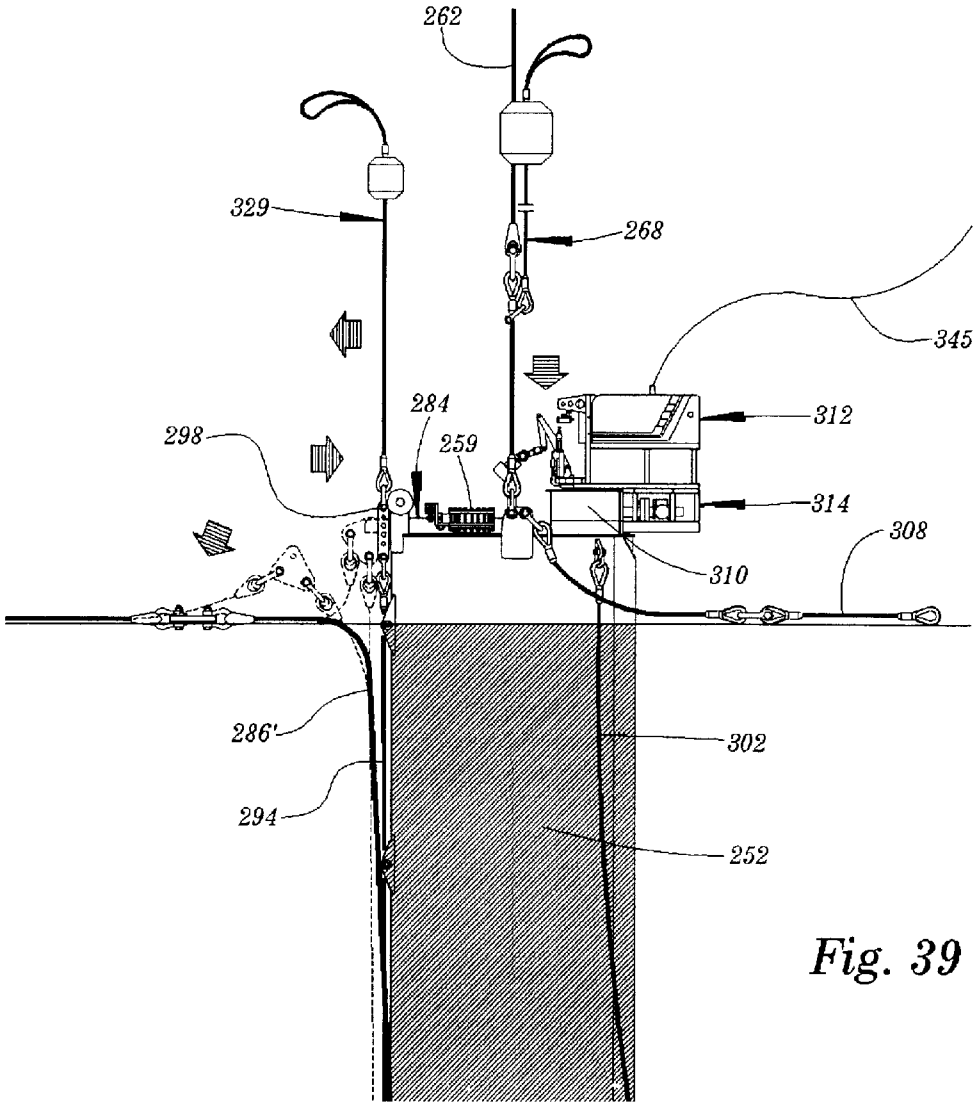
FIG. 39 is an illustration of a still later step in the method of FIG. 23.
Figure 40:
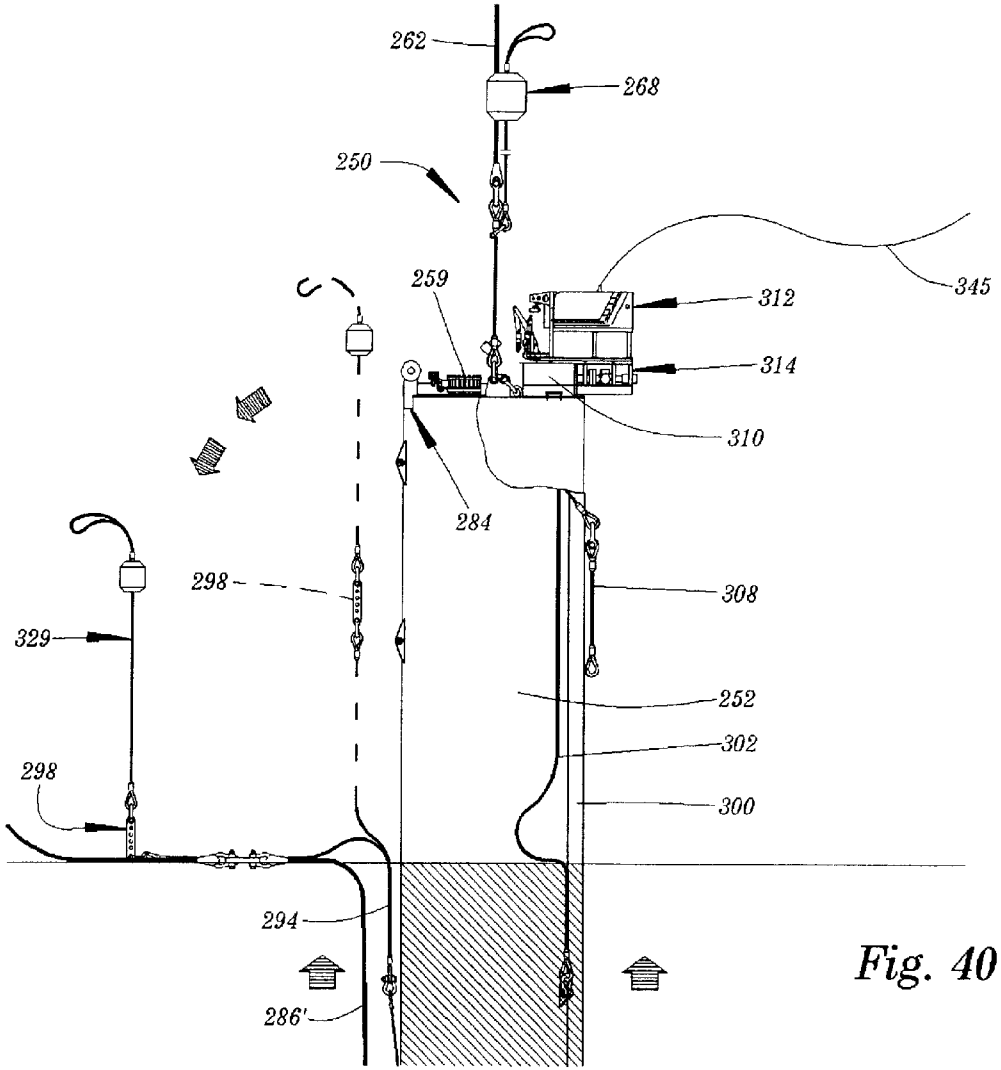
FIG. 40 is an illustration of a still later step in the method of FIG. 23.

Referring to FIGS. 39 and 40, when the suction follower 252 has penetrated the sea floor to a predetermined depth, the release mechanism 284 is actuated to disengage the forerunner wire 286' and the dog bone connector 298. Thereafter, the operation of the pumpskid 314 is reversed, thereby pumping water into the interior of the suction follower 252. This causes a differential pressure between the interior of the suction follower 252 and the surrounding sea which lifts the suction follower 252 upwardly and out of engagement with the sea floor. However, because the dog bone connector 298 and the forerunner wire 286' have been disengaged, the plate anchor which was embedded in the sea floor by operation of the suction follower 252 does not move upwardly therewith, but instead remains embedded in the sea floor.

Figure 41:
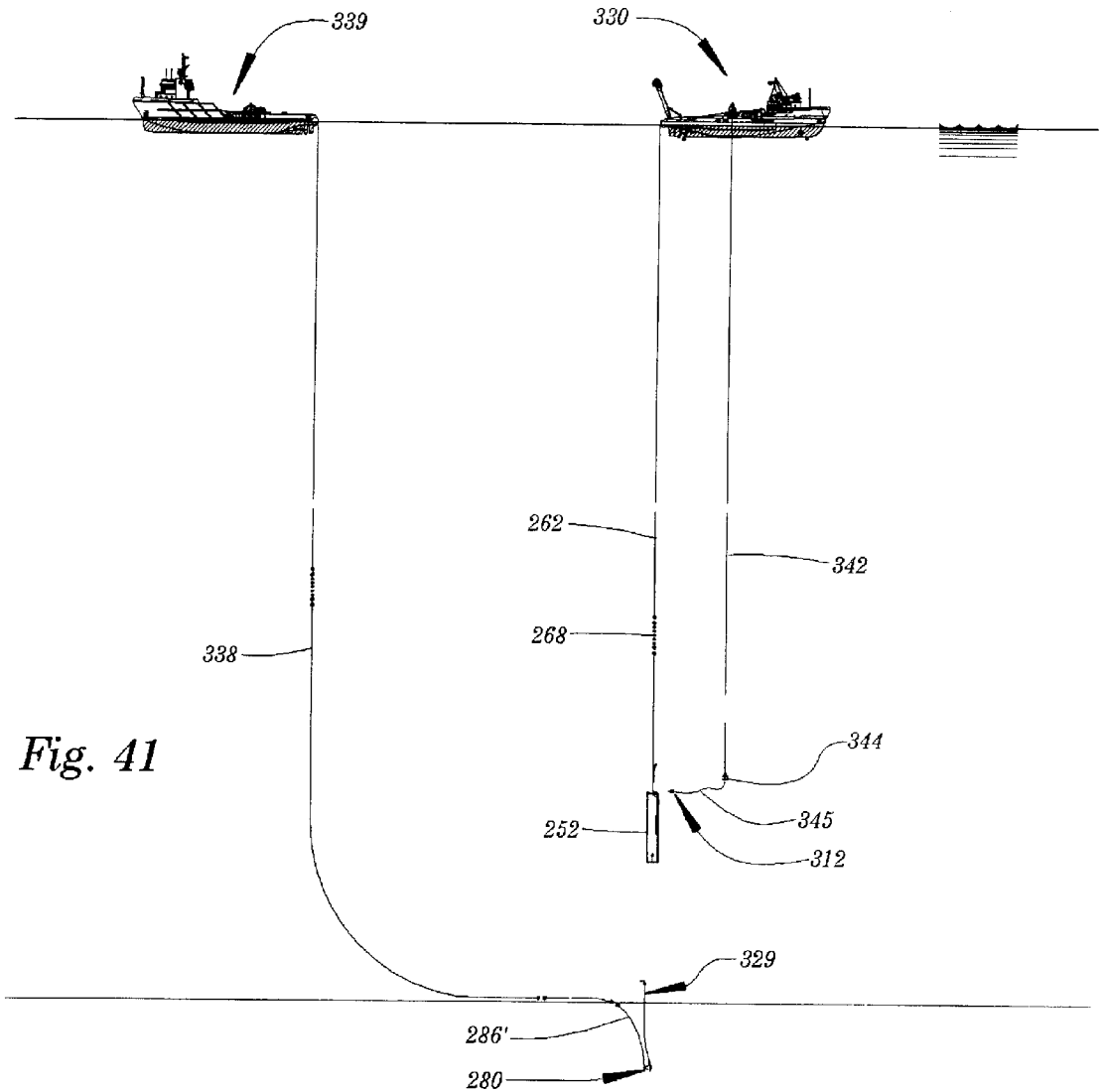
FIG. 41 is an illustration of a still later step in the method of FIG. 23.

As is shown in FIG. 41, the next step in the procedure is the recovery of the suction follower 252 to the deck of the anchor handling vessel 330, whereupon the suction follower 252 is available for use in installing another plate anchor. The steps involved in recovering the suction follower 252 to the deck of the vessel 330 are substantially identical to those illustrated in FIGS. 24 through 33, inclusive, and described hereinabove in conjunction therewith. Of course, the process steps described in conjunction with the installation of the plate anchor utilizing the suction follower 252 are carried out in reverse order in the recovery of the suction follower 252 to the deck of the vessel 330.

Figure 42:
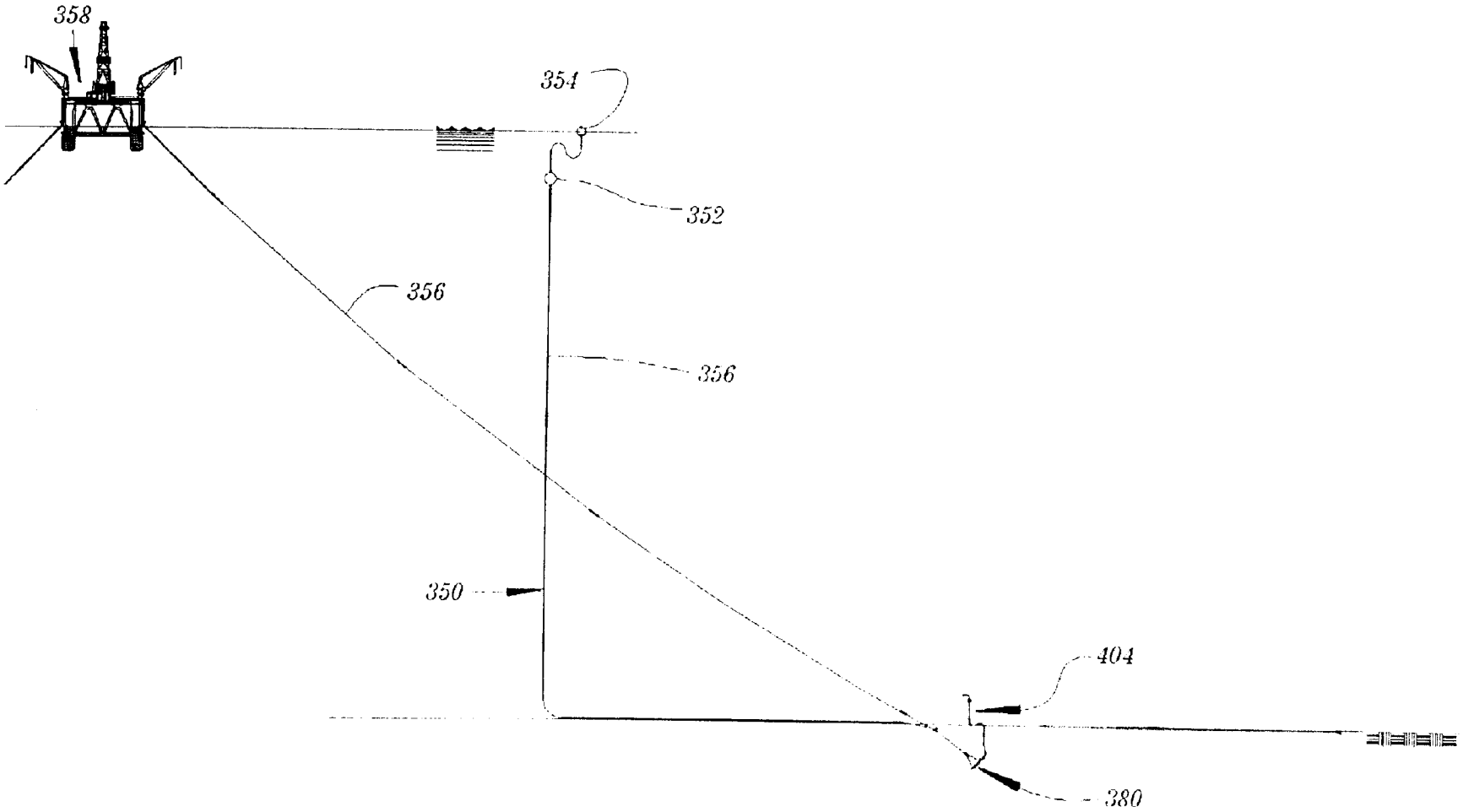
FIG. 42 is a diagrammatic illustration of an anchor installation made in accordance with the invention showing the anchor installation in both the preset condition and in the moored condition.
Figure 43:
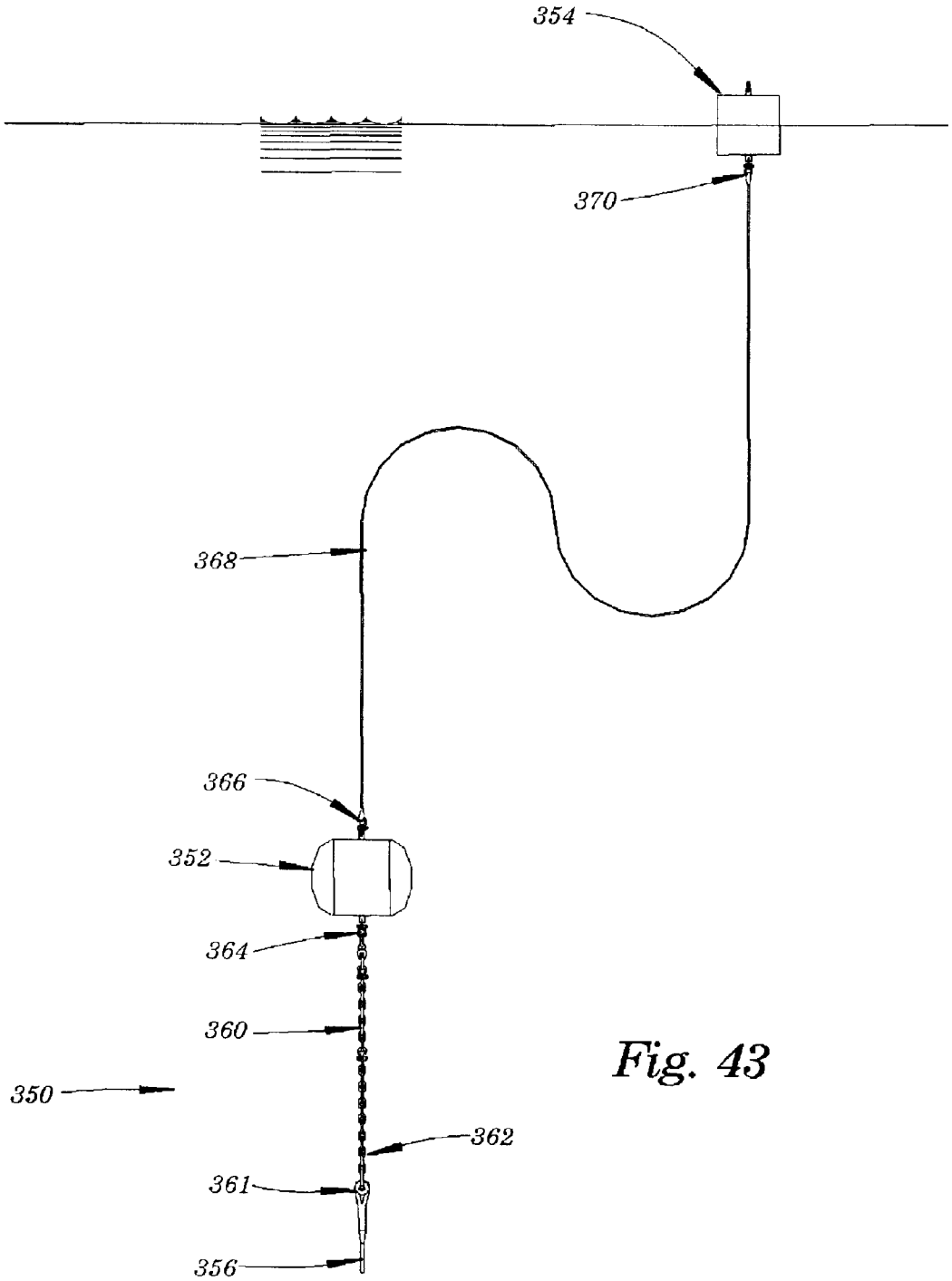
FIG. 43 is an enlargement of the upper portion of FIG. 42.
Figure 44:
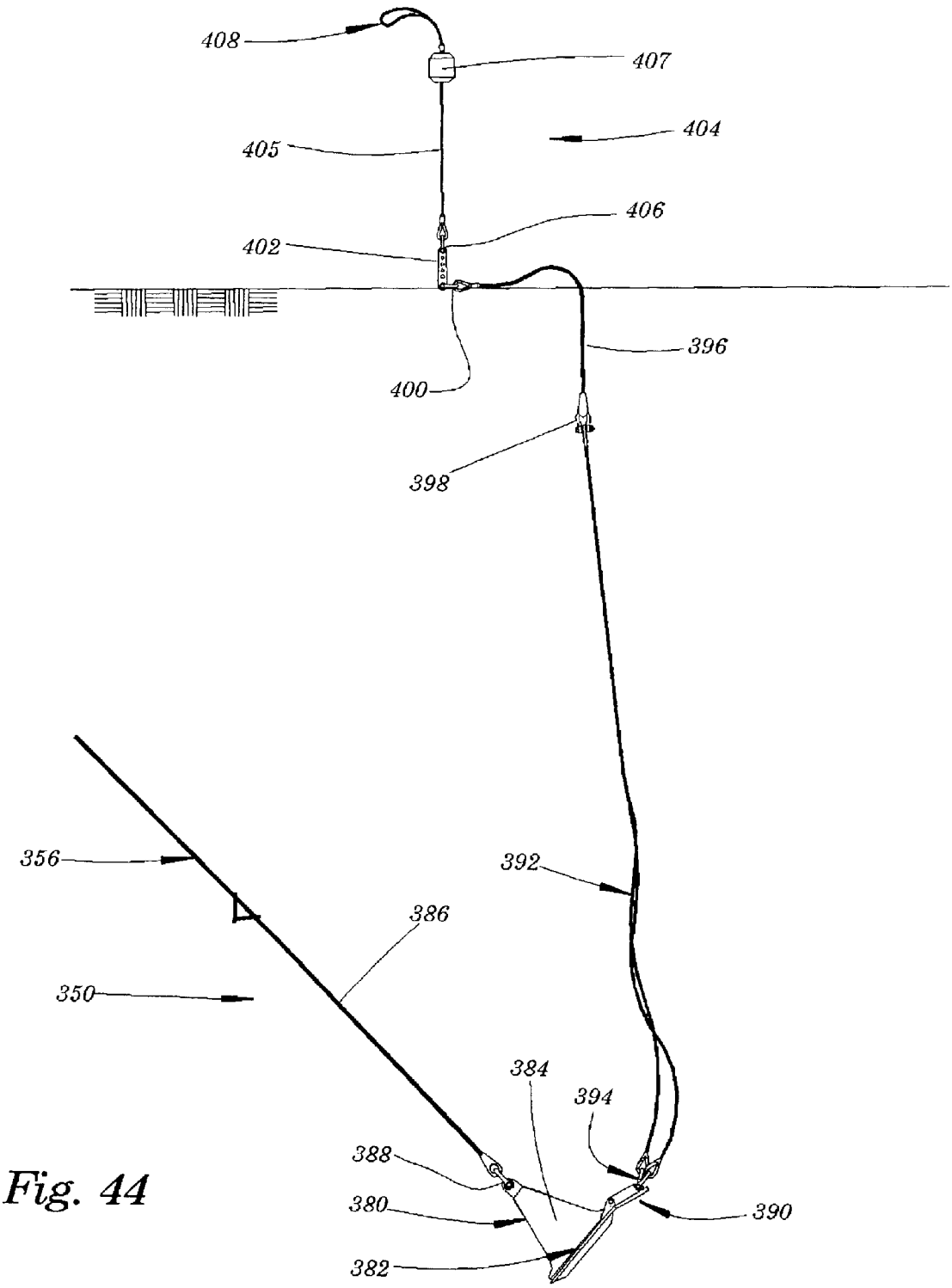
FIG. 44 is an illustration of the lower portion of FIG. 42.

FIGS. 42, 43, and 44 illustrate a mooring leg assembly 350 which is shown in both the preset condition wherein a submerged buoy 352 and a surface buoy 354 position the upper end of a mooring line 356 for subsequent connection to an MODU, and in the moored condition wherein the mooring line 356 is connected to an MODU 358. As is best shown in FIG. 43, the mooring line 356 preferably comprises a polyester rope. The mooring line 356 is preferably connected to a ballast chain 360 by a rope splice with a thimble 361 and an elongated shackle 362. The ballast chain 360 is connected to the submerged buoy 352 by a shackle 364. A shackle 366 connects the submerged buoy 352 to a polypropylene rope 368. A shackle 370 connects the opposite ends of the polypropylene rope 368 to the surface buoy 354. Upon connection of the mooring line 356 to an MODU, such as the MODU 358 illustrated in FIG. 23, the component parts above the shackle 362 are disconnected from the mooring line 356 and are recovered either to an anchor handling vessel or to the MODU.

Referring to FIG. 44, the mooring system 350 further includes a plate anchor 380 which preferably comprises one of the plate anchors illustrated in FIGS. 15 through 19, inclusive, and described hereinabove in connection therewith. The plate anchor 380 includes a major plate portion 382 having a shank 384 extending therefrom which is connected to the forerunner chain 386 of the mooring line 356 by a shackle 388. The anchor 380 further includes a minor plate portion 390 which is pivoted relative to the major plate portion 382 to prevent upward movement of the plate anchor 380 responsive to loads imposed thereon through the mooring line 356.

A bridle 392 is connected to the minor plate portion 390 of the plate anchor 380 by shackles 394 and is in turn connected to a wire 396 by a shackle 398. A shackle 400 connects the wire 396 to a dog bone connector 402. It will be understood that the bridle 392, the wire 396, and the dog bone connector 402 function to secure the plate anchor 380 in engagement with a suction follower during installation of the plate anchor. Following installation of the plate anchor, the bridle 392, the wire 396, and the dog bone connector 402 connect the plate anchor 380 to a recovery assembly 404.

The recovery assembly 404 includes a recovery wire 405 which is connected to the dog bone connector 402 by a shackle 406. The recovery wire 405 is in turn connected to a 1.3 KIP submersible buoy 407. A soft eye 405 is connected to the upper end of the submersible buoy 407 for engagement by a hook secured at the bottom of a recovery wire extending downwardly from an anchor handling vessel.

Figure 45:
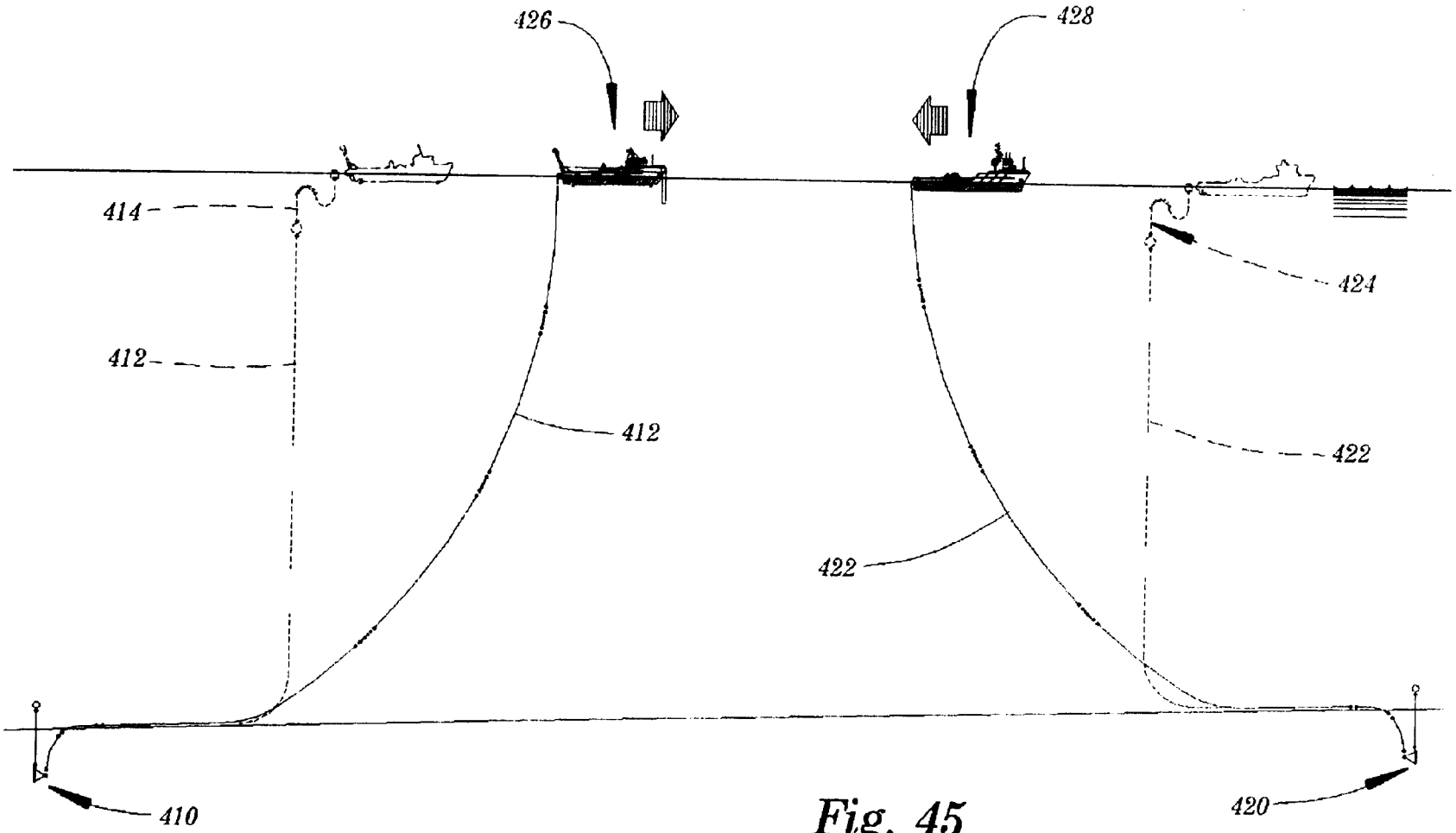
FIG. 45 is an illustration of a first step in a method of testing anchor installations made in accordance with the invention.

A method of testing the holding power of plate anchors installed in accordance with the method of the present invention is illustrated in FIGS. 45, 46, 47, and 48. Referring specifically to FIG. 45, a first plate anchor 410 constructed in accordance with the present invention and installed in accordance with the method of the present invention has a mooring line 412 extending therefrom. A submerged buoy/surface buoy assembly 414 constructed as illustrated in FIG. 43 and described hereinabove in conjunction therewith is initially secured to the upper end of the mooring line 412. A second plate anchor 420 constructed in accordance with the present invention and installed in accordance with the method of the invention has a mooring line 422 extending therefrom. A submerged buoy/surface buoy assembly 424 constructed as illustrated in FIG. 23 and described hereinabove in conjunction therewith is initially connected to the upper end of the mooring line 422.

The mooring line 412 is recovered by a first anchor handling vessel 426. The submerged buoy/surface buoy assembly 414 is disengaged from the mooring line 412, and the mooring line 412 is connected to a winch on the vessel 426. Likewise, the mooring line 422 is recovered by a second anchor handling vessel 428 and the submerged buoy/floating buoy assembly 424 is disengaged therefrom.

Figure 46:
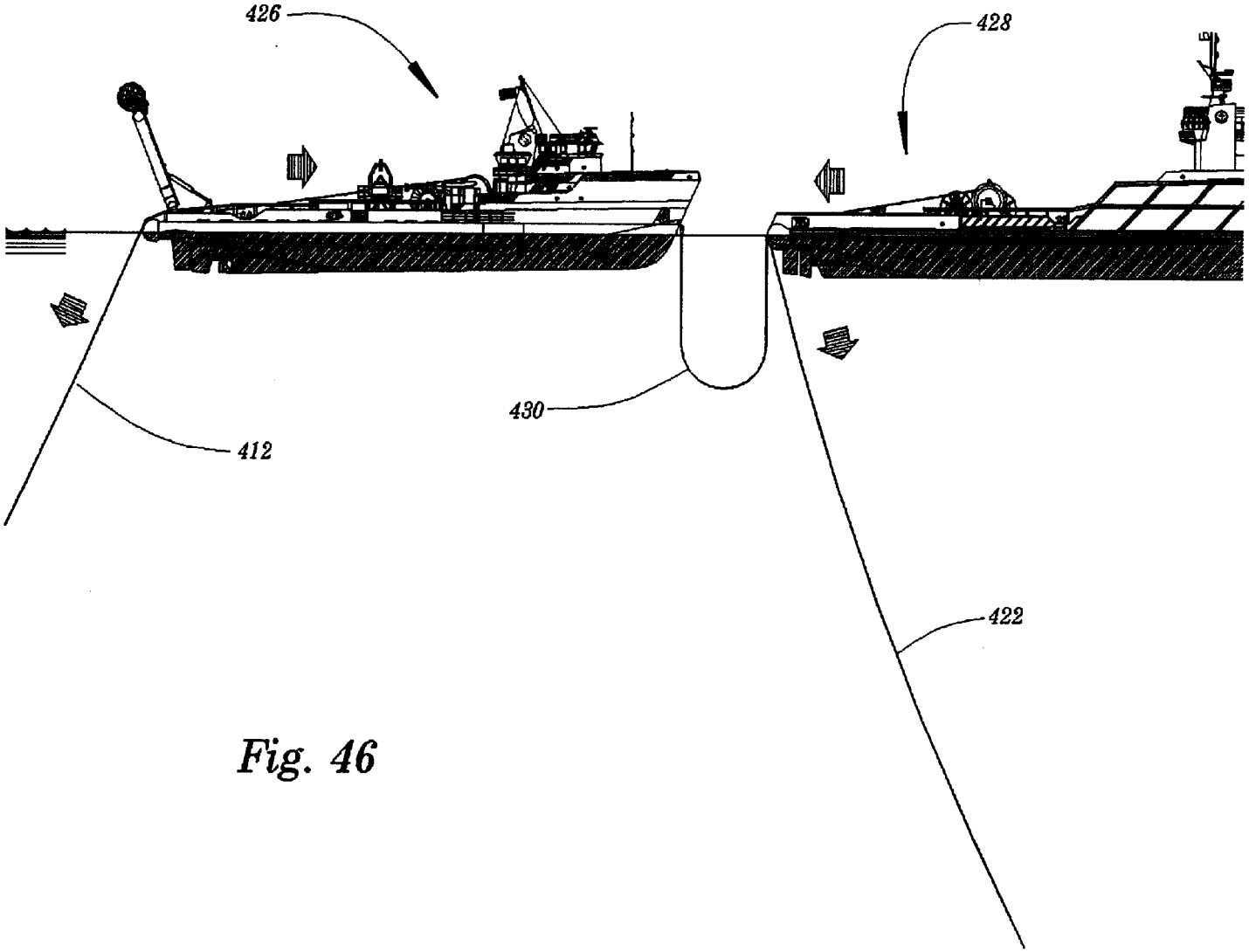
FIG. 46 is an illustration of a later step in the method of FIG. 45.
Figure 47:
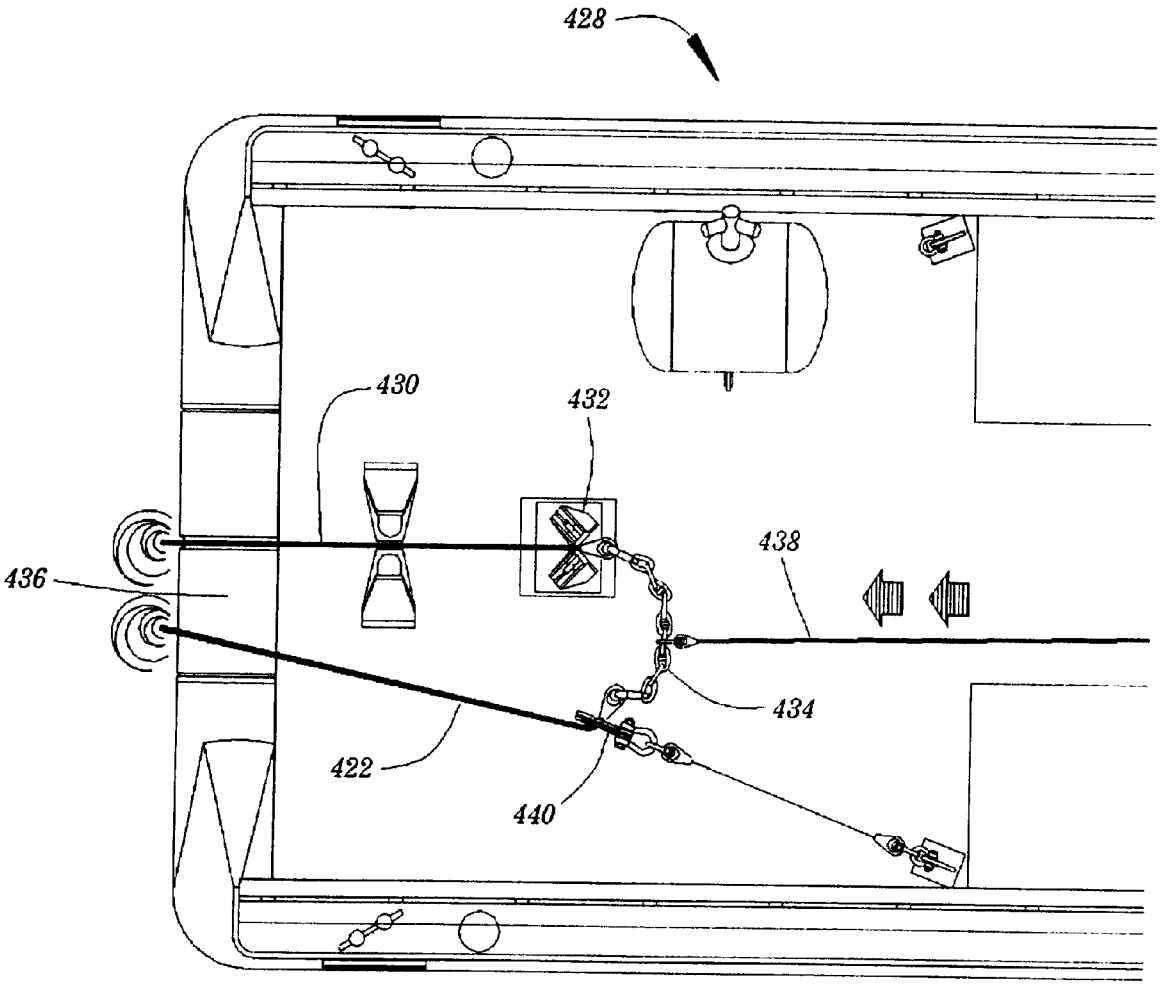
FIG. 47 is a top view further illustrating the step in the method of FIG. 46.

Referring to FIGS. 46 and 47, a pendant wire 430 is extended from the bow of the vessel 426. The distal end of the pendant wire 430 is captured in the shark's jaw 432 of the vessel 428. The mooring line 422 having a chain section 434 at the distal end thereof is pulled over the stern roller 436 of the vessel 428 by a line 438 extending from a winch on the vessel 428. The mooring line 422 is secured by a clamp 440 while the chain 434 is connected to the distal end of the pendant wire 430. Following connection of the chain 434 to the pendant wire 430, a surface buoy and buoy pendant line are connected to the chain 434, whereupon the shark's jaw 432 and the clamp 440 are released and the line 438 is payed out to lower the chain 434 having the distal ends of the work wire 432 and the mooring line 422 over the stern roller 436.

Figure 48:
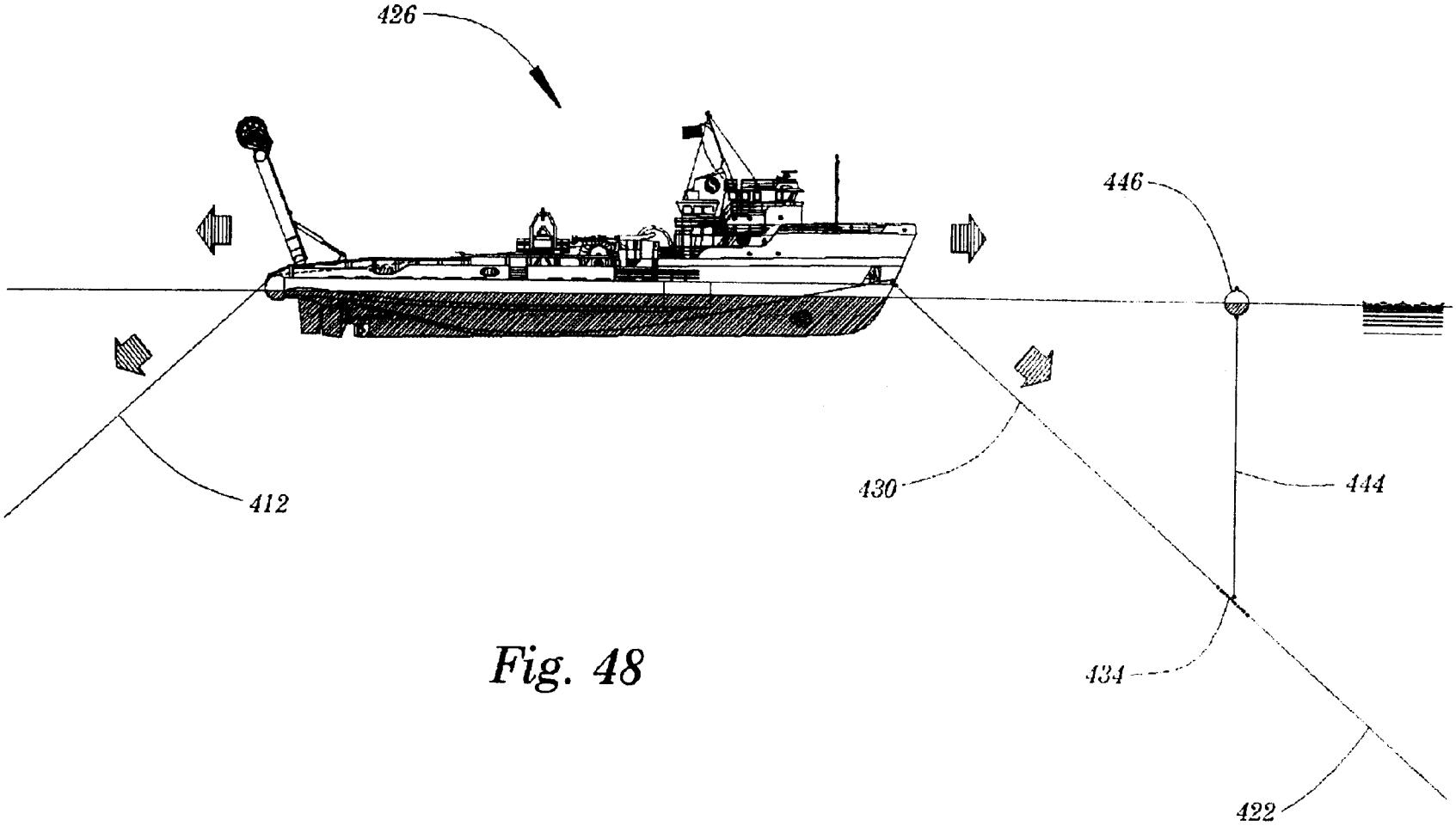
FIG. 48 is an illustration of a still later step in the method of FIG. 45.

The result of the foregoing operations is illustrated in FIG. 48. The mooring line 412 extends over the stern roller 442 of the vessel 446 and is operatively connected to a winch on the vessel 426. The pendant wire 430 is connected to the bow of the vessel 426 and extends to one end of the chain 434. The mooring line 422 is connected to the opposite end of the chain 434. A buoy pendant line 444 is connected to the chain 434 and extends upwardly therefrom to a surface buoy 446.

After the foregoing connections are made, the winch on the vessel 426 is operated to apply a predetermined load. In this manner, the plate anchors 410 and 420 are rotated from their vertical positions in FIG. 45 to a position virtually perpendicular to the loads in mooring lines 412 and 422, which process is called keying of the plate anchors. Upon completion of the testing procedures, the foregoing connection steps are reversed, the submerged buoy/surface buoy assemblies 414 and 424 are reconnected to the upper ends of the mooring lines 412 and 422, respectively, and the anchors 410 and 420 are ready for use in mooring an MODU connected therebetween.

Figure 49:
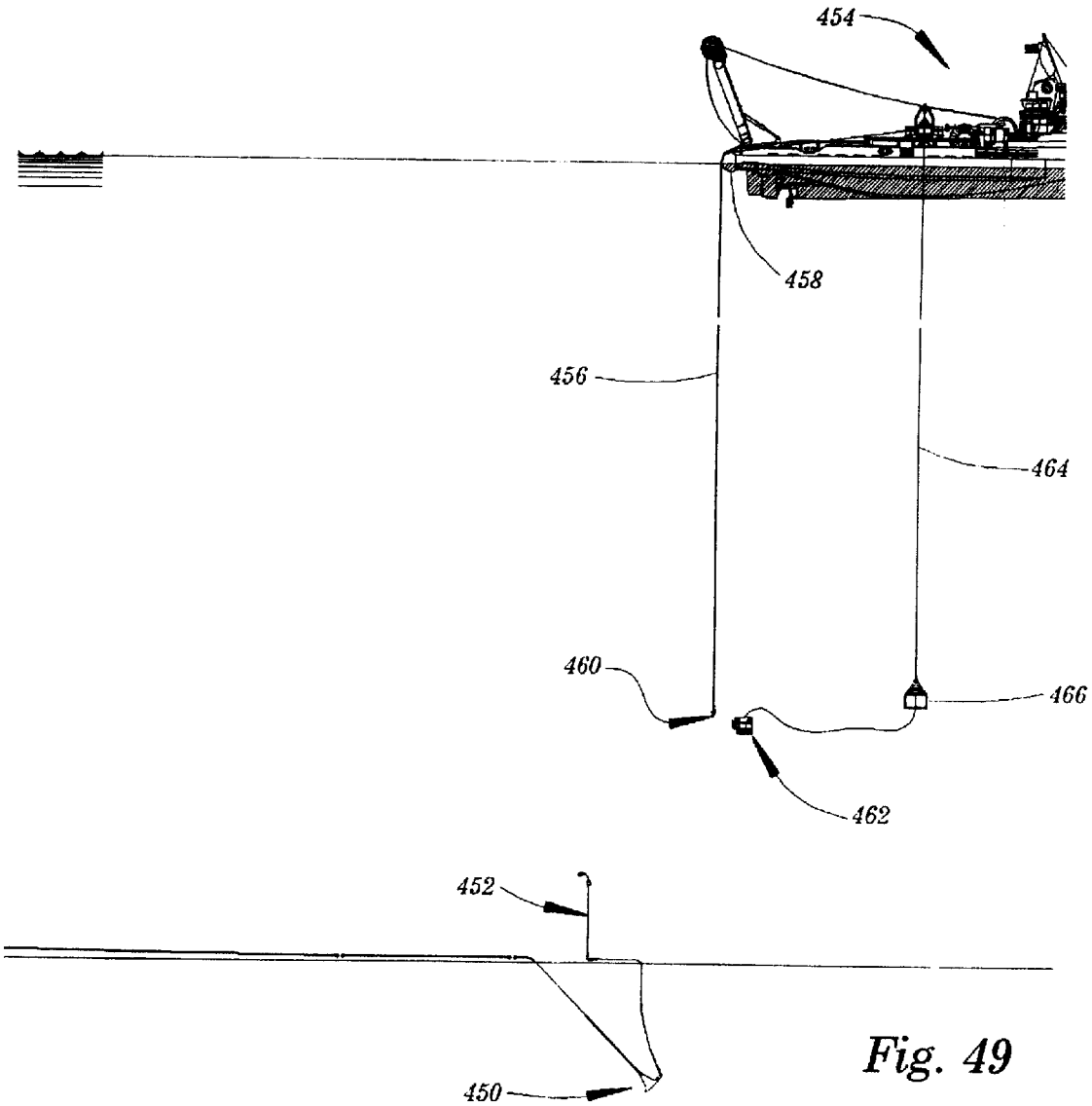
FIG. 49 is an illustration of an early step in a method of anchor recovery utilizing the practice of the invention.

A method of recovering plate anchors constructed in accordance with the present invention and installed in accordance therewith is illustrated in FIGS. 49 through 54, inclusive. Referring particularly to FIG. 49, a plate anchor 450 is installed in the sea floor and has a recovery assembly 452 extending upwardly therefrom. An anchor handling vessel 454 has a recovery line 456 extending downwardly therefrom. The recovery line 456 is operatively connected to a winch on the vessel 454 and is deployed over the stern roller 458 thereof. A recovery hook 460 is mounted at the distal end of the line 456.

A remotely operated vehicle 462 is also deployed from the anchor handling vessel 454. The remotely operated vehicle 462 may comprise a Racal Sea Lion Mk II heavy work class remotely operated vehicle having 100 horsepower; however, any of the various commercially available remotely operated vehicles having 75 horsepower or more can be used in the practice of the invention. The remotely operated vehicle 462 is deployed from the vessel 454 on a line 464 extends to a tether management system 466.

Figure 50:
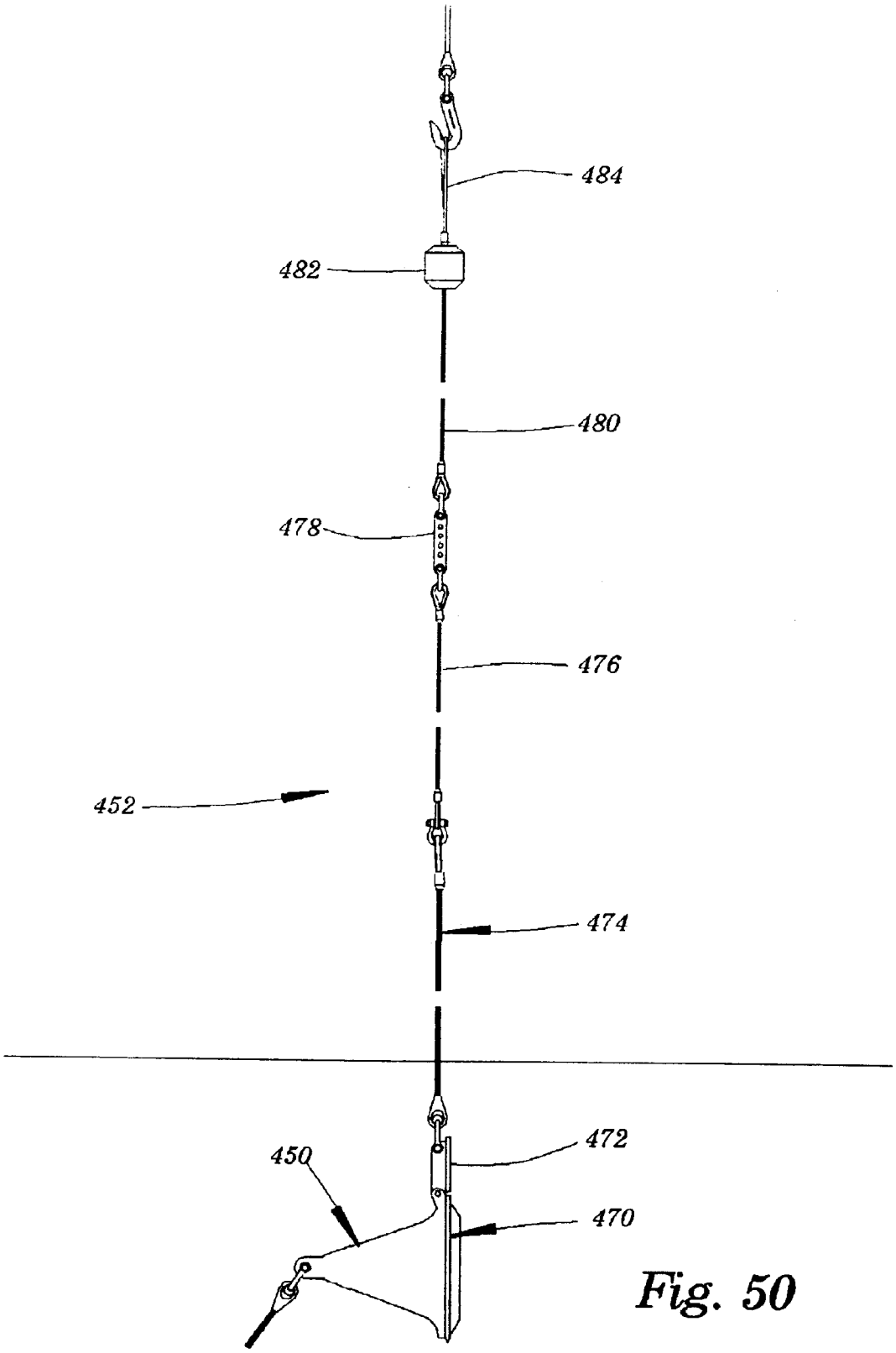
FIG. 50 is an illustration of a later step in the method of FIG. 49.

The construction of the plate anchor 450 and the recovery assembly 452 are further illustrated in FIG. 50. The anchor 450 includes a major plate portion 470 and a minor plate portion 472 which is hingedly secured to the major plate portion 470. The recovery assembly 452 includes a recovery bridle 474 connected to the opposite ends of the minor plate portion 472 of the anchor 450. A retainer wire 476 extends from the upper end of the bridle 474 to a dog bone connector 478. A buoy pendant wire 480 extends from the dog bone connector 478 to a submerged buoy 482. A soft eye extends from the buoy 482 and comprises the uppermost component of the recovery assembly 452.

Figure 51:
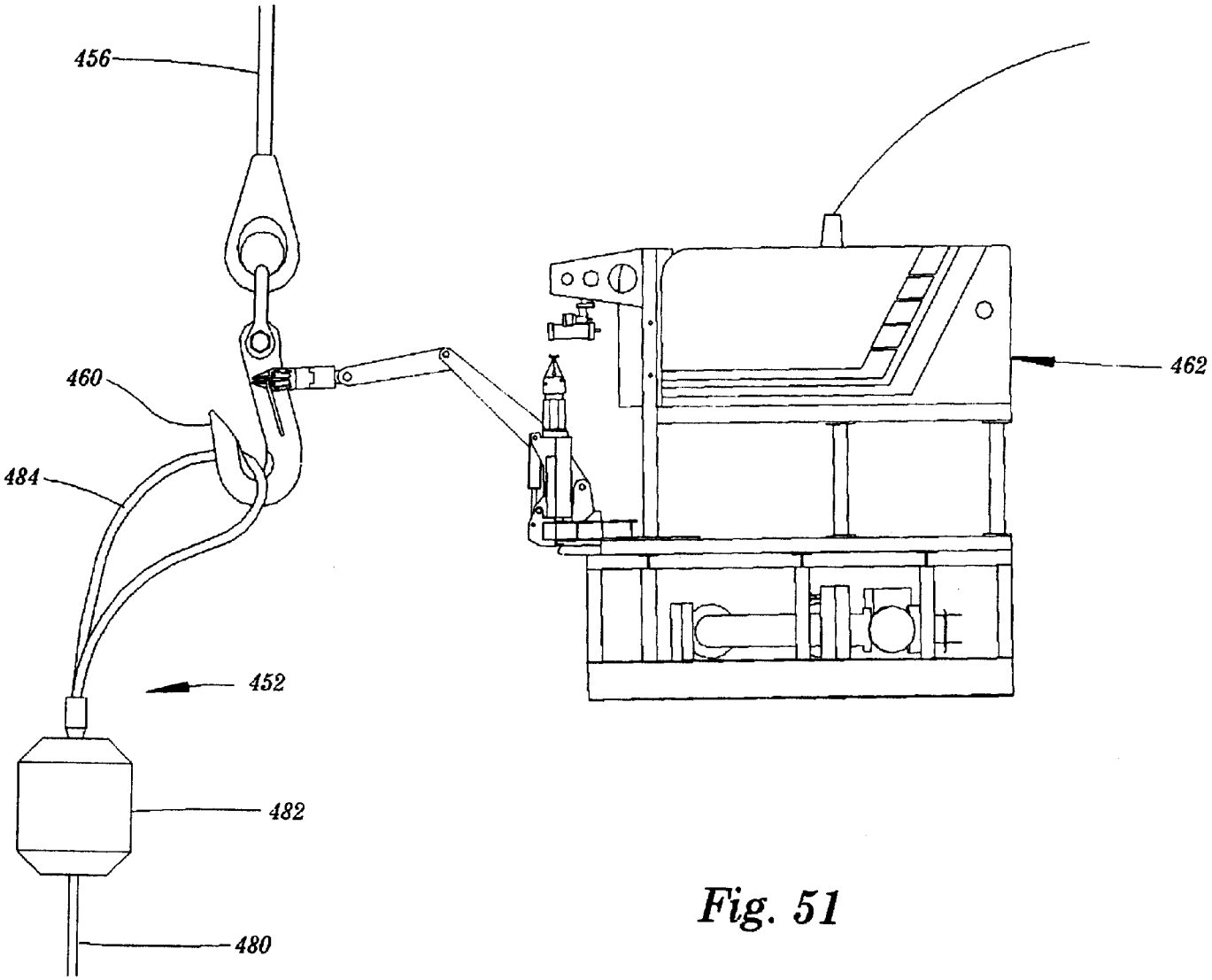
FIG. 51 is an enlarged view further illustrating the step of FIG. 50.

As is best shown in FIG. 51, the remotely operated vehicle 462 connects the recovery hook 460 secured at the distal end of the recovery line 456 to the soft eye 484 of the recovery assembly 452.

Figure 52:
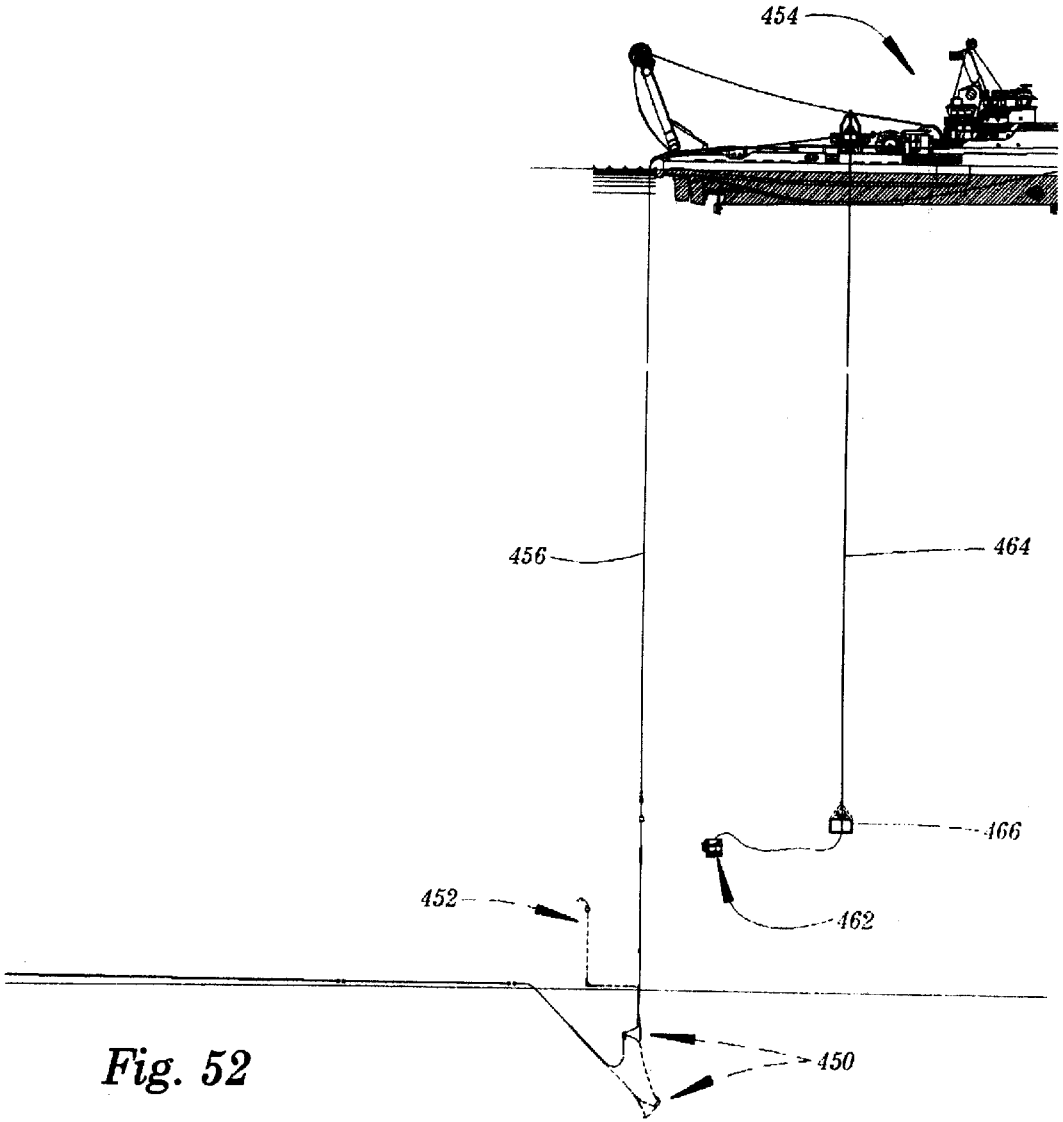
FIG. 52 is an illustration in a later step in the method of FIG. 49.
Figure 53:
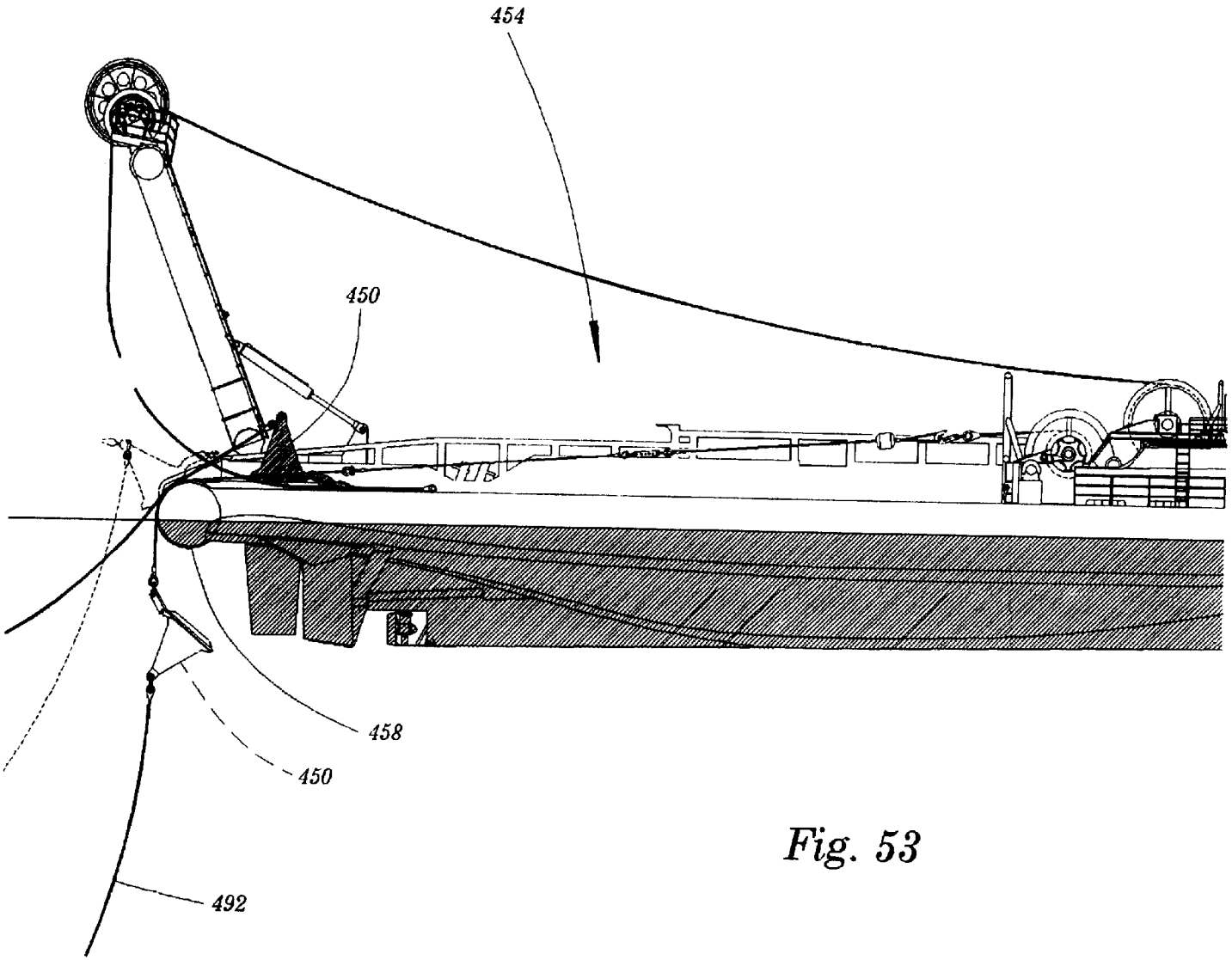
FIG. 53 is an illustration of a still step in the method of FIG. 49.
Figure 54:
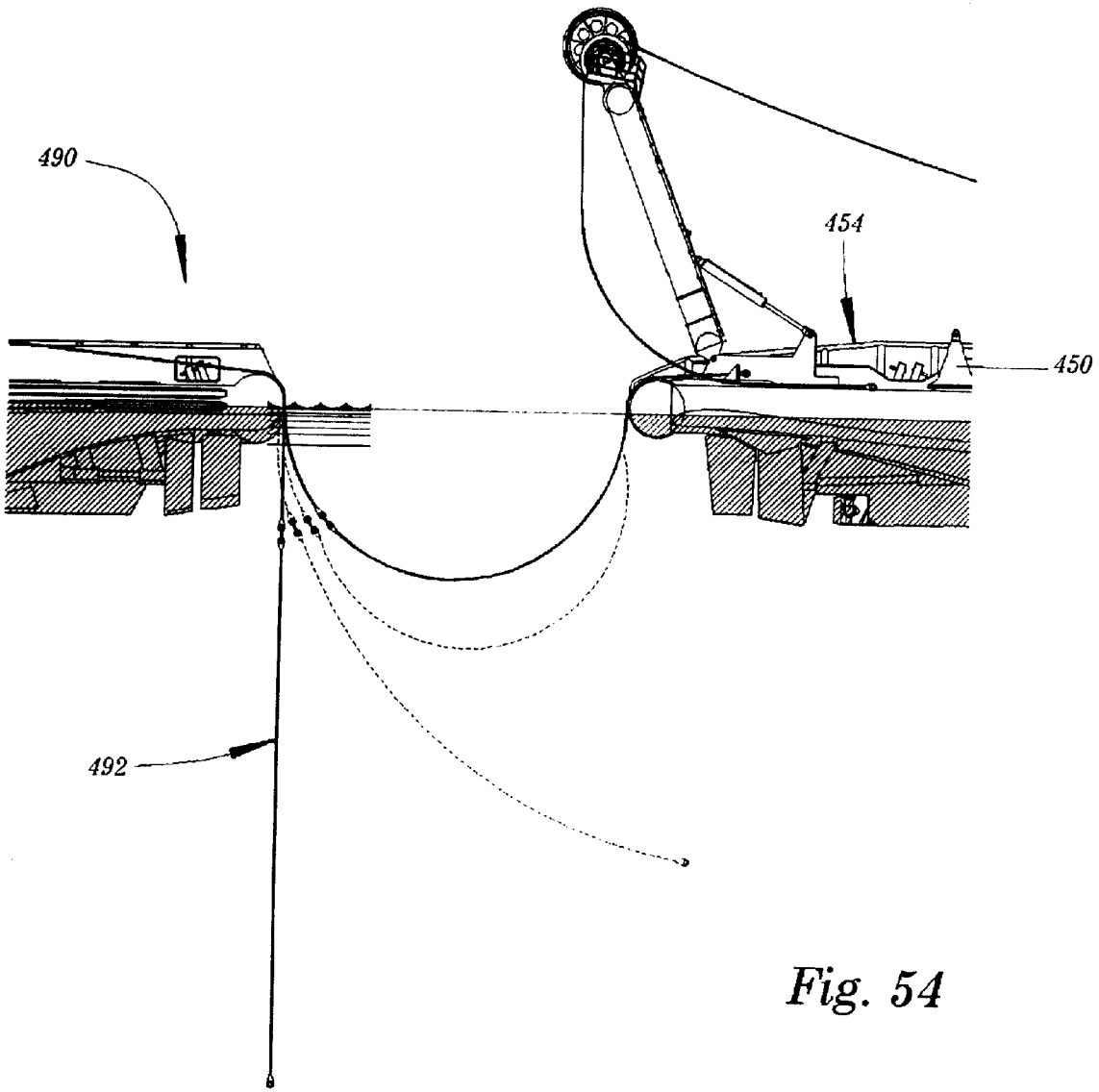
FIG. 54 is an illustration of a still step in the method of FIG. 49.

Referring to FIGS. 52, 53, and 54, the recovery line 456 is drawn upwardly by the winch on the vessel 454 until the plate anchor 450 is pulled onto the deck of the vessel over the stern roller 458 thereof. Meanwhile, a second anchor handling vessel 490 retrieves the distal end of the mooring line 492 extending from the plate anchor 450. The mooring line 492 is disconnected from the plate anchor 450 and is put in a stopper. The vessel 490 continues to retrieve the mooring line 492 and is gradually drawn closely adjacent to the vessel 454. At this point the mooring line is released from the stopper and is recovered on board the vessel 490.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. A plate anchor comprising:

a first plate member having opposed sides and at least one edge;

a shank secured to one side of the first plate member;

apparatus mounted on the shank at a location substantially spaced apart from the point of attachment of the shank to the first plate member for securing the plate anchor to a mooring line; and a second plate member hingedly mounted on the first plate member along the edge thereof for pivotal movement between a first position wherein the second plate member extends parallel to the first plate member and a second position wherein the second plate member is substantially angularly disposed relative to the first plate member.

2. The plate anchor according to claim 1 further including cooperating apparatus on the first and second plate members for preventing pivotal movement of the second plate member relative to the first plate member beyond the first and second positions.

3. The plate anchor according to claim 2 wherein the first plate member has leading and trailing edges, and wherein the second plate member is hingedly secured to the first plate member at the trailing edge thereof.

4. The plate anchor according to claim 3 wherein the first plate member is rectangular in shape and has a relatively large surface area, and wherein the second plate member is also rectangular in shape and has a relatively small surface area as compared with the first plate member.

5. The plate anchor according to claim 4 wherein the first plate member has a predetermined length and wherein the shank is secured to the first plate member at spaced apart locations which are separated by a distance of about one half of the predetermined length.

6. A plate anchor comprising:

a major plate portion having a leading edge and a trailing edge;

a minor plate portion having a leading edge and a trailing edge;

a hinge mechanism supporting the minor plate portion on the major plate portion with the leading edge of the minor plate portion extending adjacent the trailing edge of the major plate portion for pivotal movement between a first position wherein the minor plate portion extends parallel to the major plate portion and a second position wherein the minor plate portion is substantially angularly disposed relative to the major plate portion;

a shank mounted on the major plate portion and extending therefrom a predetermined distance; and apparatus mounted at the distal end of the shank for securing the plate anchor to a mooring line.

7. The plate anchor according to claim 6 wherein the major plate portion and the minor plate portion are each rectangular in configuration, and wherein the major plate portion has a substantially larger surface area than the major plate portion.

8. The plate anchor according to claim 7 further including cooperating structure on the major plate portion and the minor plate portion for preventing pivotal movement of the minor plate portion relative to the major plate portion beyond the first and second locations.

9. The plate anchor according to claim 8 wherein the minor plate portion extends angularly away from the shank when the minor plate portion is in the second location relative to the first plate portion.

10. The plate anchor according to claim 8 wherein the minor plate portion extends angularly toward the shank when the minor plate portion is in the second position relative to the first plate portion.

11. A plate anchor comprising:

a first plate member rectangular in shape and having a relatively large surface area;

a second plate member rectangular in shape and having a relatively small surface area;

at least one hinge securing the second plate member to the first plate member for pivotal movement between a first position wherein the second plate member extends parallel to the first plate member and a second position wherein the second plate member extends angularly relative to the first plate member; and a shank mounted on the first plate member for securing the plate anchor to a mooring line.

12. The plate anchor according to claim 11 further including attachment apparatus mounted at the distal end of the shank for securing the plate anchor to a mooring line and located a predetermined distance from the first plate member.

13. The plate anchor according to claim 11 wherein the first plate member has a leading edge and a trailing edge, wherein the second plate member has a leading edge and a trailing edge, and wherein the hinge supports the second plate member on the first plate member with the leading edge of the second plate member extending adjacent the trailing edge of the first plate member.

14. The plate anchor according to claim 11 wherein the shank has an inverted V-shaped configuration, and wherein the divergent ends of the shank are secured to the first plate member at predetermined locations which are spaced apart by a distance equal to about half of the overall length of the first plate member.

15. The plate anchor according to claim 11 further including apparatus for preventing pivotal movement of the second plate member relative to the first plate member beyond the first and second positions.

16. A method of anchor installation comprising:

providing a first plate member having a leading edge and a trailing edge;

providing a second plate member having a leading edge and a trailing edge;

hingedly supporting the second plate member on the first plate member with the leading edge of the second plate member extending adjacent the trailing edge of the first plate member;

forcing the leading edge of the first plate member downwardly into the sea floor until the plate anchor is positioned at a predetermined depth in the sea floor;

subsequently applying an anchoring load to the first plate member; and pivoting the second plate member into an angular relationship relative to the first plate member in response to upward movement of the first plate member and thereby preventing further upward movement of the first plate member in the sea floor.

17. The method according to claim 16 wherein the step of providing a first plate member is carried out by providing a first plate member having a rectangular configuration and a relatively large area, and wherein the step of providing a second plate member is carried out by providing a second plate member having a rectangular configuration and a relatively small surface area.

18. The method according to claim 17 including the additional step of securing a shank to the first plate member, and wherein the step of applying a load to the first plate member is carried out by applying the load to the distal end of the shank.

19. The method according to claim 18 including the additional step of preventing pivotal movement of the second plate member relative to the first plate member beyond a first location wherein the second plate member extends parallel to the first plate member and a second location wherein the second plate member extends substantially angularly relative to the first plate member.

20. The method according to claim 19 wherein the step of pivoting the second plate member relative to the first plate member is carried out by pivoting the second plate member away from the location of the shank on the first plate member.

21. The method according to claim 19 wherein the step of pivoting the second plate member relative to the first plate member is carried out by pivoting the second plate member toward the shank mounted on the first plate member.

* * * * *